US011490651B2

(12) United States Patent
Williams et al.

(10) Patent No.: US 11,490,651 B2
(45) Date of Patent: Nov. 8, 2022

(54) TONGUE AND TONGUE ASSEMBLY WITH INJECTION PORT FOR ROD FORMING APPARATUS, ROD FORMING APPARATUS WITH TONGUE ASSEMBLY AND METHOD OF INSTALLING TONGUE ASSEMBLY ON ROD FORMING APPARATUS

(71) Applicant: Altria Client Services LLC, Richmond, VA (US)

(72) Inventors: Dwight D. Williams, Powhatan, VA (US); Patrick S. McElhinney, Chesterfield, VA (US)

(73) Assignee: Altria Client Services LLC, Richmond, VA (US)

( * ) Notice: Subject to any disclaimer, the term of this patent is extended or adjusted under 35 U.S.C. 154(b) by 266 days.

(21) Appl. No.: 16/663,827

(22) Filed: Oct. 25, 2019

(65) Prior Publication Data

US 2021/0120864 A1 Apr. 29, 2021

(51) Int. Cl.

| | |
|---|---|
| ***A24C 5/18*** | (2006.01) |
| ***A24C 5/24*** | (2006.01) |
| ***A24C 5/12*** | (2006.01) |
| ***A24C 3/00*** | (2006.01) |
| ***A24C 1/12*** | (2006.01) |

(Continued)

(52) U.S. Cl.

CPC ..... *A24C 5/1892* (2013.01); *A24C 1/12* (2013.01); *A24C 1/34* (2013.01); *A24C 1/36* (2013.01); *A24C 3/00* (2013.01); *A24C 5/12* (2013.01); *A24C 5/1807* (2013.01); *A24C 5/24* (2013.01)

(58) Field of Classification Search

CPC ..... A24C 5/12; A24C 5/1892

USPC ..... 131/284

See application file for complete search history.

(56) References Cited

U.S. PATENT DOCUMENTS 302,521 A * 7/1884 Pollard ..... A24C 5/1807 131/66.1

529,544 A * 11/1894 Barth ..... A24C 1/18 131/85

1,630,488 A 5/1927 Di Ianni (Continued)

FOREIGN PATENT DOCUMENTS

GB 579029 A 7/1946

OTHER PUBLICATIONS

Notice of Allowance dated Jul. 21, 2021, issued in corresponding U.S. Appl. No. 16/663,886.

(Continued)

*Primary Examiner* — Kelly M Gambetta
*Assistant Examiner* — Russell E Sparks
(74) *Attorney, Agent, or Firm* — Harness, Dickey & Pierce, P.L.C.

(57) ABSTRACT

The tongue includes a shaft, the shaft being hollow. The shaft includes a first end and a second end, the first end defining a first opening with a first radius of curvature, and the second end defining a second opening with a second radius of curvature. The first radius of curvature is larger than the second radius of curvature. The shaft defines at least one injection port that traverses through an inner surface of the shaft. A first plate is connected to the shaft. The first plate includes an engaging structure configured to mount the tongue onto a lower plate and align the shaft with a groove defined by the lower plate. The rod forming apparatus includes the tongue. The method installs the tongue onto the rod forming apparatus.

32 Claims, 36 Drawing Sheets

(51) Int. Cl.
*A24C 1/34* (2006.01)
*A24C 1/36* (2006.01)

(56) References Cited

U.S. PATENT DOCUMENTS 1,723,942 A * 8/1929 Koerner ..... A24C 5/1807 131/84.1
1,838,110 A * 12/1931 Rundell ..... A24C 5/1807 131/60
1,971,869 A * 8/1934 Molins ..... A24C 5/1807 131/66.1
2,617,426 A * 11/1952 Patterson ..... A24C 5/1807 131/287
2,757,675 A * 8/1956 Powell ..... A24C 5/3412 131/84.1
2,759,482 A * 8/1956 Harding ..... A24C 5/14 131/66.1
4,010,762 A 3/1977 Strydom
4,186,754 A * 2/1980 Labbe ..... A24C 5/1892 131/288
4,619,276 A 10/1986 Albertson et al.
4,917,118 A 4/1990 Mangiarotti
4,979,521 A 12/1990 Davis et al.
5,413,121 A 5/1995 Dawson et al.
5,810,016 A 9/1998 Okumoto
7,827,994 B2 11/2010 Spiers et al.
9,295,284 B2 3/2016 Prestia et al.
2007/0193591 A1 8/2007 Andersen et al.
2014/0048083 A1 2/2014 Williams et al.
2017/0013872 A1* 1/2017 Williams ..... A24C 1/38

OTHER PUBLICATIONS

Notice of Allowance dated Jun. 8, 2021, issued in corresponding U.S. Appl. No. 16/663,787.
Notice of Allowance dated Oct. 29, 2021, issued in corresponding U.S. Appl. No. 16/663,787.

* cited by examiner (VIEW F-F)

(VIEW G-G)

(VIEW A-A)

(VIEW B-B)

TONGUE AND TONGUE ASSEMBLY WITH INJECTION PORT FOR ROD FORMING APPARATUS, ROD FORMING APPARATUS WITH TONGUE ASSEMBLY AND METHOD OF INSTALLING TONGUE ASSEMBLY ON ROD FORMING APPARATUS

BACKGROUND

Field

Example embodiments generally relate to a tongue and a tongue assembly, with an injection port, for a rod forming apparatus, a rod forming apparatus with the tongue assembly, and a method of installing the tongue assembly on the rod forming apparatus.

Description of Related Art

During the manufacture of cigars, tobacco can have a relatively high cost. Therefore, an efficient use of tobacco is important. High-quality cigars should be uniformly and consistently filled.

SUMMARY

At least one example embodiment is directed toward a tongue for rod forming.

In one embodiment, the tongue includes a shaft, the shaft being hollow, the shaft including a first end and a second end, the first end defining a first opening with a first radius of curvature, the second end defining a second opening with a second radius of curvature, the first radius of curvature being larger than the second radius of curvature, the shaft defining at least one injection port that traverses through an inner surface of the shaft; and a first plate connected to the shaft, the first plate including an engaging structure configured to mount the tongue onto a lower plate and align the shaft with a groove defined by the lower plate.

In one embodiment, the first opening has a first cross-sectional flow area that is larger than a second cross-sectional flow area of the second opening.

In one embodiment, the inner surface is arcuate-shaped and has a continually reducing radius of curvature from the first end to the second end of the shaft.

In one embodiment, the at least one injection port is configured to inject at least one substance onto the inner surface, the at least one substance being at least one of water, at least one flavorant, at least one additive, or combinations thereof.

In one embodiment, the at least one injection port traverses a centerline of the inner surface, the centerline running along a longitudinal length of the inner surface.

In one embodiment, the at least one injection port includes a single injection port.

In one embodiment, the at least one injection port includes two injection ports.

In one embodiment, the at least one injection port includes a first plurality of injection ports that are located at a first position along a longitudinal length of the shaft.

In one embodiment, the first plurality of injection ports includes, at least one first injection port that traverses a centerline of the inner surface, the centerline running along the longitudinal length of the shaft, at least one second injection port traversing a first side of the inner surface, and at least one third injection port traversing a second side of the inner surface, the first side and the second side being on either side of the centerline.

In one embodiment, the at least one injection port includes a second plurality of injection ports that are located at a second position along a longitudinal length of the shaft.

In one embodiment, the first position is near the first end of the shaft.

In one embodiment, the second position is near a mid-section of the shaft.

In one embodiment, the second position is between a mid-section of the shaft and the second end of the shaft.

In one embodiment, the engaging structure is at least one of a mounting bolt hole or a slot.

In one embodiment, the shaft further includes, a tapered entrance connected to the first end of the shaft, the tapered entrance defining an enlarged opening, the first opening having a first cross-sectional flow area that is smaller than a second cross-sectional area of the enlarged opening.

In one embodiment, the first cross-sectional flow area is larger than a third cross-sectional flow area of the second opening.

In one embodiment, the second cross-sectional area of the enlarged opening is one of rectangular-shaped or squared-shaped.

In one embodiment, the shaft runs along an edge of the first plate.

In one embodiment, the first plate is connected along at least a portion of an upper surface of the shaft.

In one embodiment, the first plate includes, a first protrusion on a first side of the first plate, and a second protrusion on the first side of the first plate, the first protrusion and the second protrusion defining a notch, and the first protrusion runs along at least part of an upper portion of a longitudinal length of the shaft.

At least one example embodiment is directed toward a tongue assembly.

In one embodiment, the tongue assembly includes the tongue, and a lower mounting plate connected to a lower portion of the tongue.

In one embodiment, a lower end of the lower mounting plate includes a third protrusion, the third protrusion running substantially underneath the second protrusion, the third protrusion being positioned to at least partially align and mount the tongue assembly onto a lower plate of a rod forming apparatus.

In one embodiment, the lower mounting plate includes a shelf, the shelf extending from an inner side of the lower mounting plate toward the shaft, the shelf including an inclined surface, the inclined surface being upwardly facing and inclined away from the shaft.

In one embodiment, the inclined surface is configured to at least partially assist in folding a lap edge of at least one covering of a rolled consumer product toward an upper surface of the shaft, as the lap edge of the at least one covering travels through a third opening defined by the tongue assembly.

In one embodiment, the third opening is at least partially defined by the inclined surface and a side of the shaft.

In one embodiment, the tongue assembly further includes an upper mounting plate, a first surface of the upper mounting plate mating with an upper surface of the first plate and a second surface of the lower mounting plate mating with a lower surface of the first plate, and the upper surface, the lower surface, the first surface, and the second surface each being substantially flat.

In one embodiment, the upper mounting plate includes a fourth protrusion and a fifth protrusion, the fourth protrusion mating with the first protrusion and the fifth protrusion mating with the second protrusion.

In one embodiment, the fourth protrusion defines at least two bolt holes, the at least two bolt holes being on either side of the first protrusion, the at least two bolt holes being configured to align the first plate with the upper mounting plate.

In one embodiment, the first plate defines a first notch, and the upper mounting plate defines a second notch, the first notch and the second notch being substantially aligned with each other.

In one embodiment, the first notch and the second notch are both substantially V-shaped.

At least one example embodiment is directed toward a rod forming apparatus.

In one embodiment, the rod forming apparatus includes an in-feed section configured to convey a column of tobacco in a downward direction; a finishing section configured to receive the column of tobacco, the finishing section being configured to roll the column of tobacco into a wrapped tobacco rod, the finishing section including a tongue, the tongue including, a shaft, the shaft being hollow, the shaft including a first end and a second end, the first end defining a first opening with a first radius of curvature, the second end defining a second opening with a second radius of curvature, the first radius of curvature being larger than the second radius of curvature, the shaft defining at least one injection port that traverses through an inner surface of the shaft; and a first plate connected to the shaft, the first plate including an engaging structure configured to mount the tongue onto a lower plate and align the shaft with a groove defined by the lower plate.

In one embodiment, the in-feed section includes, an upper belt and an in-feed belt, the upper belt and the in-feed belt defining a descending channel, the descending channel being configured to convey the column of tobacco in the downward direction, a pair of squeeze bars that are configured to receive the column of tobacco from the descending channel, the pair of squeeze bars being configured to compress the column of tobacco, a lower belt configured to move the column of tobacco through the pair of squeeze bars and into the finishing section, and the lower belt being further configured to move at least one covering, positioned below the column of tobacco, into the finishing section.

In one embodiment, the finishing section further includes, a compression box, the compression box including a lower plate defining a groove, wherein the shaft of the tongue is configured to longitudinally align with the groove, the compression box being configured to further compression the column of tobacco into a tobacco rod, an adhesive applicator, the adhesive applicator being configured to apply an adhesive to a portion of the at least one covering, one or more folders downstream of the compression box, the one or more folders being configured to fold the at least one covering, with the adhesive, around the tobacco rod, and a cutter, the cutter being configured to cut the tobacco rod into rolled consumer products.

At least one example embodiment is directed toward a method of installing a tongue assembly on a rod forming apparatus.

In one embodiment, the method includes aligning a shaft of a tongue with a groove, the groove being defined by a lower plate of a compression box, the tongue including, a shaft, the shaft being hollow, the shaft including a first end and a second end, the first end defining a first opening with a first radius of curvature, the second end defining a second opening with a second radius of curvature, the first radius of curvature being larger than the second radius of curvature, the shaft defining at least one injection port that traverses through an inner surface of the shaft; and a first plate connected to the shaft, the first plate including an engaging structure configured to mount the tongue onto the lower plate and align the shaft with a groove defined by the lower plate.

In one embodiment, the method further includes bolting the first plate onto the lower plate to stabilize the aligned shaft with the groove.

In one embodiment, the bolting of the first plate onto the lower plate includes, connecting a lower mounting plate to the first plate by mating a first upper surface of the lower mounting plate to a first lower surface of the first plate, the first upper surface and the first lower surface being substantially flat, the lower mounting plate and the first plate being configured to be bolted together onto the lower plate, the lower mounting plate including, a shelf, the shelf extending from an inner side of the lower mounting plate toward the shaft once the lower mounting plate is connected to the first plate, the shelf including an upwardly facing inclined surface that inclines away from the shaft.

In one embodiment, the bolting of the first plate onto the lower plate further includes, connecting an upper mounting plate to the first plate by mating a second upper surface of the first plate to a second lower surface of the upper mounting plate, the second upper surface and the second lower surface being substantially flat, the lower mounting plate, the upper mounting plate and the first plate being configured to be bolted together onto the lower plate, the upper mounting plate including, a first protrusion and a second protrusion, the first protrusion mating with a third protrusion of the first plate and the second protrusion mating with a fourth protrusion of the first plate, the third protrusion and the fourth protrusion extending from one side of the first plate.

In one embodiment, the first plate defines a first notch, and the upper mounting plate defines a second notch, the first notch and the second notch being substantially aligned with each other once the upper mounting plate is connected to the first plate.

In one embodiment, the method further includes holding the first plate on the lower plate to stabilize the aligned shaft with the groove by connecting the first plate to an arm support device using an engaging structure.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
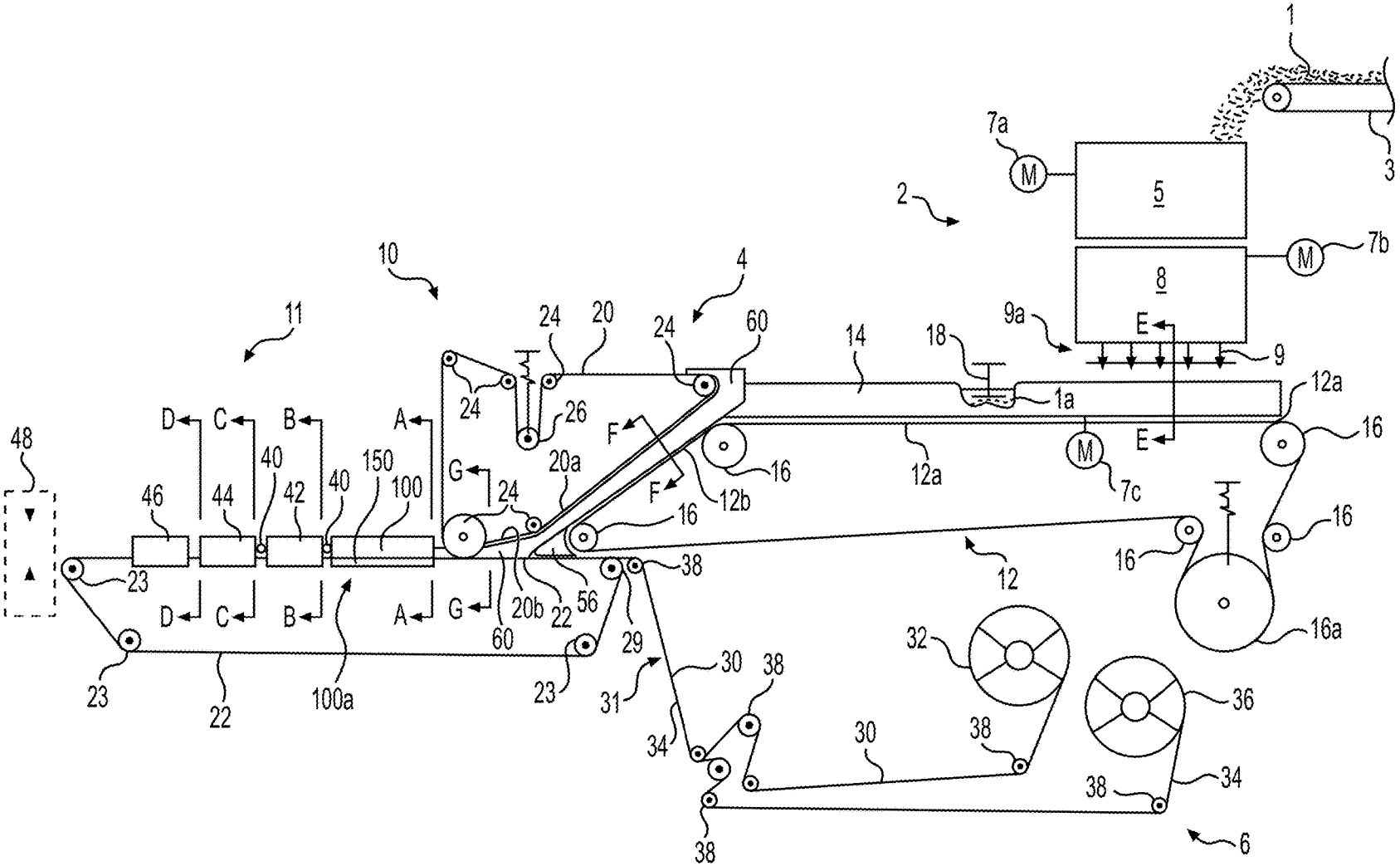
FIG. 1 is an illustration of a rod forming apparatus, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

FIG. 1 is an illustration of a rod forming apparatus 10, in accordance with an example embodiment. In an example embodiment, the rod forming apparatus 10 is used for the formation of a consumer product 300 (see FIG. 18). In an example embodiment, the consumer product 300 is a rolled product. In an example embodiment, the consumer product 300 is a rolled tobacco product, such as a tobacco rod. In an example embodiment, the tobacco rod is a cigar, a cigarette, or both a cigar and a cigarette.

In an example embodiment, the rod forming apparatus 10 includes a feed section 2, an in-feed section 4, a web section 6 and a finishing section 11. In an example embodiment, the feed section 2 includes at least one conveyer 3 for receiving tobacco 1 from a tobacco source (not shown). In an example embodiment, the tobacco 1 is shredded tobacco, as described in more detail herein. In an example embodiment, the feed section 2 includes a storage container 5 that may be at least one of a reservoir, a vat, a shipping container, etc. In an example embodiment, the rod forming apparatus 10 does not include a conveyor 3, as the tobacco 1 may be manually placed into the storage container 5, or the storage container 5 may be used until depleted and then replaced with another storage container 5.

In an example embodiment, the feed section 2 includes a feeder 8. The feeder 8 may be physically located below the storage container 5, and may receive tobacco 1 from the storage container 5. In an example embodiment, the feed section 2 does not include a storage container 5, and instead includes the feeder 8 and/or the conveyor 3. In an example embodiment, the storage container 5 and the feeder 8 are one integral element. Other configurations of the feed section 2 are contemplated.

In an example embodiment, the feeder 8 includes one or more outlets 9 at a lower portion of the feeder 8. In an example embodiment, the one or more outlets 9 are distributed in an outlet array 9*a*. In an example embodiment, the feeder 8 is a vibratory waterfall type feeder. In an example embodiment, the storage container 5, or the feeder 8, or both the storage container 5 and the feeder 8 include at least one electromagnetic (motorized) vibrator 7*a*/7*b* for causing the tobacco 1 to vibrate and uniformly settle, as the tobacco 1 leaves the storage container 5 and/or the feeder 8.

Figure 2:
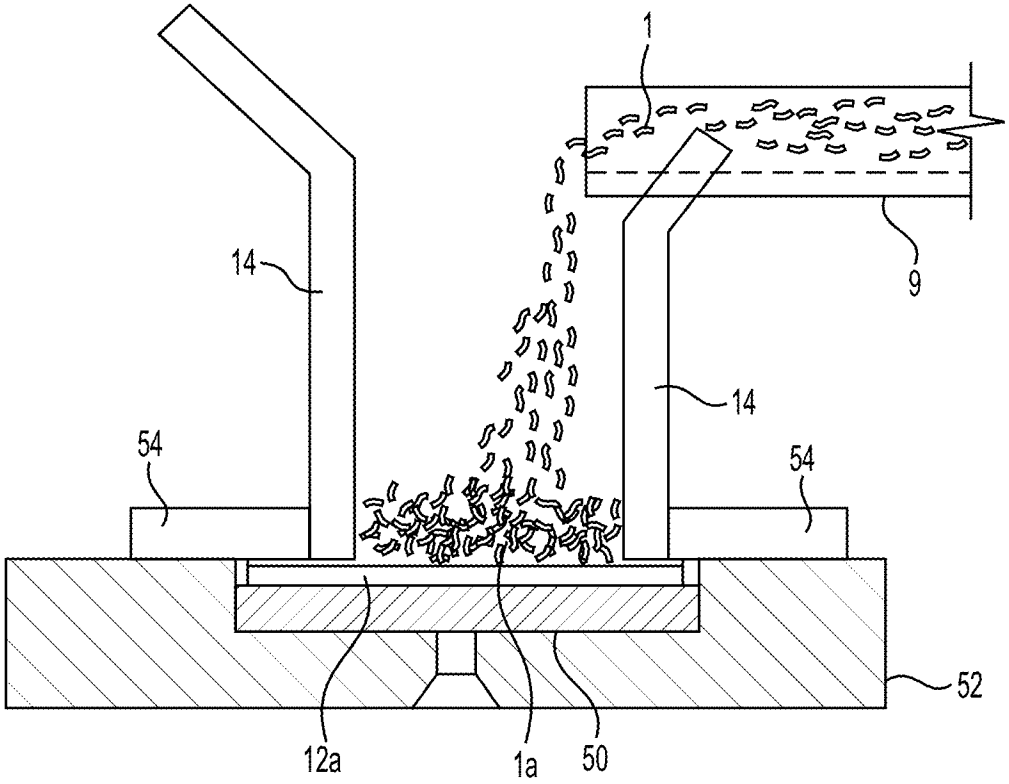
FIG. 2 is an illustration of a cross-sectional view of a portion of a feed section of FIG. 1, in accordance with an example embodiment.

In an example embodiment, the feeder 8 and/or the outlets 9 are capable of distributing the tobacco 1 onto an upper (conveyor) belt 12, as shown in better detail in FIG. 2. In an example embodiment, a first belt section 12*a* of the upper belt 12 is at least partially enclosed by a trough 14. The upper belt 12 may include rollers 16 capable of causing the upper belt 12 to move and transport the tobacco 1. In an example embodiment, the upper belt 12 includes a tensioning (biased) roller 16*a* that adjusts a tension of the upper belt 12. In an example embodiment, a trimmer unit 18 is included along the first belt section 12*a* so that a tobacco column 1*a* traveling along the first belt section 12*a* may be formed into a column with a desired and uniform height. In an example embodiment, the first belt section 12*a* includes at least one electromagnetic vibrator 7*c* to further ensure an evenly distributed tobacco column 1*a* that is spread across the first belt section 12*a*, as the tobacco column 1*a* rides along the first belt section 12*a*.

In an example embodiment, the feed section 2 and upper belt 12 provide the tobacco column 1*a* to the in-feed section 4 of the roll forming apparatus 10. In an example embodiment, the tobacco column 1*a* is transferred into the in-feed section 4 by a second belt section 12*b* of the upper belt 12 and an in-feed (compression) belt 20 that are downstream of the feeder 8. Specifically, in an example embodiment, the tobacco column 1*a* rides on the second belt section 12*b* (shown in better detail FIG. 3), while a descending belt section 20*a* of the in-feed belt 20 is in contact with a top portion of the tobacco column 1*a*. In an example embodiment, the in-feed belt 20 can be considered a compression belt, from the standpoint that the in-feed belt 20 helps assist in gently compressing the tobacco column 1*a*, as explained herein in more detail (see FIG. 3 in particular). In an example embodiment, the in-feed belt 20 travels along rollers 24. In an example embodiment, a tensioning roller 26 is included in the in-feed section 4 to adjust a tension of the in-feed belt 20.

In an example embodiment, the second belt section 12*b* and/or the descending belt section 20*a* feed the tobacco column 1*a* into the finishing section 11 of the rod forming apparatus 10. In an example embodiment, the second belt section 12*b* and/or the descending belt section 20*a* feed the tobacco column 1*a* to a lower belt 22. In an example embodiment, the lower belt 22 is a garniture belt, or a garniture tube belt. In an example embodiment, the lower belt 22 travels along a set of rollers 23.

In an example embodiment, the tobacco column 1*a* enters the finishing section 11 through a channel 21. In an example embodiment, the channel has a continually and linearly decreasing cross-sectional area, as described in detail in association with FIGS. 3-7. In an example embodiment, the channel 21 is at least partially defined by a first squeeze bar 60 and a second squeeze bar 62 (see FIGS. 1, and 5-7), the descending belt section 20*a* of the in-feed belt 20 (see FIGS. 1 and 3-6), the second belt section 12*b* (see FIGS. 1 and 3-6) and the lower belt 22 (see FIGS. 1, 3 and 7). In an example embodiment, the first squeeze bar 60 and the second squeeze bar 62 hold the tobacco column 1*a* between the descending belt section 20*a* and the second belt section 12*b*, as the tobacco column 1*a* descends down to the lower belt 22, and the first squeeze bar 60 and the second squeeze bar 62 hold the tobacco column 1*a* between a horizontal belt section 20*b* of the in-feed belt 20 and the lower belt 22, as the tobacco column 1*a* is transported to a compression box 100*a* of the finishing section 11. In an example embodiment, the continually decreasing cross-sectional area of the channel 21 forces the tobacco column 1*a* to become compressed into an ever-smaller cross-section, until the tobacco column 1*a* reaches a desired cross-sectional dimension that enters the compression box 100*a*.

In an example embodiment, the rod forming apparatus 10 includes the web section 6, where the web section 6 provides at least one covering 31 that may be applied longitudinally around the consumer product 300. In an example embodiment, the at least one covering 31 includes at least two web layers. In an example embodiment, the at least one covering 31 includes a binder web 30 and a wrapper web 34. In an example embodiment, the binder web 30 is used to bind the tobacco 1, and in doing so, the binder web 30 may come into intimate direct contact with the tobacco 1. In an example embodiment, the wrapper web 34 is used to cover the binder web 30. In an example embodiment, a bulk portion of the binder web 30 and the wrapper web 34 are respectively housed on a binder reel 32 and a wrapper reel 36. A series of rollers 38 may be used to guide the binder web 30 and the wrapper web 34 into the finishing section 11. In an example embodiment, the binder web 30 and the wrapper web 34 are formed from tobacco, tobacco pulp, compressed tobacco, or a derivative or extract of tobacco, where the binder web 30 and the wrapper web 34 are in the form of flatten sheets or ribbons.

Figure 17A:
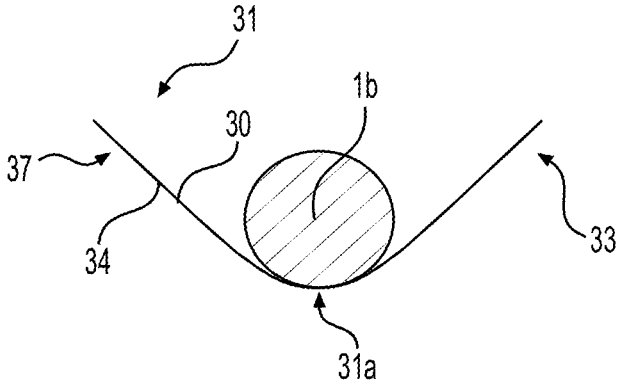
FIG. 17A is an illustration of a cross-sectional view a tobacco rod being bound, in accordance with an example embodiment.

In an example embodiment, once the tobacco column 1*a* and the at least one covering 31 proceed into the finishing (rod forming) section 11, via the force of the lower belt 22, the tobacco column 1*a* is guided through the compression box 100*a* to form a tobacco rod 1*b* (see at least FIG. 17A, which is view A-A of FIG. 1). In an example embodiment, the compression box 100*a* includes a tongue assembly 100 (see at least FIGS. 10A-10D), that is mounted on a lower plate 150 (see at least FIG. 13A), where the compression box 100*a* assists in folding the at least one covering 31 longitudinally around at least a portion of the tobacco rod 1*b* (see FIG. 17A). In an example embodiment, the tobacco rod 1*b* and the at least one covering 31 pass through the compression box 100*a*, prior to coming into contact with an adhesive applicator 40. In an example embodiment, the adhesive applicator 40 applies an adhesive 35 to a free edge 37 of the at least one covering 31 (see FIG. 17B, which is view B-B of FIG. 1), while the at least one covering 31 is partially wrapped around the tobacco rod 1*b*, as explained in more detail herein. In an example embodiment, the adhesive applicator 40 is a glue gun, or another device capable of discharging and applying the adhesive 35 to a sheet of material such as the at least one covering 31. In an example embodiment, the adhesive 35 is a food-safe organic fixative. In an example embodiment, the adhesive 35 is made from plant extract, starch, dextrin, other food-safe adhesives, or combinations thereof.

Figure 14:
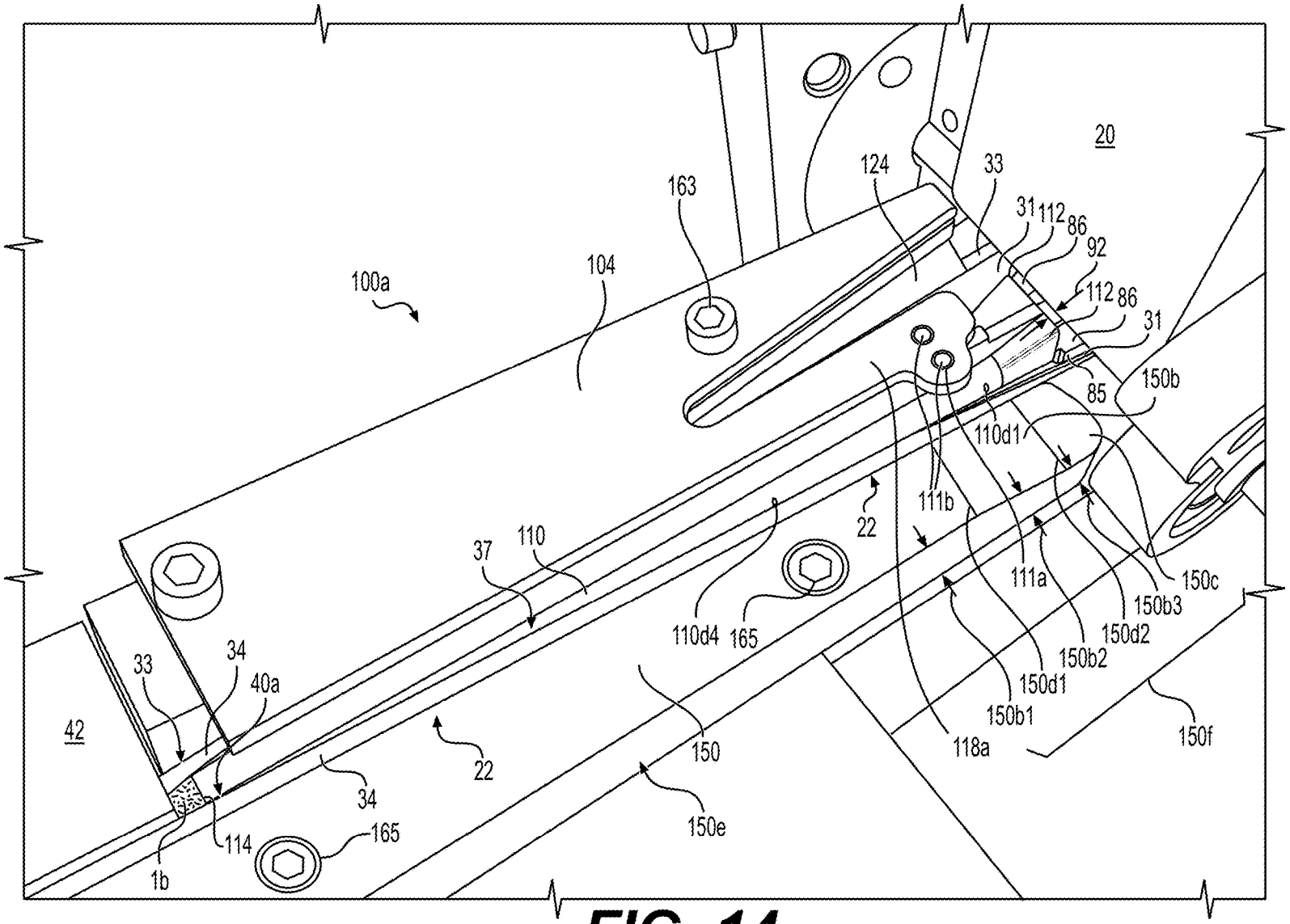
FIG. 14 is an illustration of a perspective view of the tongue assembly of the compression box interfacing with the in-feed section, in accordance with an example embodiment.
Figure 17B:
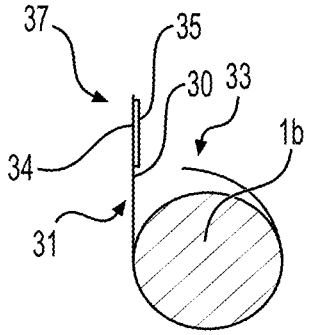
FIG. 17B is another illustration of a cross-sectional view the tobacco rod being bound, in accordance with an example embodiment.
Figure 17C:
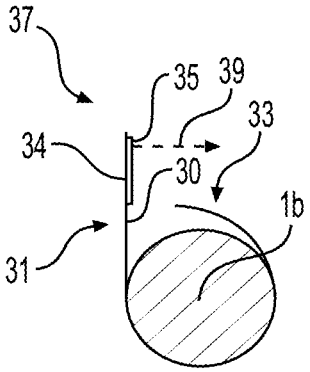
FIG. 17C is another illustration of a cross-sectional view the tobacco rod being bound, in accordance with an example embodiment.
Figure 17D:
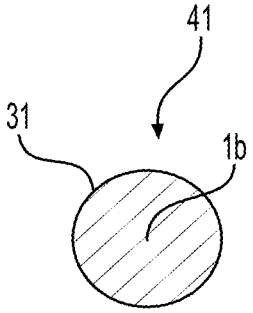
FIG. 17D is another illustration of a cross-sectional view the tobacco rod being bound, in accordance with an example embodiment.

In an example embodiment, the lower belt 22 causes the at least one covering 31 and the tobacco column 1*a* to travel in unison through the compression box 100*a* to a short folder 42, as discussed in more detail herein (see FIG. 14). In an example embodiment, the short folder 42 folds a lap (folded) edge 33 of the at least one covering 31 toward the tobacco rod 1*b*, as shown in FIG. 17B (which is view B-B of FIG. 1). In an example embodiment, the adhesive applicator 40 can located before or after the short folder 42, as depicted in FIG. 1. In an example embodiment, the lower belt 22 causes the at least one covering 31 and the tobacco column 1*a* to then continue to travel through a finishing folder 44 and a heater 46. In an example embodiment, the short folder 42 and/or the finishing folder 44 causes the lap edge 33 of the at least one covering 31 to be pinned down on the tobacco rod 1*b*, while the free edge 37 of the at least one covering 31 is also folded (in direction 39, as shown in FIG. 17C) toward the tobacco rod 1*b* and the lap edge 33 (see FIG. 17C, which is view C-C of FIG. 1). In an example embodiment, the heater 46 applies heat to the at least one covering 31 and the tobacco rod 1*b* to set the adhesive 35. In an example embodiment, following the heater 46, the at least one covering 31 is fused onto the tobacco rod 1*b* (as shown in FIG. 17D, which is view D-D of FIG. 1) to form a finished rod 41.

Figure 18:
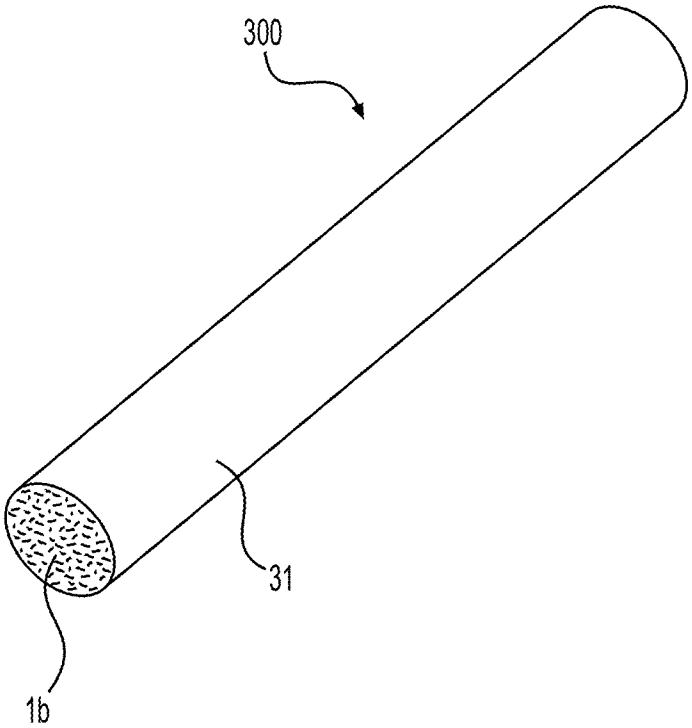
FIG. 18 is an illustration of a consumer product that is made from the rod forming apparatus, in accordance with an example embodiment.

In an example embodiment, the lower belt 22 causes the finished rod 41 to pass through a cutter 48. In an example embodiment, the cutter 48 cuts the finished rod 41 into segments, where these segments form the consumer product 300 (FIG. 18).

FIG. 2 is an illustration of a cross-sectional view of a portion of the feed section 2 of FIG. 1 (from the perspective of view E-E of FIG. 1), in accordance with an example embodiment. In an example embodiment, the first belt section 12*a* of the upper belt 12 rides above a conveyor guide 50. In an example embodiment, the conveyor guide 50 is positioned within a conveyer base plate 52. In an example embodiment, tobacco 1 from the feed section 2 is deposited upon the first belt section 12*a* to form a tobacco column 1*a*. In an example embodiment, the trough 14 keeps the tobacco column 1*a* on the first belt section 12*a* as the tobacco column 1*a* is conveyed to the in-feed section 4 of the rod forming apparatus 10. In an example embodiment, the trough 14 is stabilized and/or mounted onto the conveyor base plate 52 by one or more brackets 54.

Figure 3:
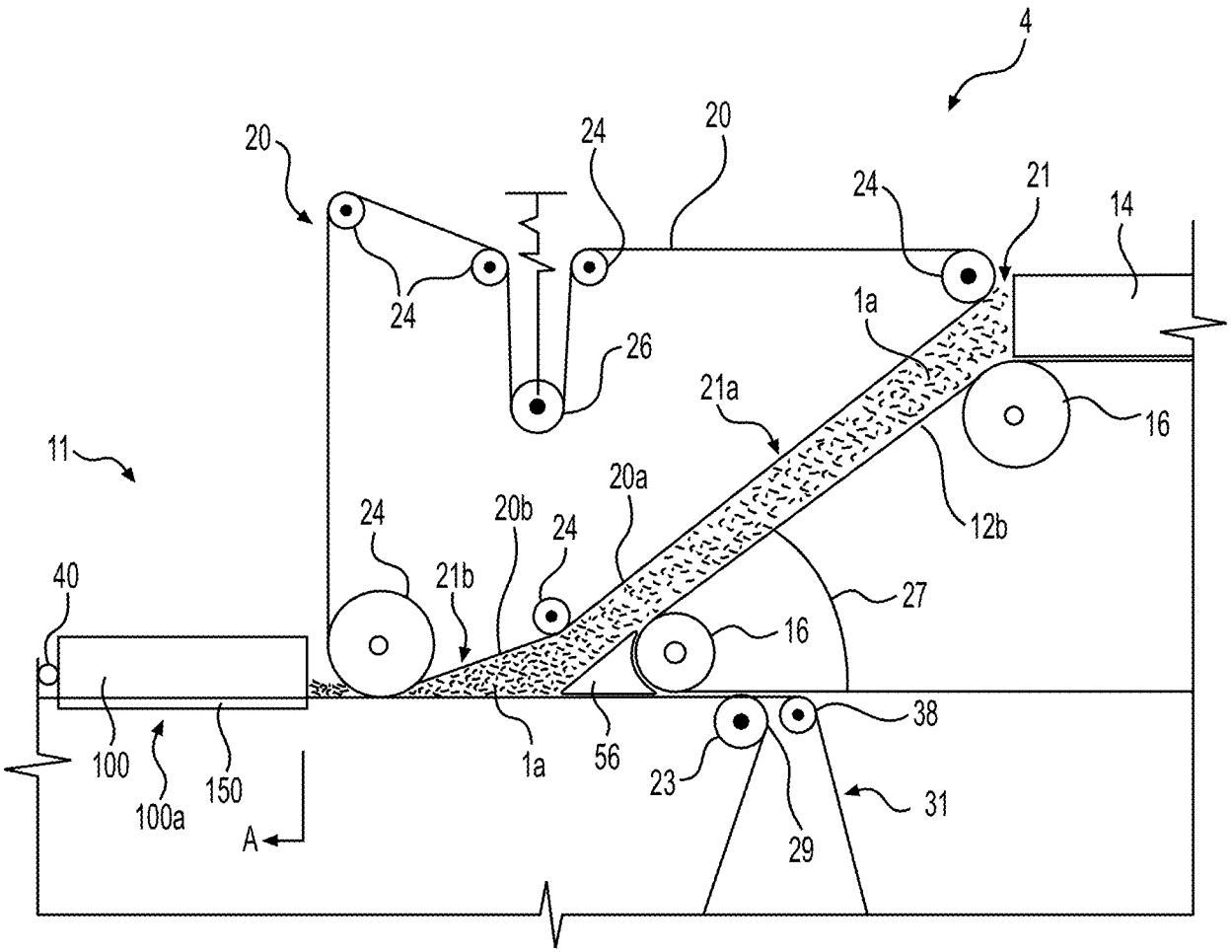
FIG. 3 is an illustration of an enlarged view of an in-feed section and a finishing section of the rod forming apparatus, in accordance with an example embodiment.
Figure 4:
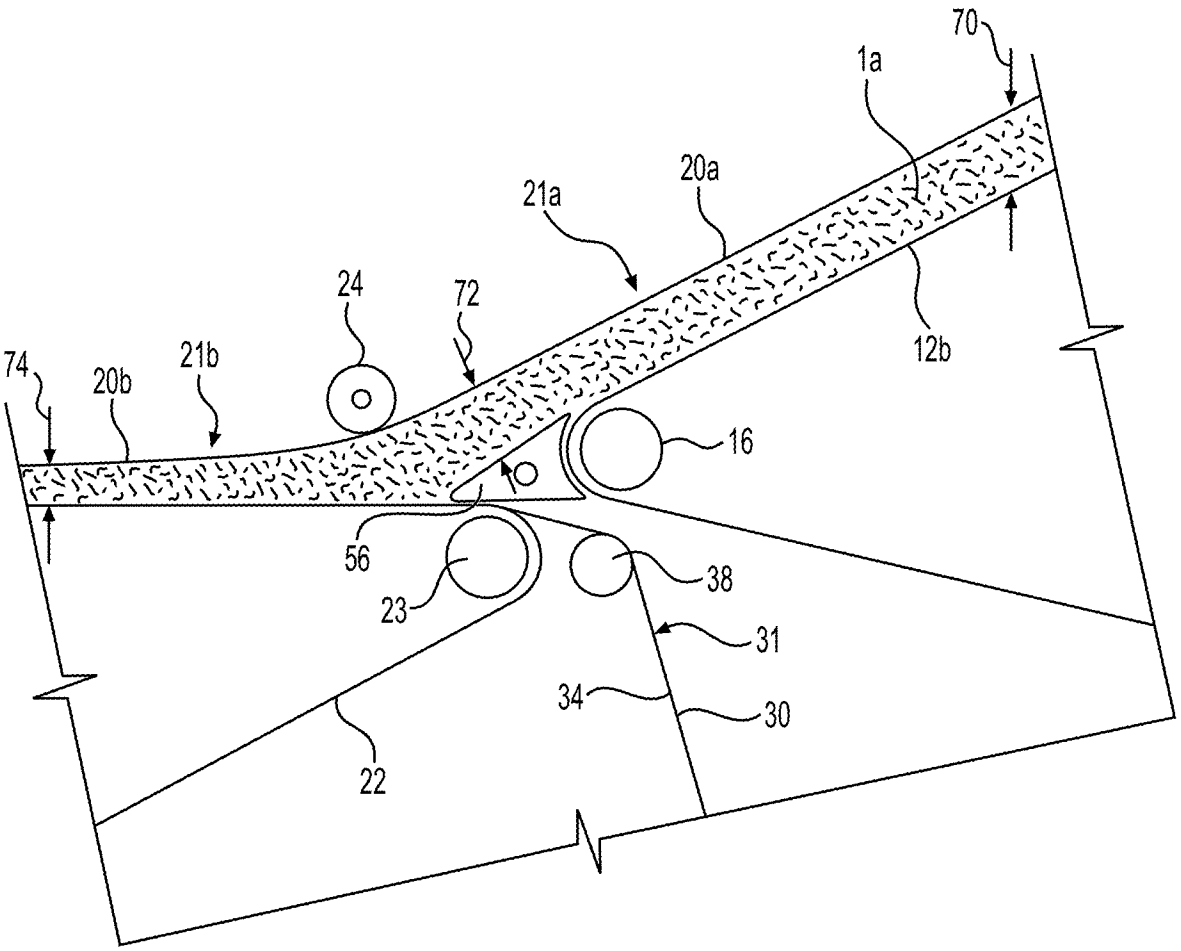
FIG. 4 is an illustration of a portion of the in-feed section of the rod forming apparatus, in accordance with an example embodiment.
Figure 5:
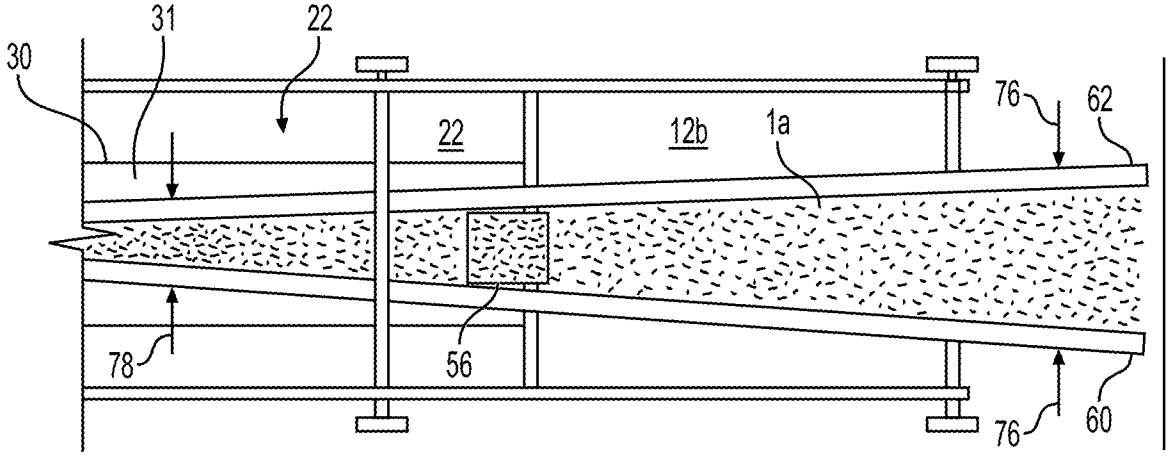
FIG. 5 is an illustration of a top view of a portion of the in-feed section of the rod forming apparatus, in accordance with an example embodiment.

FIG. 3 is an illustration of an enlarged view of the in-feed section 4 and a portion of the finishing section 11 of the rod forming apparatus 10 of FIG. 1, in accordance with an example embodiment. In FIG. 3, the in-feed section 4 is shown without the squeeze bar 60 in position on a side of the channel (in-feed flow path) 21, in order to better understand the in-feed section 4, though it should be understood that the squeeze bar 60 is normally installed in front of the channel 21 during normal operational use of the rod forming apparatus 10. In an example embodiment, a descending section 21*a* of the channel 21 is defined at least in part by the second belt section 12*b*, the descending belt section 20*a*, the first squeeze bar 60 and a second squeeze bar 62 (also see FIGS. 1, 4 and 6). In an example embodiment, the tobacco column 1*a* rides primarily along the second belt section 12*b*, where the descending belt section 20*a* of the in-feed belt 20 also assists in the transport of the tobacco column 1*a* through the descending section 21*a* of the channel 21. In an example embodiment, the descending section 21*a* of the channel 21 has a continually narrowing cross-sectional flow area, as the tobacco column 1*a* descends down to a horizontal section 21*b* of the channel 21, as also depicted in FIGS. 4 and 5. The continually narrowing cross-sectional flow area of the descending section 21*a* of the channel 21 causes the tobacco column 1*a* to be gently and continually compressed.

In an example embodiment, a decline angle 27 of the descending section 21*a* of the channel 21 (defined by the second belt section 12*b* and the descending belt section 20*a*), assists in driving the tobacco column 1*a* through the channel 21 with enough velocity that the tobacco column 1*a* has a necessary momentum to flow through the horizontal section 21*b* of the channel 21 and the compression box 100*a*, where the tobacco column 1*a* is further compressed along the way. To that end, an exceedingly steep decline angle 27 can cause the tobacco column 1*a* to flow at too great of a velocity, causing a potential over-compression of the tobacco column 1*a* (and, subsequent potential "accordion effect," caused by the over-compression), due to any minor disruption or impedance of the flow of the tobacco column 1*a* through the rod forming apparatus 10. An exceedingly mild decline angle 27 can leave the tobacco column 1*a* without enough velocity and momentum to carry the tobacco column 1*a* through the channel 21 and the compression box 100*a*. Therefore, in an example embodiment, the angle of decline 27 is about 10-45 degrees (relative to a horizontal plane, where the horizontal plane is perpendicular to gravity). It should be understood that the decline angle 27 varies, depending for instance on a speed of the second belt section 12*b* and the descending belt section 20*a*, and a composition of the tobacco column 1*a*.

In an example embodiment, the channel 21 is also at least partially defined by the horizontal section 21*b*, where the horizontal section 21*b* feeds the tobacco column 1*a* into the compression box 100*a*. In an example embodiment, the horizontal section 21*b* also has a continually narrowing cross-sectional flow area that causes the tobacco column 1*a* to be further compressed prior to flowing into the compression box 100*a*. In an example embodiment, the horizontal section 21*b* of the channel 21 is defined at least in part by the lower belt 22, the horizontal belt section 20*b*, and horizontal portions 84 of the first squeeze bar 60 and the second squeeze bar 62 (see FIGS. 8A-8D).

In an example embodiment, the in-feed section 4 includes a transition piece 56 that further defines the channel 21. Specifically, in an example embodiment, the transition piece 56 fills a gap (bridges a transition) between the second belt section 12*b* and the lower belt 22, allowing the tobacco column 1*a* to more smoothly flow over the transition piece 56 as the tobacco column 1*a* leaves the second belt section 12*b* and flows onto the lower belt 22. In an example embodiment, the transition piece 56 may serve to reduce a level of turbulence that might otherwise be imparted to the tobacco column 1*a* traversing between the second belt section 12*b* and the lower belt 22. Specifically, in an example embodiment, the transition piece 56 occupies a space at the transition between the upper belt 12 and the lower belt 22, where this space would otherwise allow the tobacco column 1*a* to potentially accumulate and intermittently release, which may impact a consistency of the final consumer product 300.

FIG. 4 is an illustration of a portion of the in-feed section 4 of the rod forming apparatus 10, in accordance with an example embodiment. This view depicts a flow of the tobacco column 1*a*, through a section of the descending section 21*a* and a section of the horizontal section 21*b* of the channel 21. In an example embodiment, the at least one covering 31 is pulled underneath and past the transition piece 56, as the tobacco column 1*a* flows over the transition piece 56 and over a portion of the at least one covering 31 that is directly on the lower belt 22. In an example embodiment, the depth of the tobacco column 1*a* is continually reduced, as the cross-sectional flow area of the channel 21 continues to narrow along a length of the channel 21. Specifically, in an example embodiment, an initial depth 70 of the tobacco column 1*a*, which is defined by a distance between the second belt section 12*b* and the descending belt section 20*a* toward a beginning of the descending section 21*a* of the channel 21, is reduced down to a smaller depth 72 (adjacent to the transition piece 56) as a distance between the second belt section 12*b* and the descending belt section 20*a* continually narrows along the descending section 21*a* of the channel 21. The depth 74 of the tobacco column 1*a* is even further reduced, due to an even smaller gap between the horizontal belt section 20*b* and the lower belt 22, as the tobacco column 1*a* flows through an end of the horizontal section 21*b* of the channel 21 just prior to the tobacco column 1*a* being discharged into the compression box 100*a*.

In an example embodiment, a speed of travel of the upper belt 12 matches a speed of travel of the in-feed belt 20. In an example embodiment, a speed of travel of the lower belt 22 matches the speed of travel of the upper belt 12 and the in-feed belt 20.

FIG. 5 is an illustration of a top (cut-away) view of a portion of the in-feed section 4 of the rod forming apparatus 10, in accordance with an example embodiment. In this top view, a relationship is depicted between the first squeeze bar 60, the second squeeze bar 62, the second belt section 12*b* and the lower belt 22. In an example embodiment, an initial width 76 between the first squeeze bar 60 and the second squeeze bar (near a proximal end of the squeeze bars 60/62) is narrowed to a smaller width 78 (near a distal end of the squeeze bars 60/62). In an example embodiment, the squeeze bars 60/62 are positioned so that the width between the squeeze bars 60/62 is continually decreasing, just as a depth of the tobacco column 1*a* (from depth 70, to depth 74, shown in FIG. 4) is continually decreasing. This causes the tobacco column 1*a* to gradually and continually become compressed, as the tobacco column 1*a* flows through the descending section 21*a* and the horizontal section 21*b* of the channel 21 (also see FIG. 4).

In an example embodiment, the at least one covering 31 comes into intimate direct contact with the tobacco column 1*a*, as the at least one covering 31 moves under and past the transition piece 56 and the tobacco column 1*a* moves over and past the transition piece 56. In an example embodiment, the lower belt 22 is directly below the at least one covering 31 (obscured from view in FIG. 5), where the lower belt 22 also passes under the transition piece 56.

Figure 6:
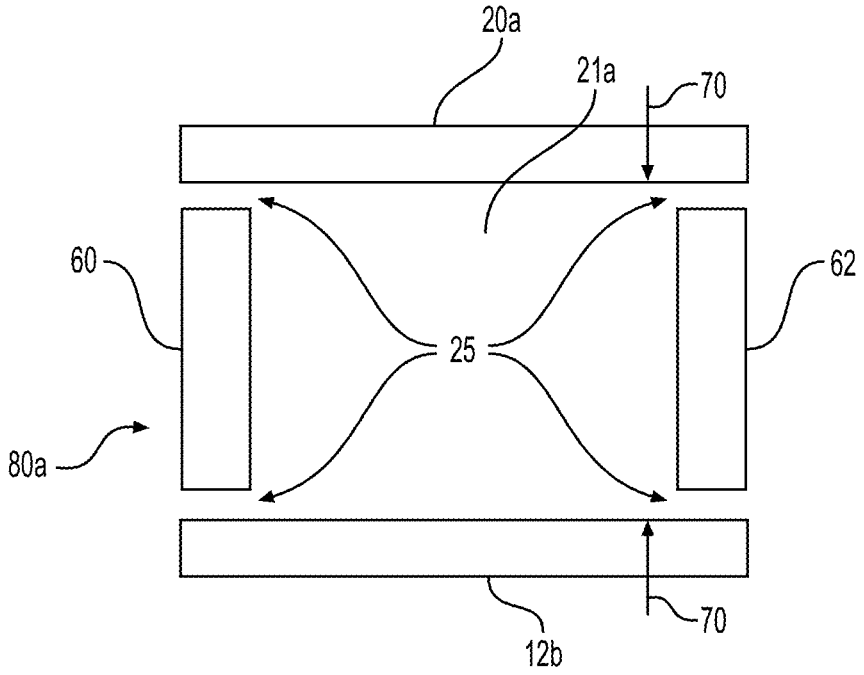
FIG. 6 is an illustration of a channel of the in-feed section of the rod forming apparatus, in accordance with an example embodiment.

FIG. 6 is an illustration of a cross-sectional view (view F-F of FIG. 1) of the descending section 21*a* of the channel 21 of the in-feed section 4 of the rod forming apparatus 10, in accordance with an example embodiment. Specifically, this view is toward a proximal end 80*a* of a main shaft 80 of the squeeze bars 60/62 (see at least FIG. 8B). In an example embodiment, and at this location of the descending section 21*a* of the channel 21 (see FIGS. 3 and 4), a depth 70 of the tobacco column 1*a* is relatively large due to a large gap between the second belt section 12*b* and the descending belt section 20*a*, and the squeeze bars 60/62 are relatively far apart from each other such that a major portion of the descending belt section 20*a* and a major portion of the second belt section 12*b* contact the tobacco column 1*a* thereby assisting the tobacco column 1*a* in being conveyed down to the horizontal section 21*b* of the channel 21. In an example embodiment, gaps 25 exist in the descending section 21*a* of the channel 21 to provide a small clearance to allow the descending belt section 20*a* and the second belt section 12*b* to move past the squeeze bars 60/62.

Figure 7:
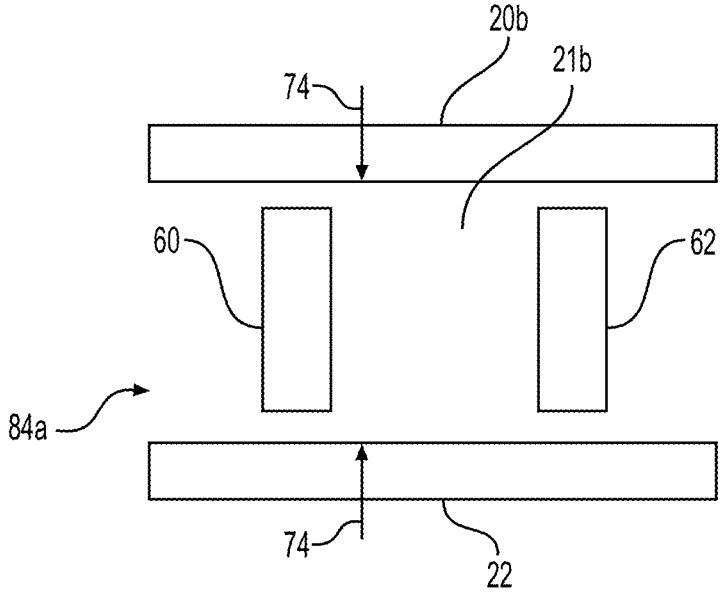
FIG. 7 is another illustration of the channel of the in-feed section of the rod forming apparatus, in accordance with an example embodiment.

FIG. 7 is another illustration of a cross-sectional view (view G-G of FIG. 1) of the horizontal section 21*b* of the channel 21 of the in-feed section 4 of the rod forming apparatus 10, in accordance with an example embodiment. In an example embodiment, and at this location of the horizontal section 21*b* of the channel 21 (see FIGS. 3 and 4), the squeeze bars 60/62 are relatively close together, thereby assisting in the compression of the tobacco column 1*a*, as the depth 74 of the tobacco column 1*a* is also depressed by the narrowing gap between the horizontal belt section 20*b* and the lower belt 22 (see FIG. 4). In an example embodiment, the gaps 25 exist in the horizontal section 21*b* of the channel 21 to provide a small clearance to allow the horizontal belt section 20*b* and the lower belt 22 to move past the squeeze bars 60/62.

Figure 8A:
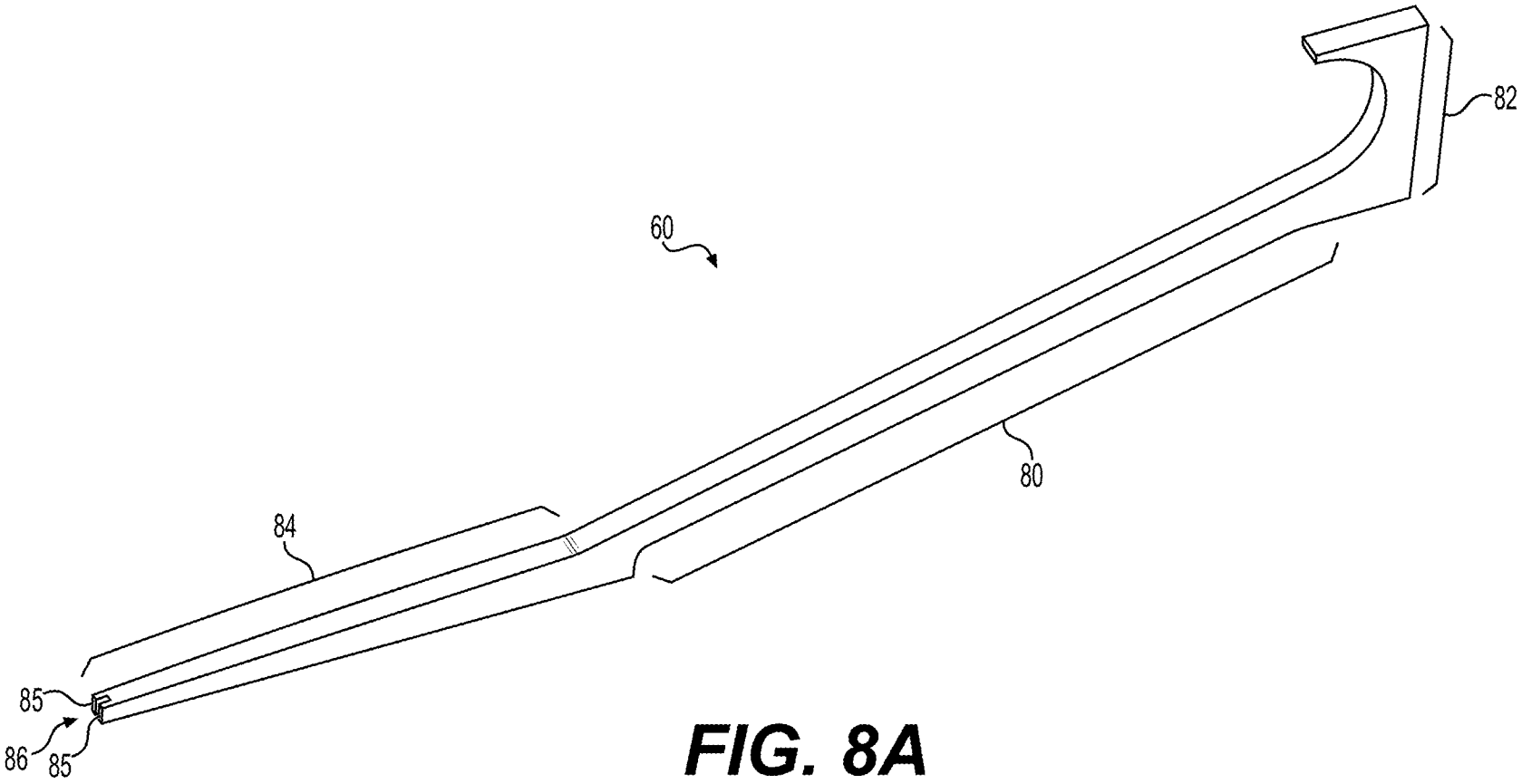
FIG. 8A is an illustration of a perspective view of a squeeze bar, in accordance with an example embodiment.

FIG. 8A is an illustration of a perspective view of the first (outer) squeeze bar 60, in accordance with an example embodiment. In an example embodiment, the first squeeze bar 60 includes a hook 82 on a proximal end of the first squeeze bar 60, and a horizontal portion 84 on a distal end of the first squeeze bar 60. In an example embodiment, the first squeeze bar 60 includes a main shaft 80 that slopes at an angle, between the hook 82 and the horizontal portion 84. In an example embodiment, a general shape of the first squeeze bar is conformed to a general shape of the channel 21, as shown in FIGS. 3 and 4.

In an example embodiment, the hook 82 can be a different shape than what is shown in FIG. 8A. In an example embodiment, the hook 82 is capable of fitting around, and being stabilized by a roller 24 (as shown in FIGS. 1 and 3). In an example embodiment, a tip 86 of the first squeeze bar 60 includes at least one protrusion (prong) 85 extending from the tip 86 (see also FIG. 8C).

Figure 8B:
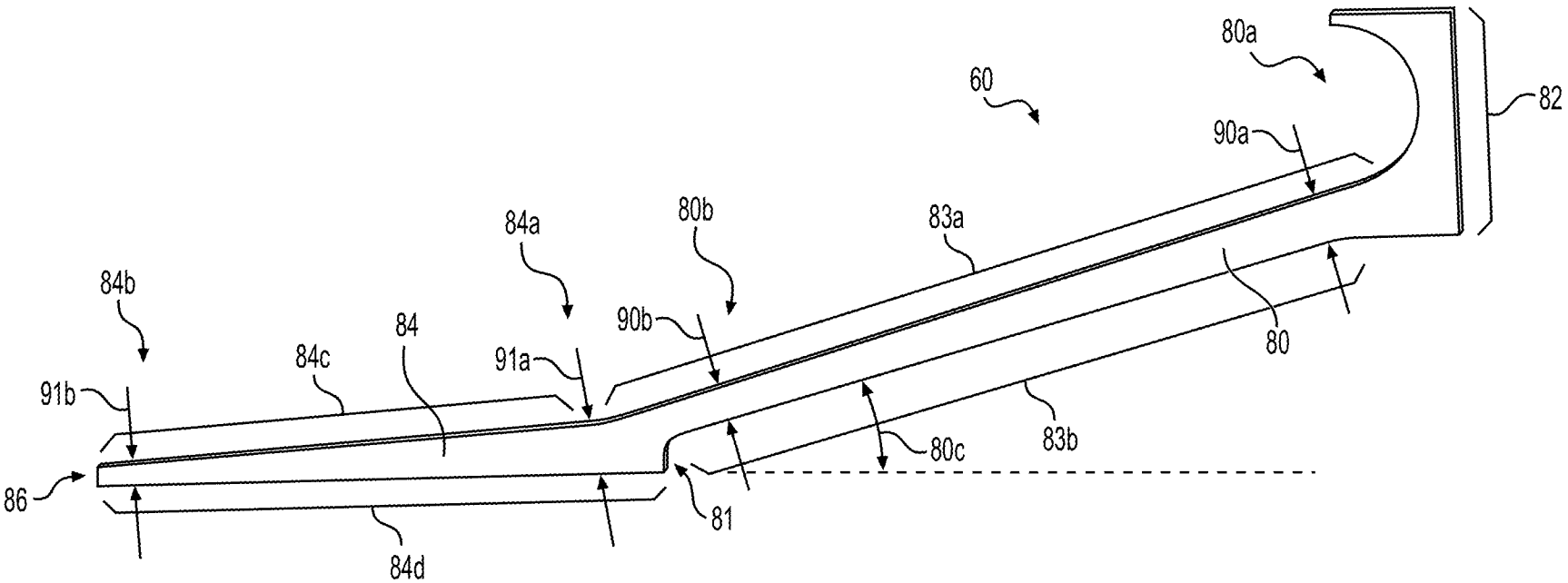
FIG. 8B is an illustration of a side view of the squeeze bar, in accordance with an example embodiment.

FIG. 8B is an illustration of a side view of the first squeeze bar 60, in accordance with an example embodiment. In an example embodiment, a depth 90*a* of the main shaft 80, at a proximal end 80*a* of the main shaft 80, is larger than a depth 90*b* of a distal end 80*b* of the main shaft 80. In an example embodiment, the depth of the main shaft 80 continues to decrease along a longitudinal length of the main shaft 80, from the proximal end 80*a* to the distal end 80*b*. In an example embodiment, a length of an upper surface 83*a* of the main shaft 80 is longer than a length of a lower surface 83*b* of the main shaft 80.

In an example embodiment, a depth 91*a* of the horizontal portion 84, at a proximal end 84*a* of the horizontal portion 84, is larger than a depth 91*b* of a distal end 84*b* of the horizontal portion 84. In an example embodiment, the depth of the horizontal portion 84 continues to decrease along a longitudinal length of the horizontal portion 84, from the proximal end 84*a* to the distal end 84*b*. In an example embodiment, a length of an upper surface 84*c* of the horizontal portion 84 is shorter than a length of a lower surface 84*d* of the horizontal portion 84. In an example embodiment, a step 81 divides the lower surface 84*d* of the horizontal portion 84 from the lower surface 83*b* of the main shaft 80. In an example embodiment, the lower surface 84*d* is substantially flat.

In an example embodiment, the main shaft 80 has an incline angle 80*c* that is about 10-45 degrees, relative to the lower surface 84*d* of the horizontal portion 84. In an example embodiment, the incline angle 80*c* matches the decline angle 27 the descending section 21*a* of the channel 21 (defined by the second belt section 12*b* and the descending belt section 20*a*, as shown in FIG. 3).

Figure 8C:
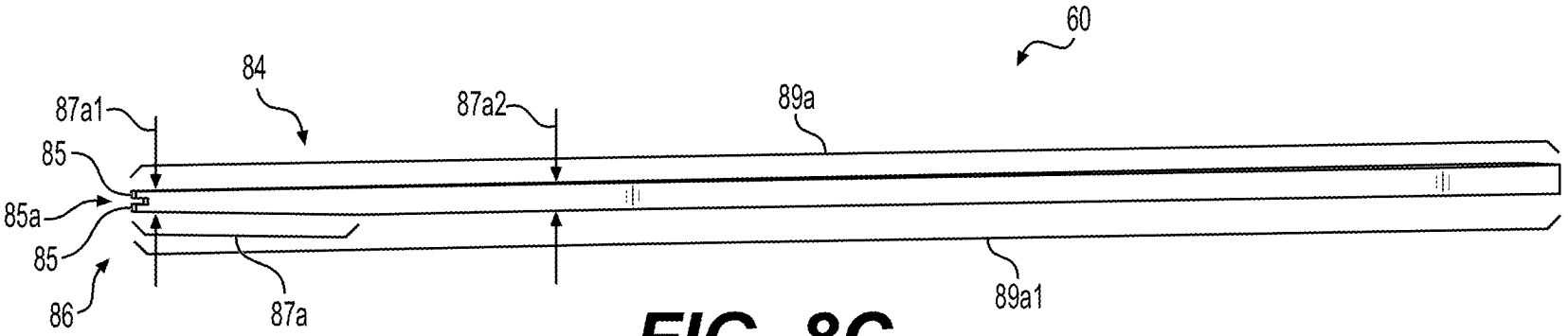
FIG. 8C is an illustration of a top view of the squeeze bar, in accordance with an example embodiment.

FIG. 8C is an illustration of a top view of the first squeeze bar 60, in accordance with an example embodiment. In an example embodiment, an inner surface 89*a* of the first squeeze bar 60 is substantially flat. In an example embodiment, an outer surface 89*a*1 is substantially flat, other than a distal end of the horizontal portion 84 that includes an angled offset 87*a*. In an example embodiment, a thickness 87*a*1 of the distal end of the horizontal portion 84 is smaller than a thickness 87*a*2 of the remainder of the first squeeze bar 60. In an example embodiment, the inner surface 89*a* of the first squeeze bar 60 contacts the tobacco column 1*a*, once the first squeeze bar 60 is installed on the rod forming apparatus 10.

In an example embodiment, the tip 86 on the distal end of the horizontal portion 84 includes two protrusions 85 that form a notch 85*a*. In an example embodiment, only one protrusion 85 exists on the distal end of the horizontal portion 84, where the protrusion 85 extends from the inner surface 89*a* of the first squeeze bar 60. In an example embodiment, the tip 86 does not include protrusions 85.

Figure 8D:
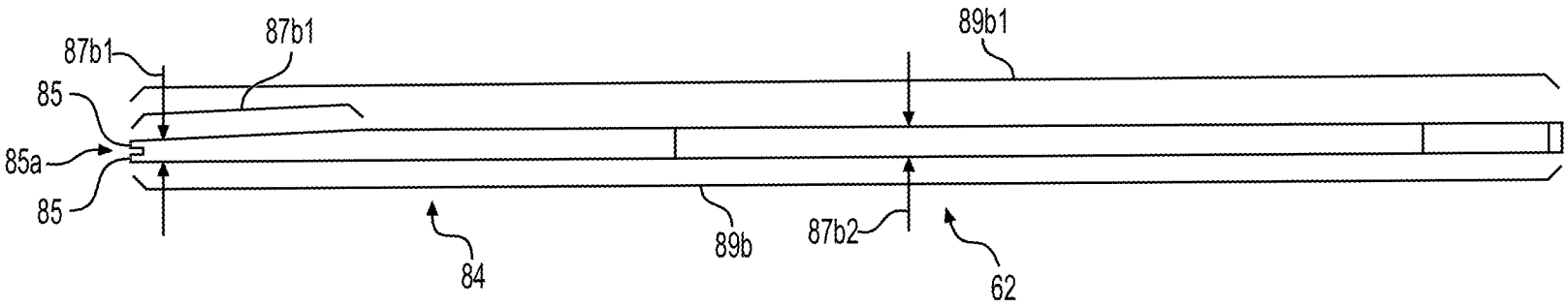
FIG. 8D is an illustration of a top view of another squeeze bar, in accordance with an example embodiment.

FIG. 8D is an illustration of a top view of the second squeeze bar 62, in accordance with an example embodiment. In an example embodiment, the second squeeze bar 62 is a mirror-image of the first squeeze bar 60. Therefore, in an example embodiment, an inner surface 89*b* of the second squeeze bar 62 is substantially flat. In an example embodiment, an outer surface 89*b*1 is substantially flat, other than a distal end of the horizontal portion 84 that includes an angled offset 87*b*. In an example embodiment, a thickness 87*b*1 of the distal end of the horizontal portion 84 is smaller than a thickness 87*b*2 of the remainder of the second squeeze bar 62. In an example embodiment, the inner surface 89*b* of the second squeeze bar 62 contacts the tobacco column 1*a*, once the second squeeze bar 62 is installed on the rod forming apparatus 10.

In an example embodiment, the second (inner) squeeze bar 62 opposes the first (outer) squeeze bar 60 in the rod forming apparatus 10, as shown in at least FIGS. 5-7.

Figure 9A:
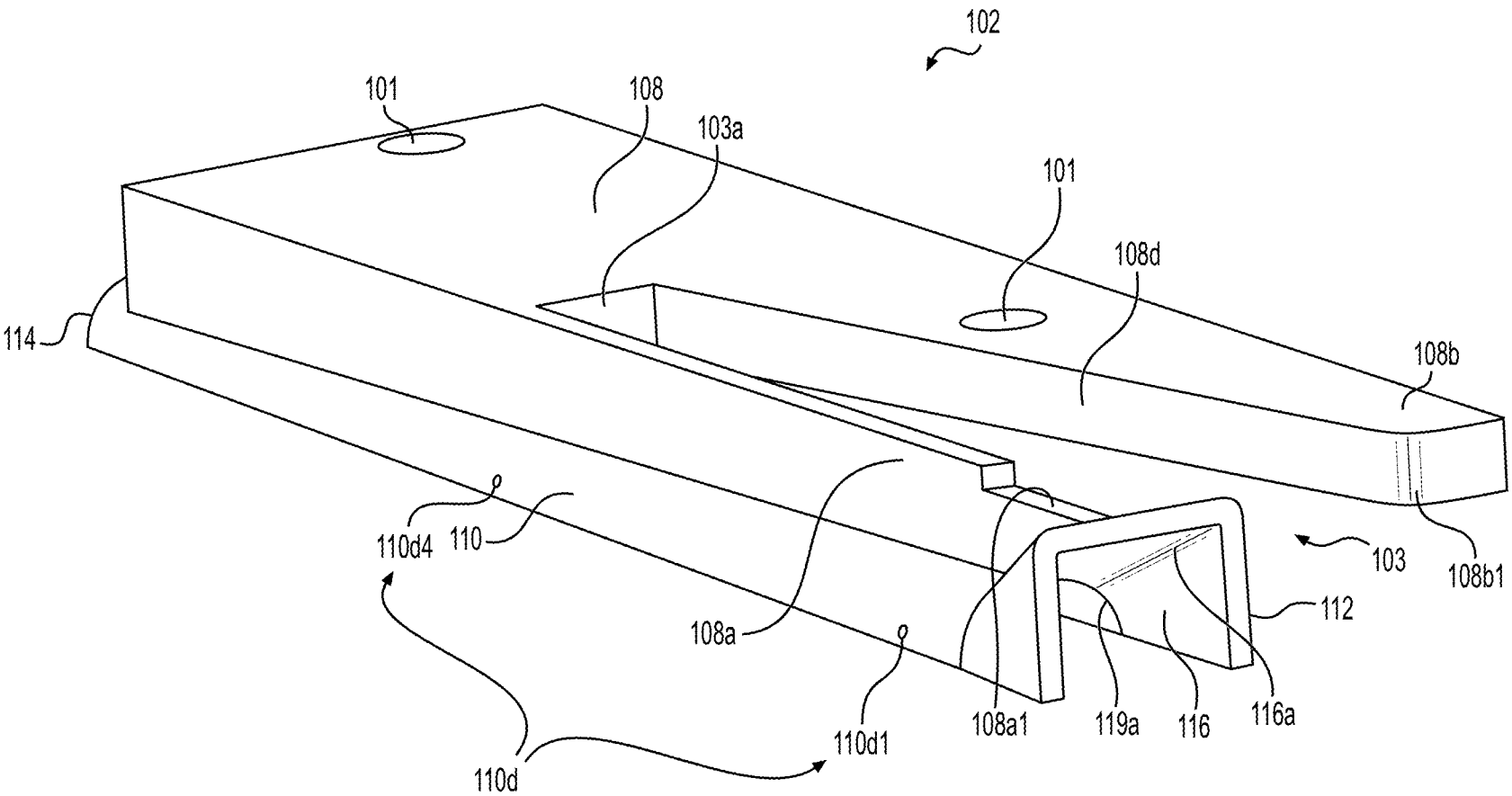
FIG. 9A is an illustration of an upper, front perspective view of a tongue, in accordance with an example embodiment.

FIG. 9A is an illustration of an upper, front perspective view of a tongue 102, in accordance with an example embodiment. In an example embodiment, the tongue 102 is an element of the compression box 100*a*, as explained in more detail herein. In an example embodiment, the tongue 102 includes a shaft 110 that is mounted to an upper plate (capture plate) 108. In an example embodiment, the upper plate 108 includes a first protrusion 108*a* and a second protrusion 108*b* that define a notch 103 on an end of the tongue 102. In an example embodiment, the first protrusion 108*a* and the second protrusion 108*b* are on a same side of the upper plate 108. In an example embodiment, the first protrusion 108*a* is peninsula-shaped, and the second protrusion 108*b* is triangular-shaped (when viewed from above). In an example embodiment, the notch 103 is substantially V-shaped, with a flattened vertex (flattened inner surface 103*a*). In an example embodiment, the first protrusion 108*a* includes a step portion 108*a*1 that adjacent to, and connects with, an inlet 112 of the shaft 110. In an example embodiment, the shaft 110 is mounted onto the upper plate 108 by virtue of the first protrusion 108*a* being connected to the shaft 110, where the first protrusion 108*a* runs along a portion of a longitudinal length of the shaft 110. In an example embodiment, the second protrusion 108*b* includes a beveled (smoothed) front corner 108*b*1 that allows the at least one covering 31 to pass along without damaging the at least one covering 31, as explained in more detail herein. In an example embodiment, the upper plate 108 includes the flat inner surface 103*a* that helps define the notch 103.

Figure 9B:
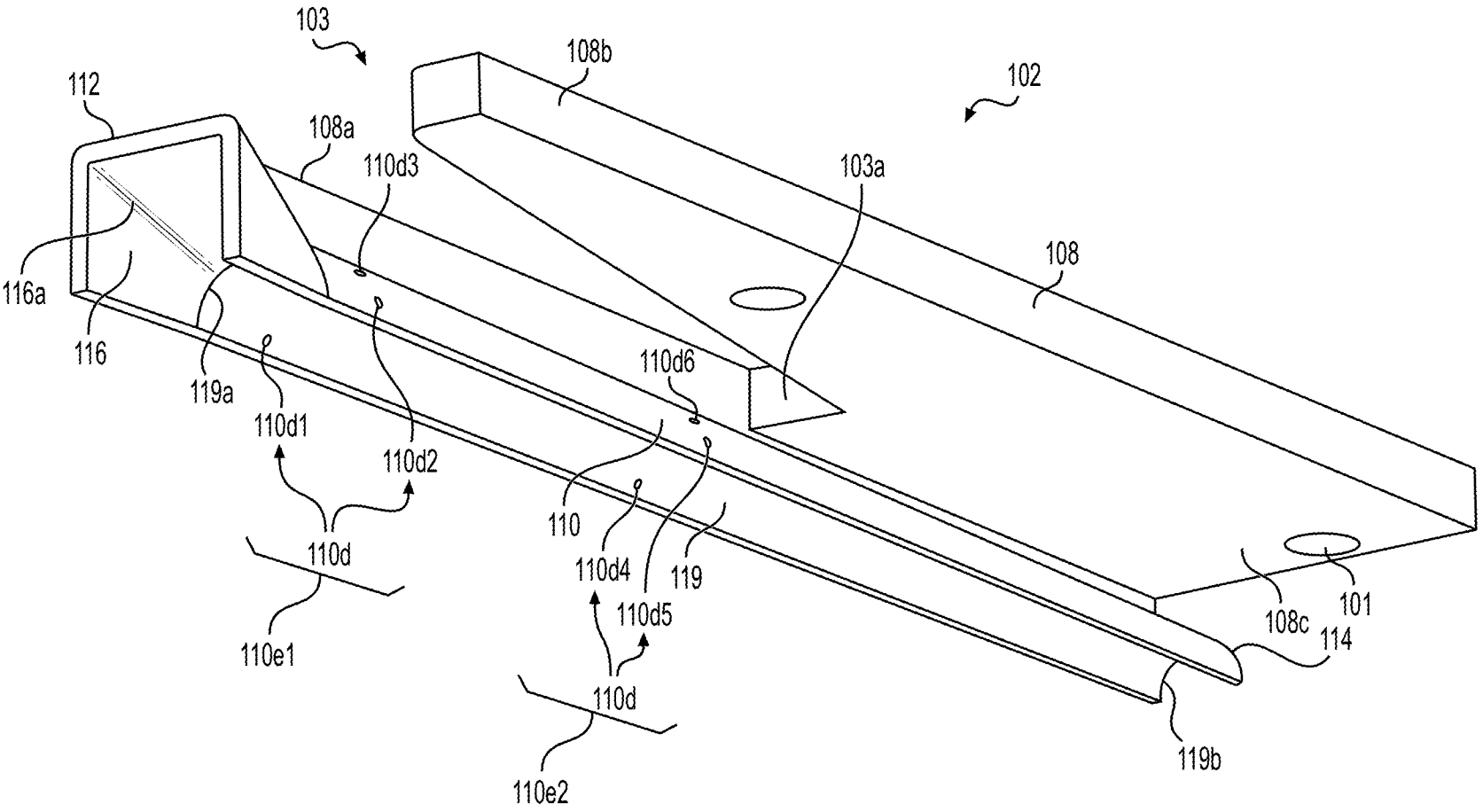
FIG. 9B is an illustration of a lower, front perspective view of the tongue, in accordance with an example embodiment.
Figure 9C:
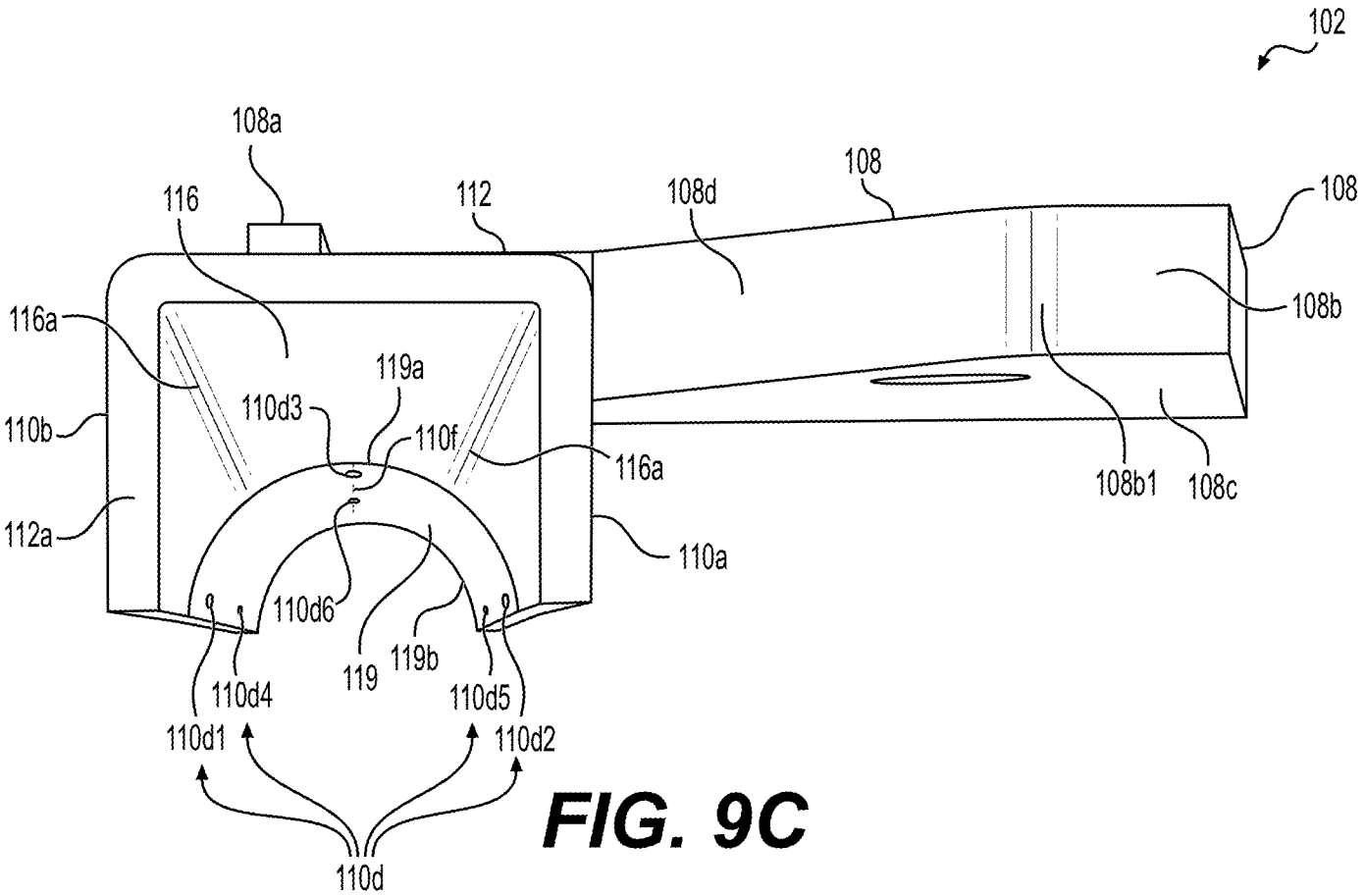
FIG. 9C is an illustration of a front view of the tongue, in accordance with an example embodiment.

In an example embodiment, the shaft 110 is hollow, and is in the shape of a half-pipe (semi-cylindrical shape), as shown better detail in at least FIGS. 9B and 9C. In an example embodiment, other shapes of the shaft 110 are contemplated. In an example embodiment, the shaft 110 includes the inlet 112. In an example embodiment, the inlet 112 is substantially U-shaped, where the inlet 112 forms a substantially square-shaped or rectangular-shaped opening for the tobacco column 1*a* to enter. Other inlet 112 shapes are contemplated. In an example embodiment, the inlet 112 includes a tapered entrance 116. In an example embodiment, the tapered entrance 116 tapers down to an inner inlet 119*a* that is arcuate-shaped. In an example embodiment, the tapered entrance 116 includes one or more lead-ins (creases) 116*a* in the tapered entrance 116. In an example embodiment, the shaft 110 includes an outlet 114.

In an example embodiment, a longitudinal length of the shaft 110 of the tongue 102 is relatively short. In an example embodiment, the relatively short longitudinal length of the shaft 110 reduces a potential "accordion effect" that can occur when pockets of less compressed tobacco, in the tobacco rod 1*b*, and become compressed together at high speeds, during use of the rod forming apparatus 10. In an example embodiment, the longitudinal length of the shaft 110, from the inlet 112 to the outlet 114, is about 10-18 cm, or about 11-15 cm, or about 12.7 cm.

In an example embodiment, the shaft 110 defines one or more injection ports 110*d* (where a first injection port 110*d*1 and a fourth injection port 110*d*4 are shown in FIG. 9A; also see injections ports 110*d*1-110*d*6 of the example embodiments in FIGS. 9B-9C, 10A-10C, and 12A-13B). In an example embodiment, the one or more injection ports 110*d* penetrate an outer surface of the shaft 110, and an inner surface 119 of the shaft 110 (see at least FIGS. 10B and 10C). In an example embodiment, the one or more injection ports 110*d* are used to inject at least one substance into the inside of the shaft 110, while the rod forming apparatus 10 is in use.

In an example embodiment, the at least one substance is water. In an example embodiment, water injection at the one or more injection ports 110*d* is used to clean the shaft 110, and lubricate the inner surface 119 of the shaft 110. In an example embodiment, the water injection at the one or more injection ports 110*d* is used to increase a moisture content of the tobacco rod 1*b*. In an example embodiment, the water injection is used to mitigate potential tobacco and/or flavorant build-up in the shaft 110 under conditions where the shaft 110 'runs dry,' especially due, at least in part, to overly dry tobacco flowing through the shaft 110 at relatively high rates of speed. In an example embodiment, water injection is performed on a metered basis in the shaft 110, using an injection rate that is proper to for the blend, consistency and moisture content of tobacco, the machining conditions (rate or production, speed and applied pressure on the tobacco rod 1*b* flowing through the shaft 110, ambient temperature, etc.), the material and surface smoothness of the shaft 110 (e.g., metal material, coated metal material, food-safe plastic/polymer, smooth or rough surface), and the production duration (e.g., the amount of anticipated wear of the inner surface 119 of the shaft 110), in order to avoid buildup of tobacco and other substances in the shaft 110, as well as buildup of elements of the rod forming apparatus 10 that are downstream of the compression box 100*a*.

In an example embodiment, the injection rate includes an injection of water at regular intervals, in between periods of time without any water injection. In another example embodiment, the injection rate includes intermittent water injection at irregular intervals. In an example embodiment, the injection rate of the water is determined via a measurement of an overall dryness of the tobacco, where the measurements are taken before, during or after a duration of time when the rod forming apparatus 10 is in use. In an example embodiment, the injection rate of water is continuous, or continuous for one or more periods of time, followed by periods of time where water is not injected. In an example embodiment, the water injection mitigates jamming, assists in the overall performance of the rod forming apparatus 10, and reduces maintenance demands and down-time of equipment. In an example embodiment, the injection rate of water is used to extend the useful life of the tongue 102, so that the water injection is used to extend the use of the tongue 102 prior to removing the tongue from the rod forming apparatus 10 for maintenance and/or replacement.

In an example embodiment, the at least one substance is at least one flavorant that can become commingled with the tobacco rod 1*b*, as the tobacco rod 1*b* flows through the shaft 110. In an example embodiment, the at least one flavorant may be at least one of a natural flavorant, an artificial flavorant, or a combination of a natural flavorant and an artificial flavorant. For instance, the at least one flavorant may include menthol, etc. In an example embodiment, the at least one substance is a mixture of water and the at least one flavorant. In an example embodiment, the at least one injection port 110*d* is used to intermittently, or regularly, inject the at least one flavorant and water, at separate intervals, or periods where they are injected at a same time, followed by periods where they are injected separately.

In an example embodiment, the at least one substance is at least one additive. In an example embodiment, the at least one additive changes a property of the tobacco in the tobacco rod 1*b*. In an example embodiment, the additive includes a humectant. In an example embodiment, the humectant is used to adjust and/or maintain a moisture content of the tobacco rod 1*b*, act as a preservative for the tobacco rod 1*b*, or both. In an example embodiment, examples of humectants include glycerol, propylene glycol, or combinations thereof. In an example embodiment, the humectant reduces a water activity in the consumer product 300, thereby reducing an opportunity for growth of micro-organisms. In an example embodiment, the humectant provides a higher moisture feel for a potentially dry composition of the tobacco 1. In an example embodiment, the considerations related to an injection rate, and the impact the humectant has on the tobacco, the compression box 100*a*, and/or the other equipment in the rod forming apparatus 10, are the same as the considerations described in relation to the injection rate of water (discussed herein).

In an example embodiment, the at least one substance is water, the at least one flavorant, the at least one additive, or combinations thereof. In an example embodiment, the one or more injection ports 110*d* are used to inject any or all of these substances, either together, or separately, either at regular or intermittent times, or on a continuous or semi-continuous basis. In an example embodiment, the one or more injection ports 110*d* are used to inject at least one first flavorant, where water is subsequently injected to flush residual levels of the at least one first flavorant. Following flushing, in an example embodiment, at least one second flavorant is injected via the one or more injection ports 110*d*. In an example embodiment, the at least one first flavorant is different than the at least one second flavorant.

In an example embodiment, use of the one or more injection ports 110*d* to introduce the at least one substance into the tobacco 1 at the compression box 100*a* is performed in lieu of introducing the at least one substance at a location within the rod forming apparatus 10 that is upstream of the compression box 100*a*. For example, introducing the at least one substance into the tobacco 1 at the compression box 100*a*, is performed instead of introducing the at least one substance into the tobacco 1 at the storage container 5, the feeder 8, the trough 14, or introducing the at least one substance into the tobacco 1 prior to the tobacco 1 being introduced into the rod forming apparatus 10. In another example embodiment, introduction of the at least one substance into the tobacco 1 at the compression box 100*a* is performed in addition to introducing a same or different substance into the tobacco 1 at a location that is upstream of the compression box 100*a*.

In an example embodiment, the at least one substance is introduced into the tobacco 1 at the compression box 100*a*, so that the elements of the rod forming apparatus 10 that are upstream of the compression box 100*a* do not need to be subsequently cleaned to remove undesired, residual levels of the at least one substance. For example, in an example embodiment, the at least one substance is introduced at the compression box 100*a*, so that residual levels of the at least one substance are not later discovered in the storage container 5, the feeder 8, the trough 14, the upper belt 12, the in-feed belt 20, the lower belt 22, etc. Injections of water at the compression box 100*a*, following introduction of the at least one substance, cause residual levels of the at least one substance to be flushed from the compression box 100*a* and/or equipment downstream of the compression box 100*a*. In an example embodiment, introduction of the at least one flavorant at the compression box 100*a*, which may be followed by injections of water at the compression box 100*a* to flush residual levels of the at least one flavorant (as needed, or if needed), allow for the subsequent introduction of different flavorants into the tobacco 1 without needing to shut down the rod forming apparatus 10 and/or clean major equipment within the rod forming apparatus 10.

In an example embodiment, the at least one substance is injected onto the inner surface 119 of the shaft 110, as opposed to being injected into a central location within the cross-sectional flow area of the shaft 110, to ensure that the at least one substance contacts, and in some regards streams along, the inner surface 119. In another example embodiment, the at least one substance is injected within a central location of the cross-sectional flow area of the shaft 110, via the use of an injection tube (not shown), or other structure, that extends away from the inner surface 119 of the shaft 110, in order to inject the at least one substance within the shaft 110 at a location that is somewhere other than directly on the inner surface 119 of the shaft 110.

In an example embodiment, the at least one substance is injected into the one or more injection ports 110*d*, via a pump, a test syringe pump, a micro-pump, a squeeze bulb (manually actuated) pump, a syringe, a fluid metering device, any well-known pump device, or combinations thereof. In an example embodiment, the at least one substance is injected individually into each of the one or more injection ports 110*d*, either at the same time or at different times. In an example embodiment, the at least one substance is injected into a manifold (tubular connecting structure), where the manifold is connected to at least one, or all, of the one or more injection ports 110*d*. In at least some example embodiments, use of the manifold allows for injection into some or all of the one or more injection ports 110*d* simultaneously. In an example embodiment, the manifold includes isolation valves to isolate or cease a flow of the at least one substance to some or all of the one or more injection ports 110*d*.

In an example embodiment, the upper plate 108 includes one or more bolt holes 101 that are used to mount the tongue 102. In an example embodiment, the one or more bolt holes 101 includes two bolt holes 101, where at least one of the bolt holes 101 traverses through the second protrusion 108*b*. In this example embodiment, the bolt holes 101 are engaging structure that is used to mount the tongue 102 on at least a portion of the rod forming apparatus 10 to stabilize the tongue 102. In an example embodiment, the one or more bolt holes 101 is located on a side (half) of the upper plate 108 that is opposite the location of the shaft 110. In an example embodiment, the inner surface of the one or more bolt holes 101 define threads capable of mating with mounting bolts. In another example embodiment, the inner surface of the one or more bolt holes 101 is a smooth surface devoid of threads.

FIG. 9B is an illustration of a lower, front perspective view of the tongue 102, in accordance with an example embodiment. In an example embodiment, the shaft 110 has an inner surface 119 that is arcuate-shaped, and runs along the longitudinal length of the shaft 110. In an example embodiment, the inner surface 119 faces away from the upper plate 108. In an example embodiment, the inner inlet 119*a* has a first radius of curvature that is larger than a second radius of curvature of an outlet 119*b*, where the outlet 119*b* is arcuate-shaped. That is to say, the inner inlet 119*a* is larger (with a bigger cross-sectional flow area), as compared to the outlet 119*b*. This causes the tobacco column 1*a* to continue to become compressed as it flows through the compression box 100*a*. In an example embodiment, the inner surface 119 of the shaft 110 has a continually decreasing radius of curvature, from the inner inlet 119*a* to the outlet 119*b*.

In an example embodiment, the tapered entrance 116 and the inner surface 119 of the shaft 110 are made from a food-safe plastic or polymer material. In an example embodiment, the tapered entrance 116 and the inner surface 119 of the shaft 110 are made from a polyether ether ketone (PEEK). In an example embodiment, the tongue 102 is made from a food-safe plastic or polymer material, or a polyether ether ketone (PEEK).

In another example embodiment, the shaft 110, or the inner surface 119 of the shaft 110 and the tapered entrance 116, or the overall tongue 102, or the portions of the tongue 102 that contact the tobacco rod 1*b* and/or the at least one covering 31, are made from a metal, such as stainless steel or carbon steel. In this example embodiment, the inner surface 119 of the shaft 110 and the tapered entrance 116, or the overall tongue 102, or the portions of the tongue 102 that contact the tobacco rod 1*b* and/or the at least one covering 31, are made from metal that may be coated with a food-safe coating. In an example embodiment, the food-safe coating is made from a food-safe plastic or polymer material, or a polyether ether ketone (PEEK).

In an example embodiment, a majority of a lower surface 108*c* of the upper plate 108 is substantially flat.

In an example embodiment, the shaft 110 defines the one or more injection ports 110*d* at different locations along the longitudinal length of the shaft 110. For example in an example embodiment, a first set (plurality) 110*e*1 of the one or more injection ports 110*d* is located near the inlet 112 of the shaft 110, and a second set (plurality) 110*e*2 of the one or more injection ports 110*d* is positioned near a mid-section of the shaft 110. In an example embodiment, the mid-section of the shaft 110 is a middle of the shaft 110, relative to the longitudinal length of the shaft 110. In an example embodiment, the first set 110*e*1 of the one or more injection ports 110*d* includes at least three injection ports (e.g., the first injection port 110*d*1, the second injection port 110*d*2 and a third injection port 110*d*3). In an example embodiment, the second set 110*e*2 of the one or more injection ports 110*d* is between a mid-section of the shaft 110, and the outlet 114 of the shaft 110.

In this example embodiment, the first set 110*e*1 of the one or more injection ports 110*d* can be substantially evenly distributed along a circumference of the inner surface 119 of the shaft 110, as shown in FIG. 9B (where the first set 110*e* includes the first injection port 110*d*1 and the second injection port 110*d*2 near ends of the arcuate-shaped inner surface 119, and the third injection port 110*d*3 is substantially positioned near a center of the arcuate-shaped inner surface 119). Similarly, in an example embodiment, the second set 110*e*2 of the one or more injection ports 110*d* is substantially evenly distributed along the circumference of the inner surface 119 near the mid-section of the shaft 110 (e.g., the fourth injection port 110*d*4 and a fifth injection port 110*d*5 are near ends of the arcuate-shaped inner surface 119, and a sixth injection port 110*d*6 is near a center of the arcuate-shaped inner surface 119). Other shapes for the inner surface 119 of the shaft 110 are contemplated, where the one or more injection ports 110*d* are evenly distributed at one or more locations along the longitudinal length of the shaft 110.

In an example embodiment, more than two sets of injection ports (e.g. more than 110*e*1 and 110*e*2) are defined by the shaft 110.

In an example embodiment, the shaft 110 defines only a single injection port. In an example embodiment, the single injection port is the third injection port 110*d*3 or the sixth injection port 110*d*6. In an example embodiment, the single injection port is defined in the shaft 110 to be positioned at a center location of the circumference of the inner surface 119 of the shaft 110 (e.g., a highest elevation along the inner surface 119 of the shaft 110).

In an example embodiment, the shaft 110 defines only two injection ports. In an example embodiment, the two injection ports are the third injection port 110*d*3 and the sixth injection port 110*d*6. In an example embodiment, the one or more injection ports 110*d* are located between the inlet 112 and the mid-section of the shaft 110, along the longitudinal length of the shaft 110. In an example embodiment, the tapered entrance 116 defines at least some, or all, of the one or more injection ports 110*d*.

In an example embodiment, the one or more injection ports 110*d* are defined at any location along the longitudinal length of the shaft 110, and may include any number of injection ports.

In an example embodiment, some or all of the one or more injection ports 110*d* are defined so that they have an oval-shaped opening along the inner surface 119 of the shaft 110, as shown in FIG. 9B (e.g., see the first injection port 110*d*1 and the fourth injection port 110*d*4). In this example embodiment, the oval-shaped opening assists in injecting the at least one substance over a larger area within the inside of the shaft 110, which in turn provides an increased level of mixing between the at least one substance and the tobacco rod 1*b*. In another example embodiment, the opening of some or all of the one or more injection ports 110*d* are oval-shaped, tear-drop shaped, or reverse tear-drop shaped (see the example embodiments of FIGS. 15A-15G). Other shapes of the opening of the one or more injection ports 110*d* are contemplated.

FIG. 9C is an illustration of a front view of the tongue 102, in accordance with an example embodiment. In an example embodiment, a rim 112*a* of the inlet 112 of the tongue 102 fits into the notch 85*a* of the first squeeze bar 60 and the second squeeze bar 62, thereby stabilizing the tip 86 of the horizontal portion 84 of each of the squeeze bars 60/62 (see FIG. 14). In another example embodiment, where the squeeze bars 60/62 include only a single protrusion 85, the single protrusion 85 of each squeeze bar 60/62 may fit along the tapered entrance 116 of the inlet 112 of the tongue 102, such that the single protrusion 85 contacts an inner edge of the rim 112*a* of the inlet 112. In another example embodiment, where the squeeze bars 60/62 do not include a protrusion 85, the tip 86 of the squeeze bars 60/62 abut the rim 112*a* of the inlet 112 of the tongue 102.

In an example embodiment, at least some of the one or more injection ports 110*d* traverse a centerline 110*f* of the inner surface 119 of the shaft 110. In an example embodiment, at least one of the injection ports from each set of the injection ports (e.g., 110*e*1 and 110*e*2), traverses the centerline 110*f* of the inner surface 119. In an example embodiment, the centerline 110*f* is an imaginary line running along the center of the inner surface 119, along the longitudinal length of the inner surface 119. In an example embodiment, the centerline 110*f* substantially divides the inner surface 199 into equal halves (e.g., equal sides). In this example embodiment, other injection ports, of each set of injection ports (e.g., 110*e*1 and 110*e*2), are located on either side of the centerline 110*f*. In an example embodiment, the centerline 110*f* is at a center location of the circumference of the inner surface 119 of the shaft 110 (e.g., a highest elevation along the inner surface 119 of the shaft 110).

In an example embodiment, during use of the rod forming apparatus 10, the lap edge 33 of the at least one covering 31 (see at least FIG. 17A) travels along a first outer side surface 110*a* of the shaft 110, and a free edge 37 of the at least one covering 31 travels along a second outer surface 110*b* of the shaft 110, while the tobacco column 1*a* enters the inlet 112 of the tongue 102, and the tobacco column 1*a* is formed into a tobacco rod 1*b* as the tobacco flows past the inner inlet 119*a* (see at least FIG. 17A, which is view A-A of FIG. 1). As the tobacco rod 1*b* flows through the tongue 102, the tobacco rod 1*b* becomes further compressed prior to exiting the tongue 102. In an example embodiment, as the at least one covering 31 passes along the tongue 102, the lap edge 33 may contact an angled surface 108*d* of the upper plate 108 (depending on a width of the at least one covering 31), as the at least one covering 31 becomes partially folded around the lower portion of the tobacco rod 1*b* that is formed in the tongue 102 (see FIG. 17A).

Figure 10A:
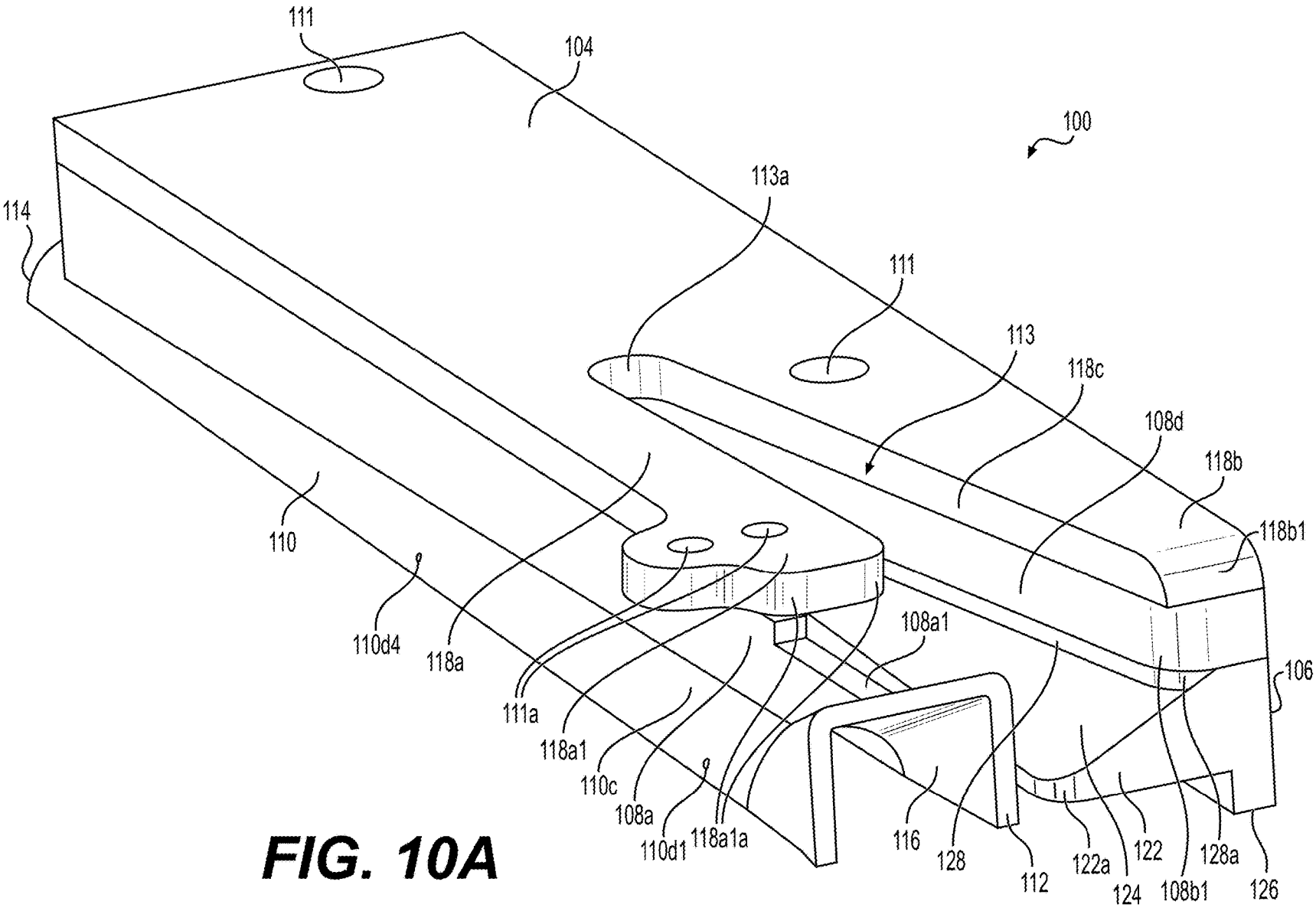
FIG. 10A is an illustration of an upper, front perspective view of a tongue assembly, in accordance with an example embodiment.

FIG. 10A is an illustration of an upper, front perspective view of the tongue assembly 100, in accordance with an example embodiment. In an example embodiment, the tongue assembly 100 includes an upper mounting plate 104 and a lower mounting plate 106 (seen in better detail in FIGS. 11A and 11B), capable of being connected above and below the tongue 102. In an example embodiment, the upper mounting plate 104 includes mounting bolt holes 111 that align with the mounting bolt holes 101 of the tongue 102, one or more mounting bolt holes 131 in the lower mounting plate 106 (FIG. 10C), and one or more mounting bolt holes 164 in the lower plate 150 (FIG. 13C) of the compression box 100*a* (see FIG. 13A). In this example embodiment, the mounting bolt holes 111/131 are engaging structure that is used to mount the tongue assembly 100 on at least a portion of the rod forming apparatus 10 to stabilize the tongue assembly 100. In an example embodiment, the upper mounting plate 104 includes two mounting bolt holes 111, or more than two mounting bolt holes 111, that mate with bolt holes in the upper plate 108 of the tongue 102 and the lower mounting plate 106. In an example embodiment, the upper mounting plate 104 includes mounting bolt holes 111, used for the purpose of mounting the tongue assembly 100 onto the lower plate 150 of the compression box 100*a*, where the mounting bolt holes 111 are located on a side (half) of the tongue assembly 100 that is opposite the location of the shaft 110.

In an example embodiment, the upper mounting plate 104 includes a first protrusion 118*a* and a second protrusion 118*b* that define a notch 113. In an example embodiment, the notch 113 substantially matches a shape of the notch 103 (FIG. 9A) of the upper plate 108 of the tongue 102, where the notch 113 and notch 103 substantially align with each other once the tongue assembly 100 is assembled. In an example embodiment, the notch 113 is substantially V-shaped, with a rounded vertex (curved inner surface 113*a*). In an example embodiment, the first protrusion 118*a* is substantially peninsula-shaped and the second protrusion 118*b* is substantially triangular-shaped (when viewed from above). In an example embodiment, the upper mounting plate includes the curved inner surface 113*a* on an inner portion of the notch 113.

In an example embodiment, the first protrusion 118*a* includes an enlarged end portion 118*a*1. In an example embodiment, the first protrusion 118*a* includes one or more bolt holes 111*a*. In an example embodiment, the one or more bolt holes 111*a* straddle sides of the first protrusion 108*a* of the tongue 102, so that bolts 111*b* (FIG. 13A) can be screwed into the one or more bolt holes 111*a*, where distal ends of the bolts 111*b* can contact an upper surface 110*c* of the shaft 110 to help stabilize the upper mounting plate 104 on the tongue 102 (see FIG. 13A). In an example embodiment, the inner surface of the one or more bolt holes 111*a* define threads capable of mating with the bolts 111*b*. In an example embodiment, a front surface of the enlarged end portion 118*a*1 of the first protrusion 118*a* includes one or more beveled corners 118*a*1*a*.

In an example embodiment, the second protrusion 118*b* includes a beveled (smoothed) front surface 118*b*1. In an example embodiment, the second protrusion 118*b* includes an angled surface 118*c* that substantially aligns with the angled surface 108*d* of the tongue 102.

In an example embodiment, the lower mounting plate 106 includes a shelf 122 that extends from an inner side of the lower mounting plate 106 toward the shaft 110 of the tongue 102. In an example embodiment, the shelf 122 includes an inclined surface 124 that is upwardly facing, and extends toward an end surface 106*a* of the lower mounting plate 106 (shown in better detail in FIG. 11B). In an example embodiment, the inclined surface 124 inclines away from the shaft 110, and inclines toward the side surface (inner side surface) 130 of the lower mounting plate 106. In an example embodiment, the shelf 122 includes a front corner 122*a* that is beveled (rounded), and faces the inlet 112 of the shaft 110 of the tongue 102. In an example embodiment, the lower mounting plate 106 includes an angled surface 128 that extends above the inclined surface 124. In an example embodiment, the angled surface 128 is conformed to generally align with the angled surface 108*d* of the tongue 102 and the angled surface 118*c* of the upper mounting plate 104. In an example embodiment, the angled surface 128 includes a beveled (rounded) front corner 128*a*.

In an example embodiment, a protrusion 126 extends from a lower end of the lower mounting plate 106. In an example embodiment, the protrusion 126 runs along a longitudinal length of the lower mounting plate 106, and assists in allowing the lower mounting plate 106 and the tongue assembly 100 to be correctly aligned and mounted onto the lower plate 150 of the compression box 100*a* (see FIG. 13A).

In an example embodiment, the overall height of the tongue assembly 100 is substantially uniform, such that the tongue assembly 100 is substantially flat when installed on the rod forming apparatus 10. Said another way, when the tongue assembly 100 is installed on the rod forming apparatus 10, the top surface of the upper mounting plate 104 is substantially flat, and the general height of the tongue assembly 100 (from the lower surface 132 of the lower mounting plate 106 to the upper surface of the upper mounting plate 104) is substantially uniform, along a length of the tongue assembly 100.

In an example embodiment, the upper mounting plate 104 is used to support and protect the tongue 102 from deformation and/or warping during use in the rod forming apparatus 10, especially if the shaft 110, or the overall tongue 102, is made from a material other than metal.

Figure 12A:
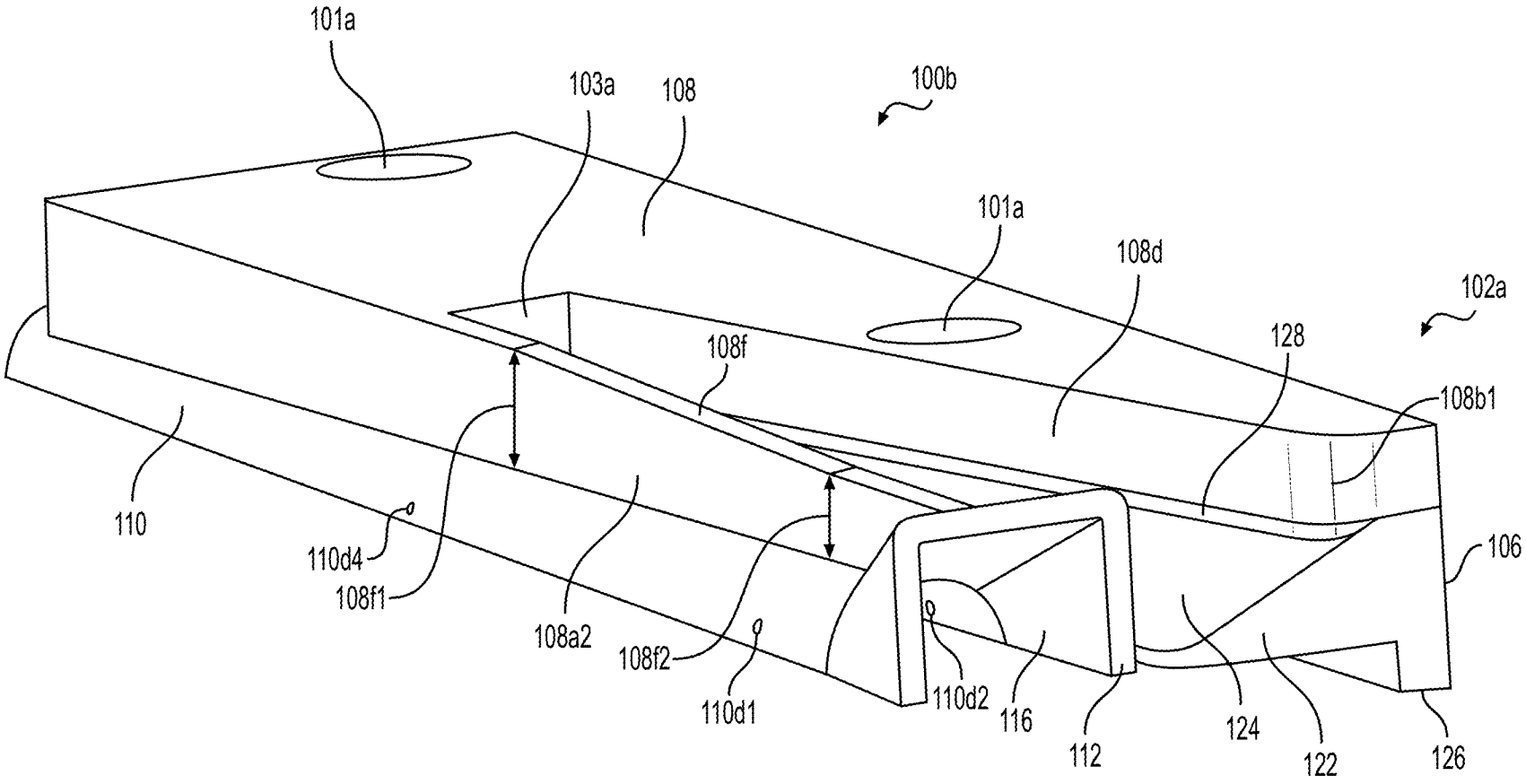
FIG. 12A is an illustration of a front, upper perspective view of a second embodiment of a tongue assembly, in accordance with an example embodiment.

In an example embodiment, the tongue assembly 100 does not include the upper mounting plate 104 (see the example embodiment of FIG. 12A). In this example embodiment, the shaft 110, or the overall tongue 102, is made from a hard material, such as metal (as described above), that resists deformation and/or warping during use in the rod forming apparatus 10.

In an example embodiment, the upper mounting plate 104 and/or the lower mounting plate 106 are integrally and/or monolithically formed with the tongue 102, such that the upper mounting plate 104 and/or the lower mounting plate 106 are not separate elements from the tongue 102.

Figure 10B:
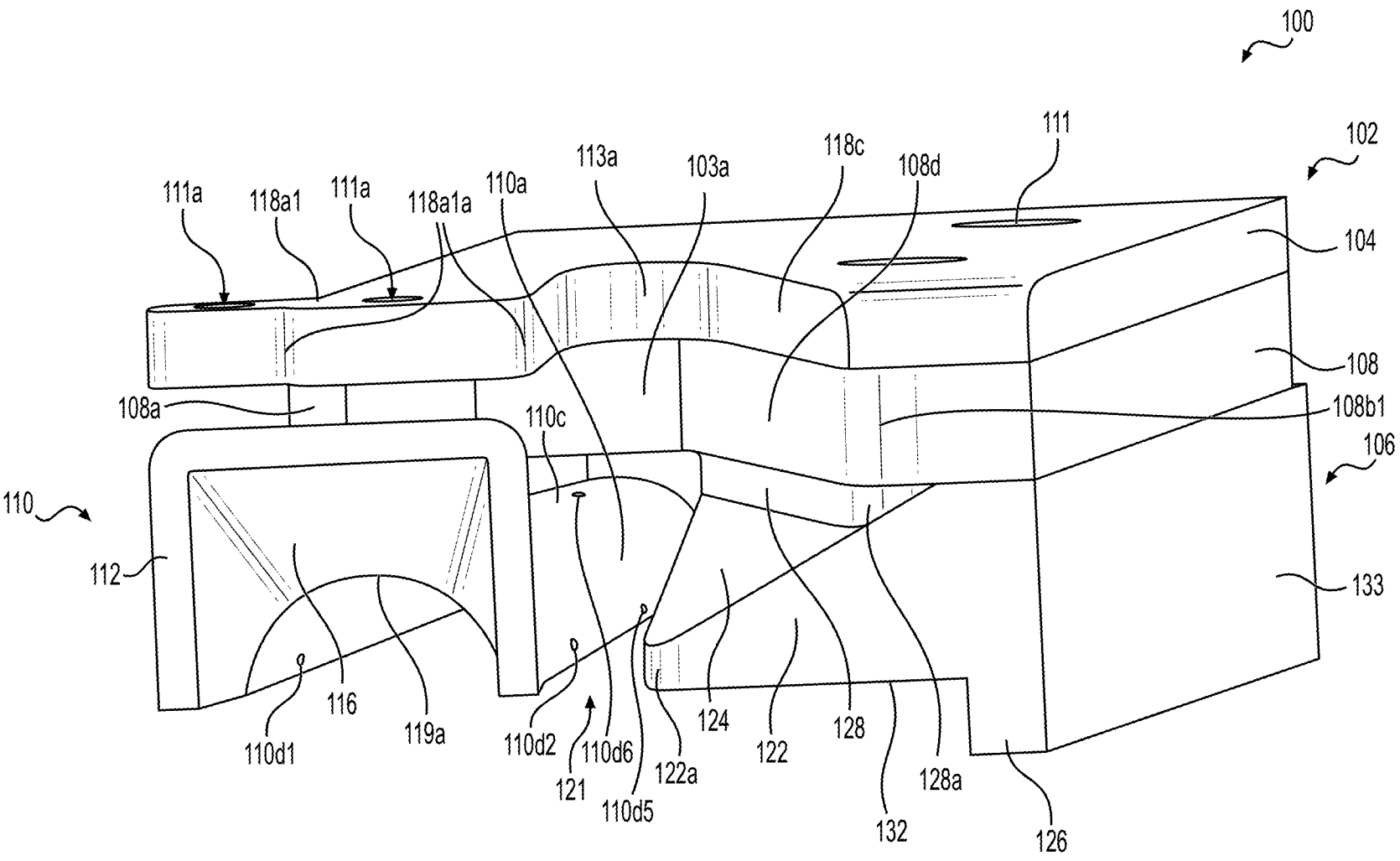
FIG. 10B is an illustration of a front perspective view of the tongue assembly, in accordance with an example embodiment.

FIG. 10B is an illustration of a front perspective view of the tongue assembly 100, in accordance with an example embodiment. In an example embodiment, the tongue assembly 100 defines an opening 121 for the lap edge 33 of the at least one covering 31 (see FIG. 17A) to pass through. In an example embodiment, the opening 121 is defined by at least the following elements: the first outer side surface 110*a* of the shaft 110, the inclined surface 124 of the lower mounting plate 106, an outer edge 130*a* below the inclined surface 124 (see FIG. 11B), the angled surfaces 128/108*d*/118*c*, the first protrusion 108*a* of the tongue 102, the lower surface 108*c* of the upper plate 108 of the tongue 102, and a side surface 130 of the lower mounting plate 106 (see FIG. 11B). In an example embodiment, the opening 121 is able to accommodate the at least one covering 31, where the at least one covering 31 is relatively wide. In an example embodiment, a width of the at least one covering 31 is about 25 mm to 36 mm, or about 30 mm to 36 mm, or about 34 mm.

In an example embodiment, and as shown in at least FIGS. 1 and 3, the tobacco column 1*a* flows through the squeeze bars 60/62, and is compressed down to a tobacco rod 1*b* (FIG. 17A), whereupon the tobacco rod 1*b* and the at least one covering 31 enter and flow through the compression box 100*a*. Specifically, in an example embodiment, the tobacco rod 1*b* flows between the shaft 110 of the tongue 102 and a groove 152 of the lower plate 150 (see FIG. 13A), as the lap edge 33 of the at least one covering 31 enters and passes through the opening 121 of the tongue assembly 100. Specifically, in an example embodiment, the lap edge 33 of the at least one covering 31 slides along the inclined surface 124 within the opening 121, before being partially folded toward the tobacco rod 1*b* as the lap edge 33 contacts the side surface 130 of the lower mounting plate 106 (FIG. 11B). In an example embodiment, a width of the inclined surface 124 is continually reduced, from a front end to a back end of the inclined surface 124 (also shown in in FIG. 11B), to cause the lap edge 33 of the at least one covering 31 to fold toward the upper surface 110*c* of the shaft 110, as the lap edge 33 travels through the tongue assembly 100. In an example embodiment, as the tobacco rod 1*b* exits the outlet 114 of the tongue 102 of the compression box 100*a*, the tobacco rod 1*b* and the at least one covering 31 are in a configuration as shown in FIG. 17B (where FIG. 17B is view B-B of FIG. 1).

In an example embodiment, one or more of the following corners are beveled (rounded), in the event the lap edge 33 of the at least one covering 31 may contact them, so that the at least one covering 31 is not inadvertently torn or damaged: the front corner 122*a* of the shelf 122, the front corner 128*a* of the angled surface 128, the front corner 108*b*1 of the angled surface 108*d*, and the beveled corners 118*a*1*a* of the enlarged end portion 118*a*1 of the upper mounting plate 104.

In an example embodiment, a side surface 133 of the lower mounting plate 106 is substantially flat.

Figure 10C:
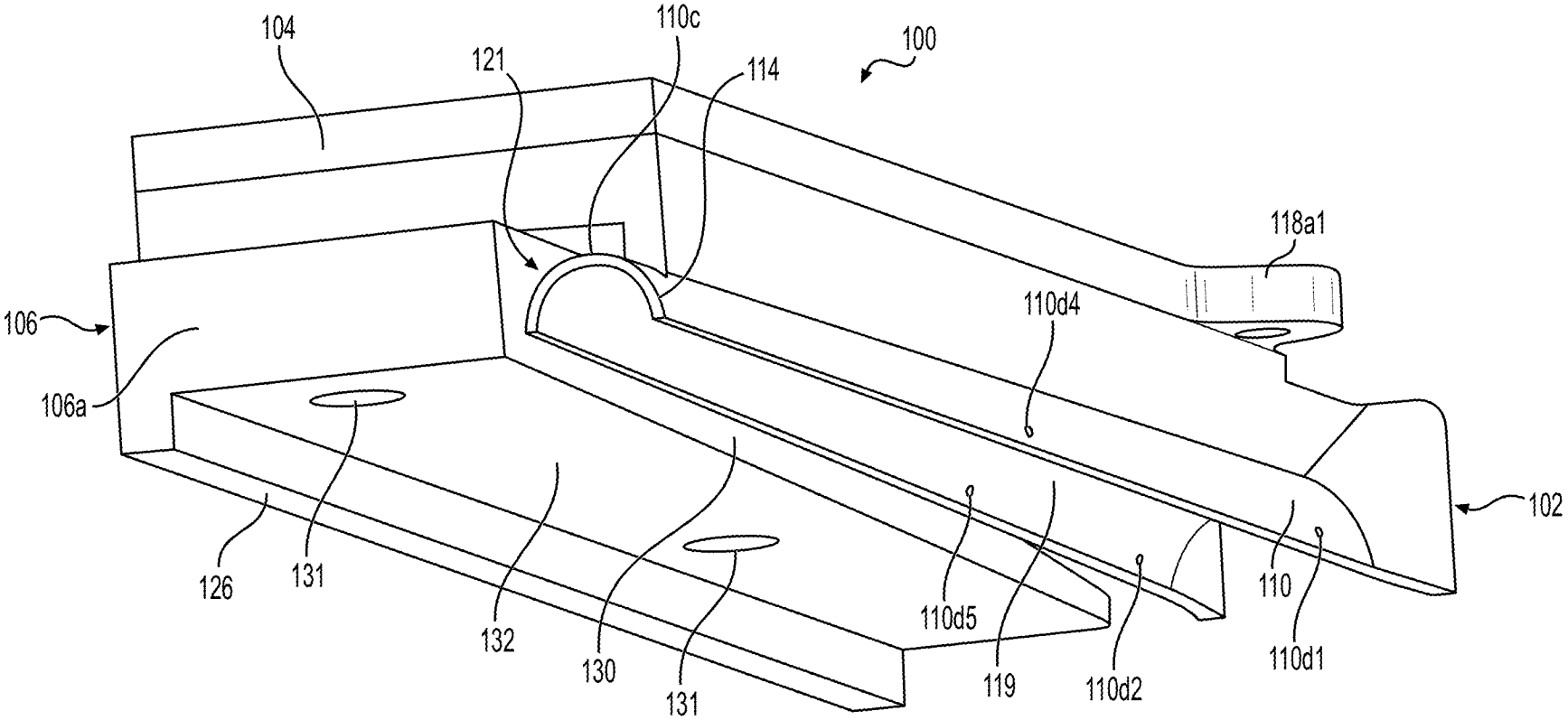
FIG. 10C is an illustration of a lower, rear perspective view of the tongue assembly, in accordance with an example embodiment.

FIG. 10C is an illustration of a lower, rear perspective view of the tongue assembly 100, in accordance with an example embodiment. In an example embodiment, and as shown in FIG. 10C, a lower surface 132 of the lower mounting plate 106 is substantially flat. In an example embodiment, the protrusion 126 extends along an edge of the lower surface 132. In an example embodiment, the one or more mounting bolt holes 131 of the lower mounting plate 106 traverse through the lower surface 132.

In an example embodiment, an elevation (height) of the upper surface 110*c* of the shaft 110 is about even with an elevation of the adhesive applicator 40 (FIG. 1). In an example embodiment, the lap edge 33 of the at least one covering 31 is raised up, as it passes over inclined surface 124 (see FIG. 10B), and the lap edge 33 curls over and is substantially at the elevation of the upper surface 110*c*, as the lap edge 33 passes through the end of the opening 121, so that the lap edge 33 is out of the way and allows the adhesive applicator 40 to access and apply the adhesive 35 to the free edge 37 of the at least one covering 31 (see FIG. 17B), as the at least one covering 31 passes through the back end of the tongue assembly 100.

Figure 10D:
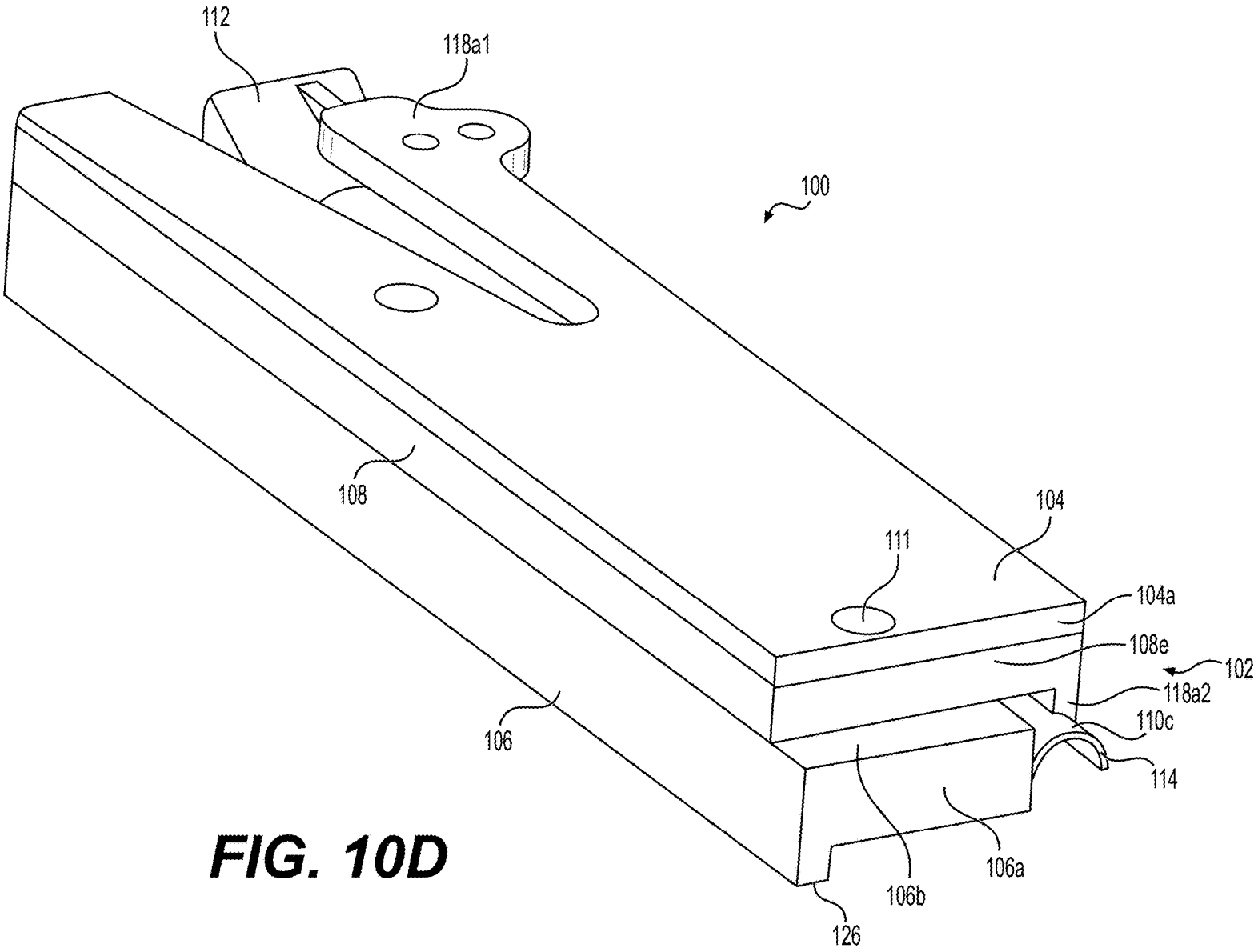
FIG. 10D is an illustration of an upper, rear perspective view of the tongue assembly, in accordance with an example embodiment.

FIG. 10D is an illustration of an upper, rear perspective view of the tongue assembly 100, in accordance with an example embodiment. In an example embodiment, an end surface 104*a* of the upper mounting plate 104 is substantially aligned with an end surface 108*e* of the tongue 102. In an example embodiment, the end surface 106*a* of the lower mounting plate 106 extends from the end surfaces 104*a*/108*e*, thereby creating a step 106*b* that is formed by the lower mounting plate 106.

In an example embodiment, an extension 118*a*2 of the upper plate 108 connects to the upper surface 110*c* of the shaft 110.

Figure 11A:
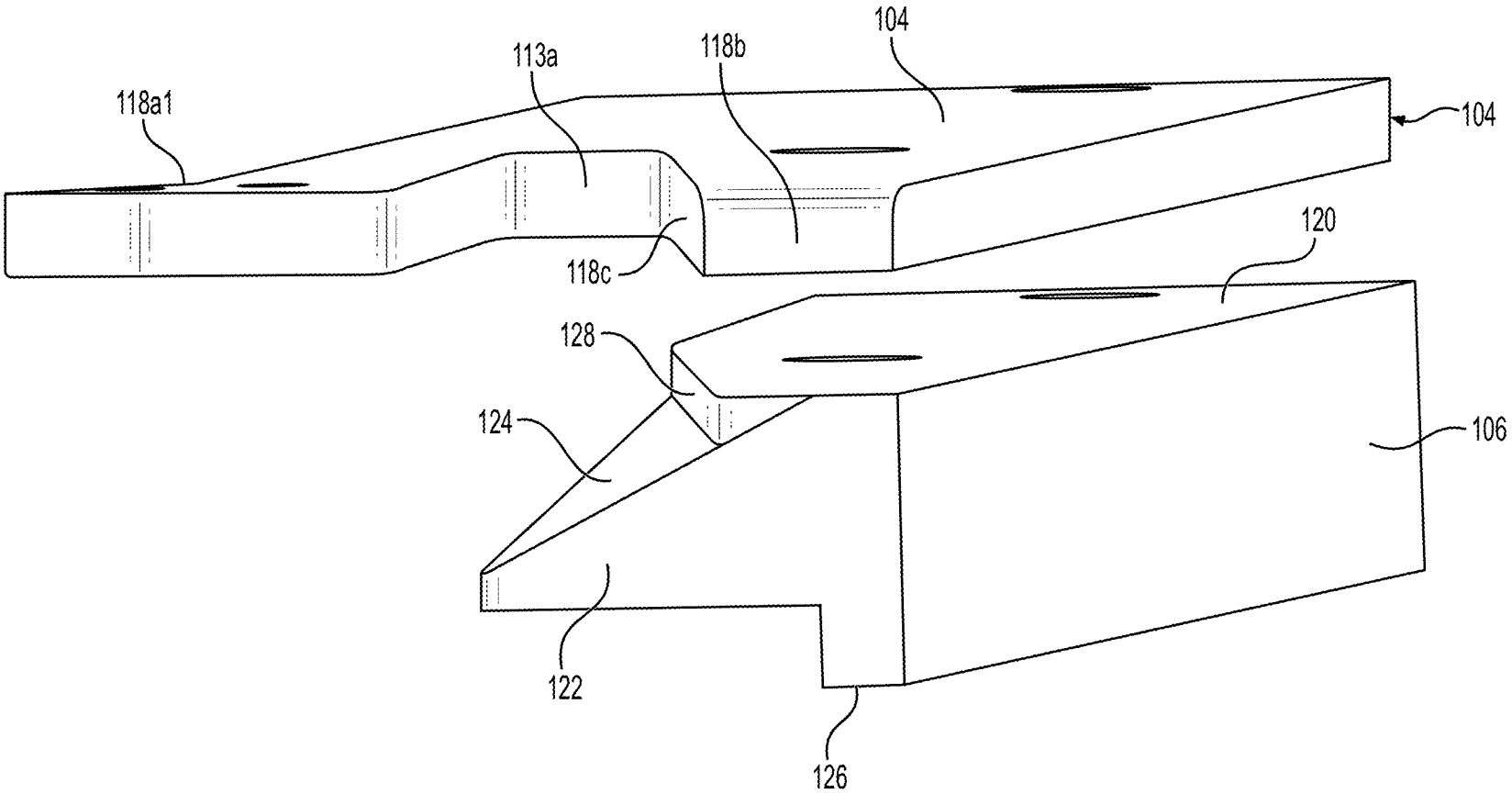
FIG. 11A is an illustration of a perspective view of mounting plates for the tongue assembly, in accordance with an example embodiment.
Figure 11B:
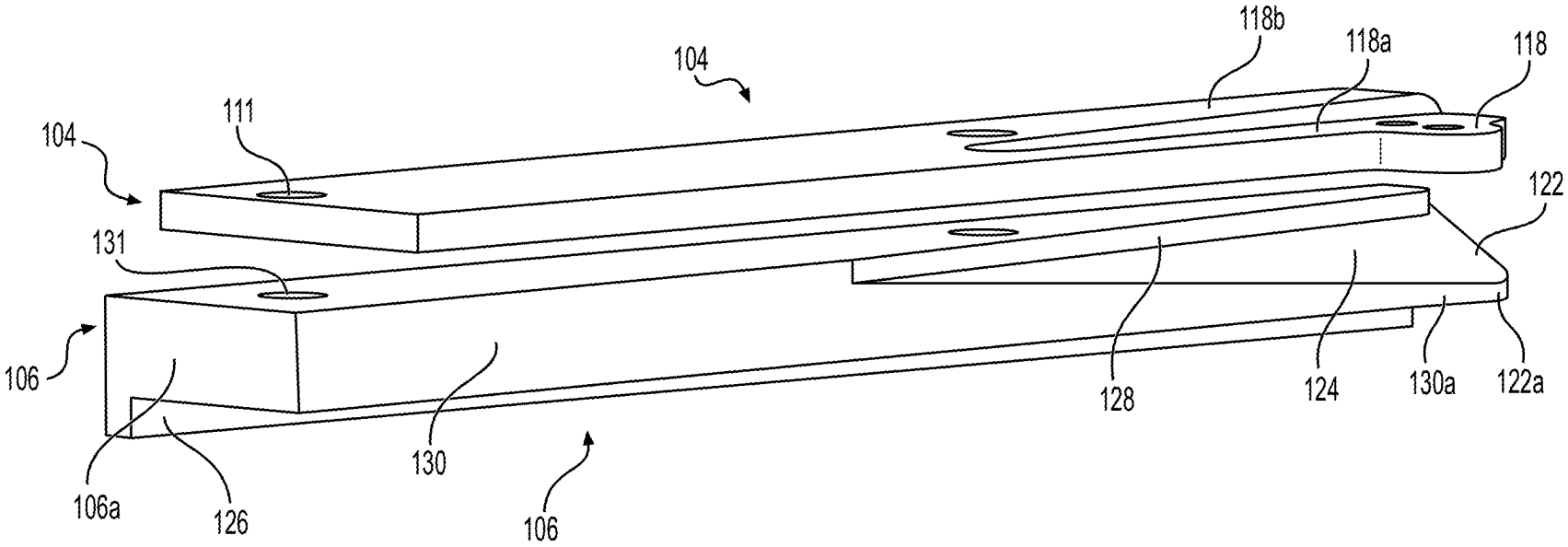
FIG. 11B is an illustration of another perspective view of the mounting plates for the tongue assembly, in accordance with an example embodiment.

FIG. 11A is an illustration of a perspective view of the upper mounting plate 104 and the lower mounting plate 106 for the tongue assembly 100, in accordance with an example embodiment. In an example embodiment, and as shown in FIG. 11A, the mounting plates 104/106 are shaped so that the lap edge 33 of the at least one covering 31 is able to smoothly enter the compression box 100*a* by passing over the inclined surface 124. Depending on an overall width of the at least one covering 31, the lap edge 33 may glance along the angled surface 128 of the lower mounting plate 106 and/or the angled surface 118*c* of the upper mounting plate 104, and may also contact the curved inner surface 113*a* of the upper mounting plate 104, prior to being gently folded toward the tobacco rod 1*b* (see FIG. 17B, which is view B-B of FIG. 1), as the at least one covering 31 exits the tongue assembly 100 between the outlet 114 of the shaft 110 and the side surface 130 of the lower mounting plate 106 (see FIG. 10C).

In an example embodiment, a top surface 120 of the lower mounting plate 106 is substantially flat, and mates with the lower surface 108*c* of the upper plate 108 of the tongue 102.

FIG. 11B is an illustration of another perspective view of the upper mounting plate 104 and the lower mounting plate 106 for the tongue assembly 100, in accordance with an example embodiment. In an example embodiment, the shelf 122 extends from a side of the lower mounting plate 106, where the inclined surface 124 of the shelf 122 extends along about half of a longitudinal length of the lower mounting plate 106.

Figure 11C:
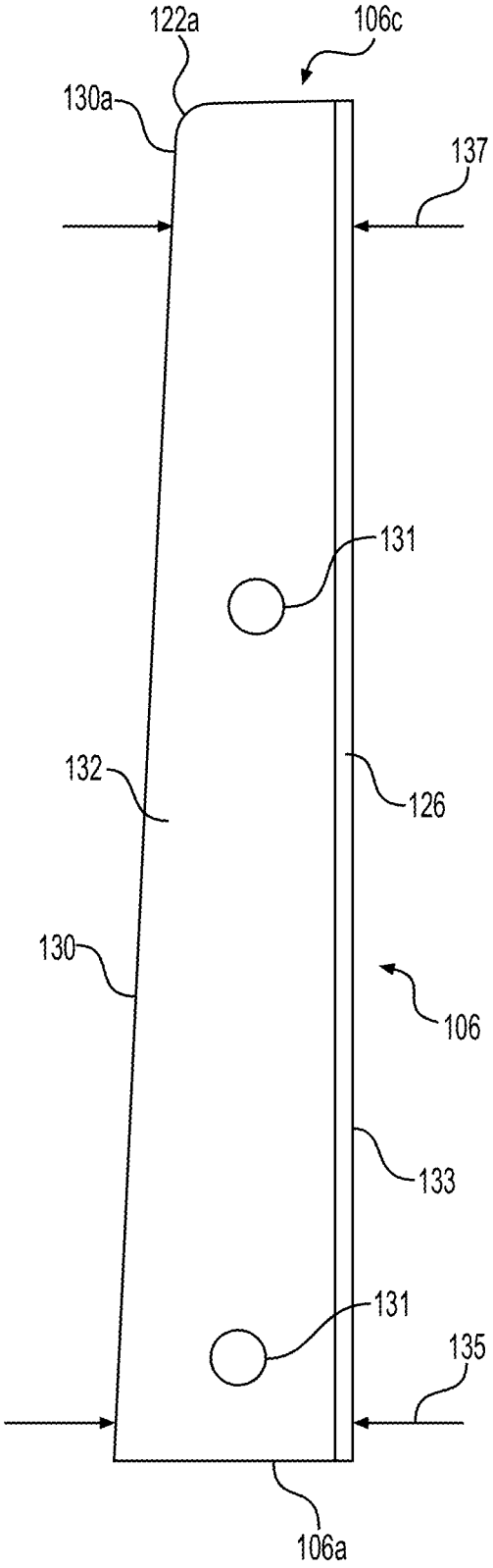
FIG. 11C is an illustration of a lower view of the lower mounting plate for the tongue assembly, in accordance with an example embodiment.

FIG. 11C is an illustration of a lower view of the lower mounting plate 106 for the tongue assembly 100, in accordance with an example embodiment. In an example embodiment, a first width 135 of the lower mounting plate 106 is larger than a second width 137 of the lower mounting plate 106. In an example embodiment, the side surface 130 is angled, relative to the side surface 133 and the end surface 106*a*, to cause the width of the lower mounting plate 106 to narrow toward a front end 106*c* of the mounting plate 106. In an example embodiment, the width of the lower mounting plate 106 continually narrows, from the end surface 106*a* to the front end 106*c* of the mounting plate 106.

FIG. 12A is an illustration of a front, upper perspective view of a second embodiment of a tongue assembly 100*b*, in accordance with an example embodiment. In an example embodiment, the shaft 110, or the upper plate 108, or the tongue 102*a* as a whole, are made from a hard material that resists deformation and/or warping during use in the rod forming apparatus 10. In an example embodiment, the hard material is a metal. In an example embodiment, the metal is at least one of stainless steel, carbon steel, or combinations thereof. In an example embodiment, the inner surface 119 of the shaft 110 and the tapered entrance 116, or at least some of the surfaces of the tongue 102*a*, or surfaces of the tongue 102*a* that contact the tobacco rod 1*b* and/or the at least one covering 31, are coated with a food-safe coating. In an example embodiment, the food-safe coating includes at least one of a food-safe plastic, polymer material, a polyether ether ketone (PEEK), or combinations thereof.

In an example embodiment, discussion of the one or more injection ports 110*d* described in relation to the example embodiments of FIGS. 9A-10C, including a number, a shape, a location of the one or more injection ports 110*d*, and a use of the one or more injection ports 110*d* to inject the at least one substance on the inner surface 119 of the shaft 110, apply equally to the one or more injection ports 110*d* and the shaft 110 of the example embodiment of FIG. 12A. In an example embodiment, discussion of the injection of the at least one substance into the shaft 110 of the tongue 102 in relation to the example embodiments of FIGS. 9A-10C, apply equally to injection of the at least one substance into the shaft 110 of the tongue 102*a* of the example embodiments of FIG. 12A.

In some example embodiments where the shaft 110, and/or the upper plate 108, or the tongue 102*a* as a whole are made from a hard material, the tongue assembly 100*b* does not include an upper mounting plate (such as the upper mounting plate 104 of FIG. 10A). In this example embodiment, the upper plate 108 of the tongue 102*a* may constitute an upper surface of the tongue assembly 100*b*.

Figure 12B:
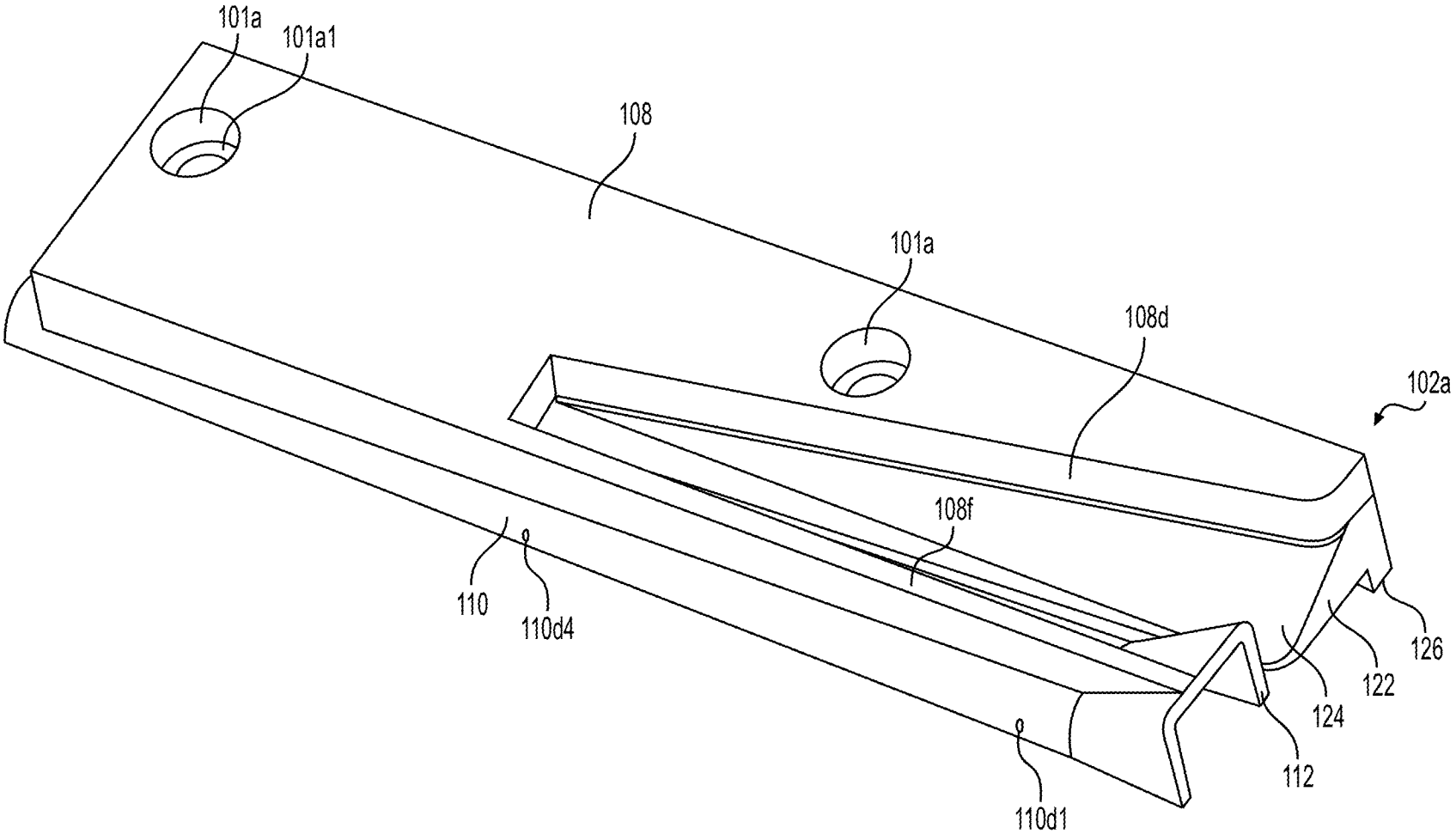
FIG. 12B is an illustration of an upper perspective view of the second embodiment of the tongue assembly, in accordance with an example embodiment.

In an example embodiment, the upper plate 108 of the tongue 102*a* includes one or more bolt holes 101 that are counter-sunk holes (as shown in better detail in FIG. 12B). In an example embodiment, the tongue 102*a* includes a first protrusion 108*a*2 connected to the shaft 110. In an example embodiment, the first protrusion 108*a*2 includes an upper surface 108*f* that is downwardly-sloped, such that a first height 108*f*1 of the upper surface 108*f* has a higher elevation than a second height 108*f*2 of the upper surface 108*f*.

In an example embodiment, the lower mounting plate 106 of the tongue assembly 100*b* is formed as a separate element from the tongue 102*a*. In an example embodiment, the lower mounting plate 106 is connectable to the upper plate 108 via the use of the bolts. In other example embodiments, the lower mounting plate 106 is formed integrally, or monolithically, with the upper plate 108 of the tongue 102*a*, such that the lower mounting plate 106 is a permanent or integral portion of the tongue 102*a*.

FIG. 12B is an illustration of an upper perspective view of the second embodiment of the tongue assembly 100*b*, in accordance with an example embodiment. As shown in FIG. 12B, the one or more bolt holes 101*a* are counter-sunk, such that a counter-sunk surface 101*a*1 exists below an upper surface of the upper plate 108 of the tongue 102*a*.

Figure 13A:
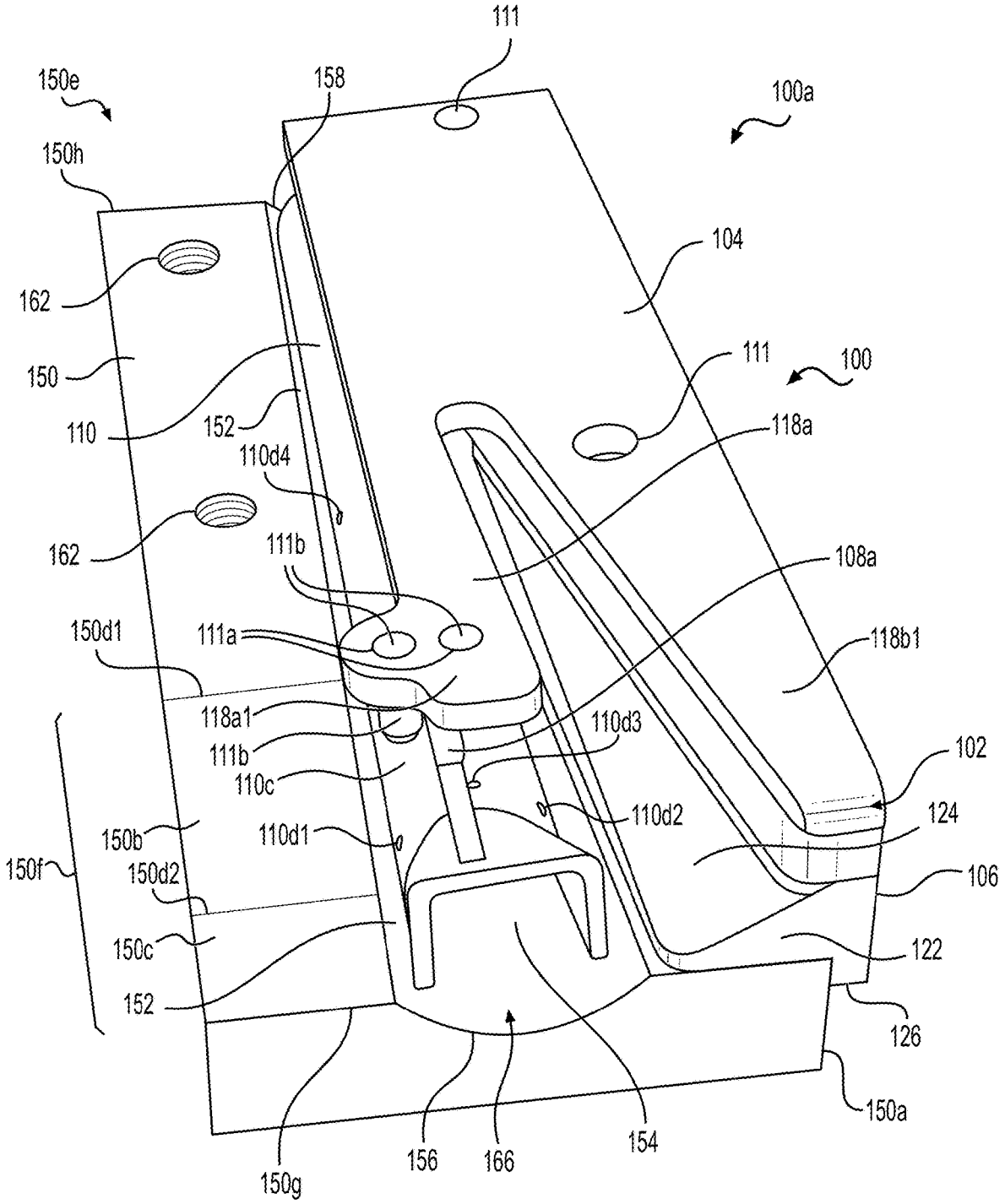
FIG. 13A is an illustration of a perspective view of the compression box, in accordance with an example embodiment.

FIG. 13A is an illustration of the compression box 100*a*, in accordance with an example embodiment. In an example embodiment, the compression box 100*a* includes the lower plate 150, where the tongue assembly 100 is mounted on the lower plate 150.

In an example embodiment, the protrusion 126 of the lower mounting plate 106 can align with a side surface 150*a* of the lower plate 150, to stabilize the tongue assembly 100 on the lower plate 150 and ensure that the tongue assembly 100 is properly aligned on the lower plate 150. In an example embodiment, the mounting bolt holes 111 of the upper mounting plate 104 align with the bolt holes 101 of the tongue 102 (FIG. 9A) and the one or more mounting bolt holes 131 of the lower mounting plate 106 (FIG. 11B), so that bolts 163 (FIG. 14) can penetrate through the tongue assembly 100 and reach one or more mounting bolt holes 164 in the lower plate 150 (see FIG. 13C). In an example embodiment, the one or more mounting bolt holes 164 of the lower plate 150 are threaded to mate with the bolts 163.

In an example embodiment, the tongue assembly 100 can be properly aligned on the lower plate 150, via the bolts 163 that penetrate through the tongue assembly 100 and mate with the one or more mounting bolt holes 164 in the lower plate 150, where the protrusion 126 provides another point of contact to align the tongue assembly 100. In an example embodiment, the one or more mounting bolt holes 164 include two mounting bolt holes in the lower plate 150, where two of the bolts 163 fasten the tongue assembly 100 to the lower plate 150, and where the protrusion 126 provides a third point of contact to align the tongue assembly 100 on the lower plate 150. In an example embodiment, when the tongue assembly 100 is properly aligned on the lower plate 150, the shaft 110 is centrally aligned with a groove 152 that runs along a longitudinal length of the lower plate 150 (shown in better detail in FIG. 13C). In an example embodiment, the groove 152 of the lower plate 150 has an arcuate shaped surface 154. In an example embodiment, an arcuate shaped inlet 156 of the groove 152 has a larger radius of curvature than an arcuate shaped outlet 158 of the groove 152. In an example embodiment, when the tongue assembly 100 is properly mounted on the lower plate 150, the inner surface 119 of the shaft 110 and the arcuate shaped surface 154 of the lower plate 150 longitudinally align to form a channel 166, where the channel 166 has a substantially circular cross-sectional flow area.

In an example embodiment, a free-side 150*e* of the lower plate 150 (a side of the lower plate 150 that is not being used to bolt the tongue assembly 100 to the lower plate 150), includes an inclined portion 150*f*. In an example embodiment, the inclined portion 150*f* provides a gradually increasing depth to the free-side 150*e* of the lower plate 150, in an example embodiment, the inclined portion 150*f* may include an upper surface that includes a flat portion 150*c*, between a front edge 150*g* of the lower plate and a valley 150*d*2 of the lower plate 150. In an example embodiment, the inclined portion 150*f* further includes an inclined surface 150*b*, between the valley 150*d*2 and a ridge 150*d*1. In an example embodiment, a remaining upper surface of the free-side 150*e* of the lower plate 150 may have a common, elevated height. The inclined portion 150*f*, with the flat portion 150*c* and the inclined surface 150*b*, can be seen in better detail in FIG. 14, where the inclined surface 150*b* has an elevation (height) 150*b*2 that increases, from a lower elevation 150*b*3 of the flat portion 150*c*, to a higher elevation 150*b*1 (starting at the ridge 150*d*1) for the remainder of the lower plate 150. In an example embodiment, a purpose of a gradual elevation of the lower plate 150, from the front edge (leading edge) 150*g* of the lower plate 150 to a back edge 150*h* of the lower plate 150, is to cause the free edge 37 of the at least one covering 31 to transition from a 'flared out' configuration (as shown in FIG. 17A) to a vertical configuration (as shown in FIG. 17B). This allows the free edge 37 of the at least one covering 31 to be in a proper orientation as the free edge 37 passes by the adhesive application 40.

In an example embodiment, the lower plate 150 includes one or more mounting bolt holes 162 that can be used to mount the lower plate 150 on the rod forming apparatus 10.

In an example embodiment, and as shown in FIG. 13A, bolts 111*b* can be threaded through the one or more bolt holes 101*a* of the upper mounting plate, where each of the bolts 111*b* may straddle and hug sides of the first protrusion 108*a* of the tongue 102. In an example embodiment, because the radius of curvature of the arcuate shaped inlet 156 of the groove 152 is larger than the arcuate shaped outlet 158, the resulting channel 166 has a smaller diameter (smaller cross-sectional flow area) from the front to the back of the channel 166, thereby compressing the tobacco rod 1*b* (FIG. 17A) as the tobacco rod 1*b* flows through the compression box 100*a*. In an example embodiment, the channel 166 can have a cross-sectional flow area that is a shape that is non-circular.

Figure 13B:
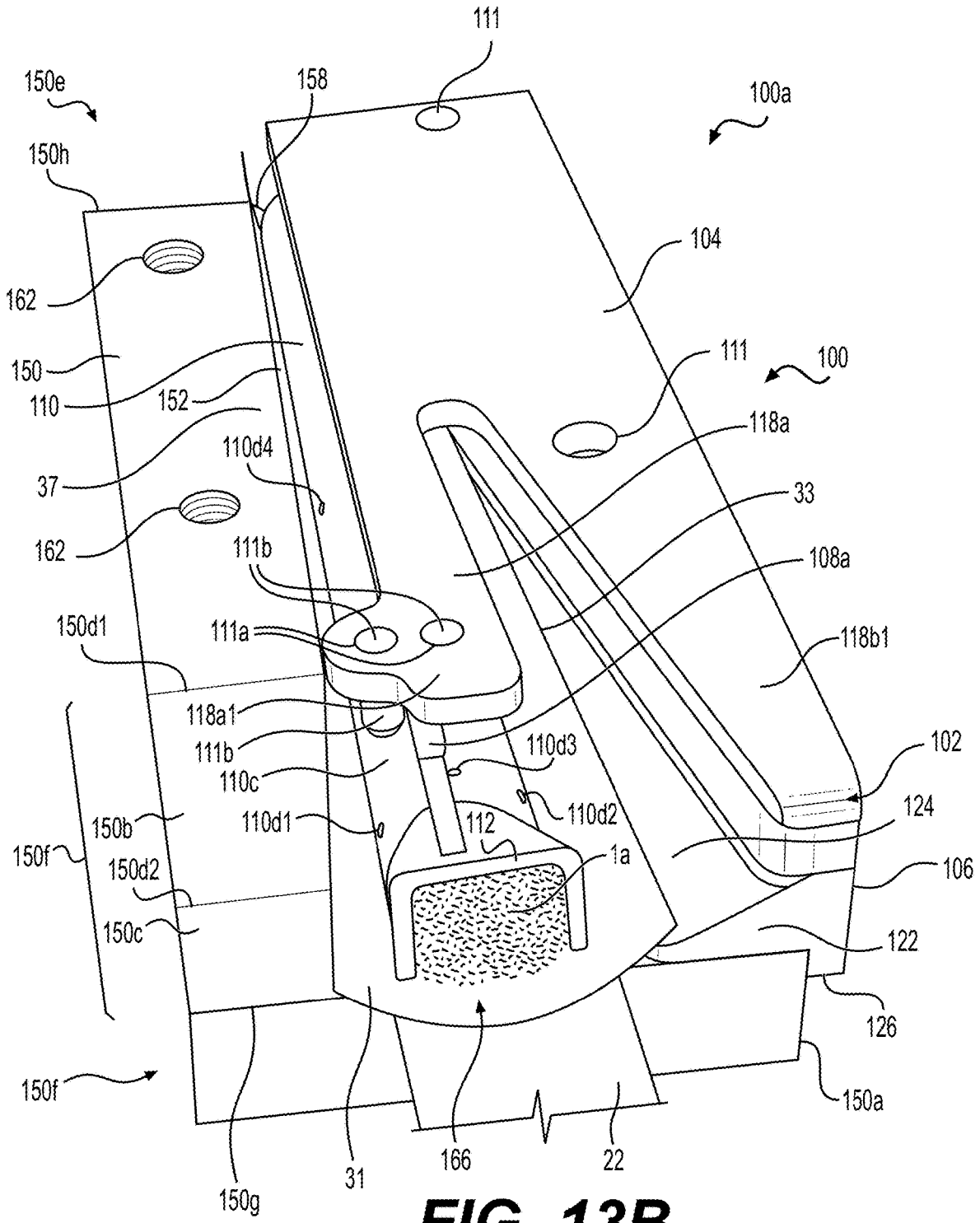
FIG. 13B is an illustration of a perspective view of the compression box, with the lower belt and the at least one covering shown passing through the compression box, in accordance with an example embodiment.

FIG. 13B is an illustration of a perspective view of the compression box 100*a*, with the lower belt 22 and the at least one covering 31 shown passing through the compression box 100*a*, in accordance with an example embodiment. In an example embodiment, and as shown in FIG. 13B, the lower belt 22 passes between the lower plate 150 and the shaft 110 of the tongue assembly 100, causing the at least one covering 31 to be moved through the compression box 100*a* as the at least one covering 31 moves on top of the lower belt 22. Movement of the lower belt 22 and the at least one covering 31 causes the tobacco column 1*a* to enter the inlet 112, and cause the tobacco column 1*a* to be compressed into the tobacco rod 1*b*, as the tobacco flows into and through the shaft 110 (as shown in FIG. 17A).

In an example embodiment, and as shown in FIG. 13B, the free edge 37 of the at least one covering 31 initially enters the compression box 100*a* in the 'flared out' configuration (also see FIG. 17A), and the tongue assembly 100 causes the free edge 37 to become slightly folded into a substantially vertical orientation (see FIG. 17B), as the free edge 37 passes through the compression box 100*a*. As discussed in association with FIG. 14, the movement of the free edge 37, from the 'flared out' configuration to the substantially vertical orientation (FIGS. 15A and 15B), is assisted at least in part by the inclined portion 150*f* of the lower plate 150.

In an example embodiment, and as shown in FIG. 13B, the folded edge 33 of the at least one covering 31 travels along the inclined surface 124 of the tongue assembly, as the inclined surface 124 directs the folded edge 33 through the compression box 100*a* and assists in folding the folded edge 33 over so that an upper surface of the folded edge 33 is folded onto a top of the tobacco rod 1*b*, as shown in at least FIG. 17B.

Figure 13C:
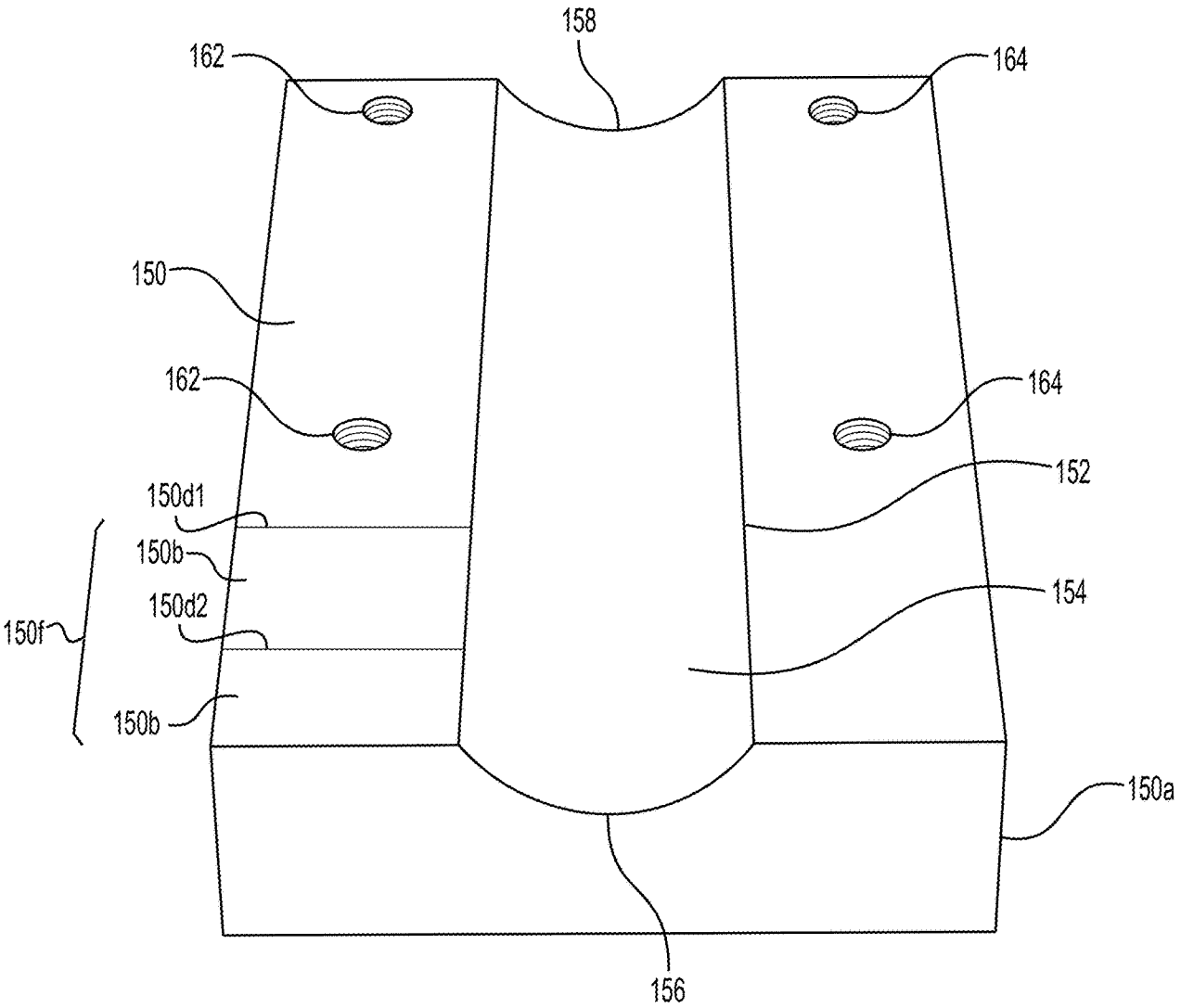
FIG. 13C is an illustration of a lower plate of the compression box, in accordance with an example embodiment.

FIG. 13C is an illustration of the lower plate 150 of the compression box 100*a*, in accordance with an example embodiment. In an example embodiment, and as shown in FIG. 13C, the groove 152 runs along an upper surface of the lower plate 150. In an example embodiment, the one or more mounting bolt holes 164 used to connect the tongue assembly 100 to the lower plate 150 are on one side of the groove 152. In an example embodiment, the mounting bolt holes 162 used to mount the lower plate 150 onto the rod forming apparatus 10 are on one side of the groove 152. In another example embodiment, the one or more mounting bolt holes 164 can be on either side of the groove 152 on the lower plate 150, just as the mounting bolt holes 162 can be on either side of the groove 152.

FIG. 14 is an illustration of a perspective view of the tongue assembly 100 of the compression box 100*a* interfacing with the in-feed section 4, in accordance with an example embodiment. In an example embodiment, a gap 92 exists between the inlet 112 of the tongue assembly 100 and the in-feed belt 20. In an example embodiment, the gap 92 allows the in-feed belt 20 to travel in front of the inlet 112, without contacting the inlet 112 or the tongue assembly 100. In an example embodiment, the tip 86 of the squeeze bars 60/62 guide the tobacco column 1*a* into the inlet 112 of the tongue assembly 100.

In an example embodiment, the lower belt 22 travels between the lower plate 150 and the tongue assembly 100 (obstructed from view in FIG. 14, but shown in better detail in FIG. 13B), where the lower belt 22 is directly below the at least one covering 31. Specifically, in an example embodiment, the lower belt 22 passes under the shaft 110 of the tongue assembly 100, where a lower surface of the lower belt 22 travels along and directly contacts the arcuate shaped surface 154 of the lower plate 150 and an upper surface of the lower plate 150 (see FIGS. 13A, 13B and 13C). In an example embodiment, the lower belt 22 can lay on top of, and pass over, the inclined surface 124 of the tongue assembly 100.

In an example embodiment, and as shown in FIG. 14, the free edge 37 of the at least one covering 31 enters the compression box 100*a* in the 'flared out' configuration (also see FIG. 17A). In an example embodiment, as the free edge 37 passes through the compression box 100*a*, between the shaft 110 and the free side 150*e* of the lower plate 150, the inclined portion 150*f* of the lower plate 150 may assist in folding the free edge 37 from the 'flared out' configuration to the substantially vertical configuration (see FIG. 17B). In an example embodiment, this folding of the free edge 37 will cause the free edge 37 to be in a proper configuration for the adhesive applicator 40 to apply the adhesive to the free edge 37 (see the adhesive 35 being applied in FIG. 17B), either after the compression box 100*a* where the adhesive applicator 40 applies the adhesive 35 at location 40*a*, or after the short folder 42 (see the adhesive applicator 40 locations, in FIG. 1).

In an example embodiment, and as shown in FIG. 14, the lap (folded) edge 33 of the at least one covering 31 enters the compression box 100*a* in a 'flared out' configuration (see FIG. 17A), and is folded over on top of the tobacco rod 1*b* as the at least one covering 31 exits the compression box 100*a* (see FIG. 17B). Specifically, the lap edge 33 of the at least one covering 31 passes through the compression box 100*a* by traveling along the inclined surface 124 (as shown in FIG. 13B), before being folded over. In an example embodiment, the short folder 42 pins the lap edge 33 down, to cause the lap edge 33 to be folded onto the tobacco rod 1*b*, as shown in FIG. 14 (where a lower surface, or the wrapper web 34 side of the at least one covering 31, is depicted between the compression box 100*a* and the short folder 42).

Figure 15A:
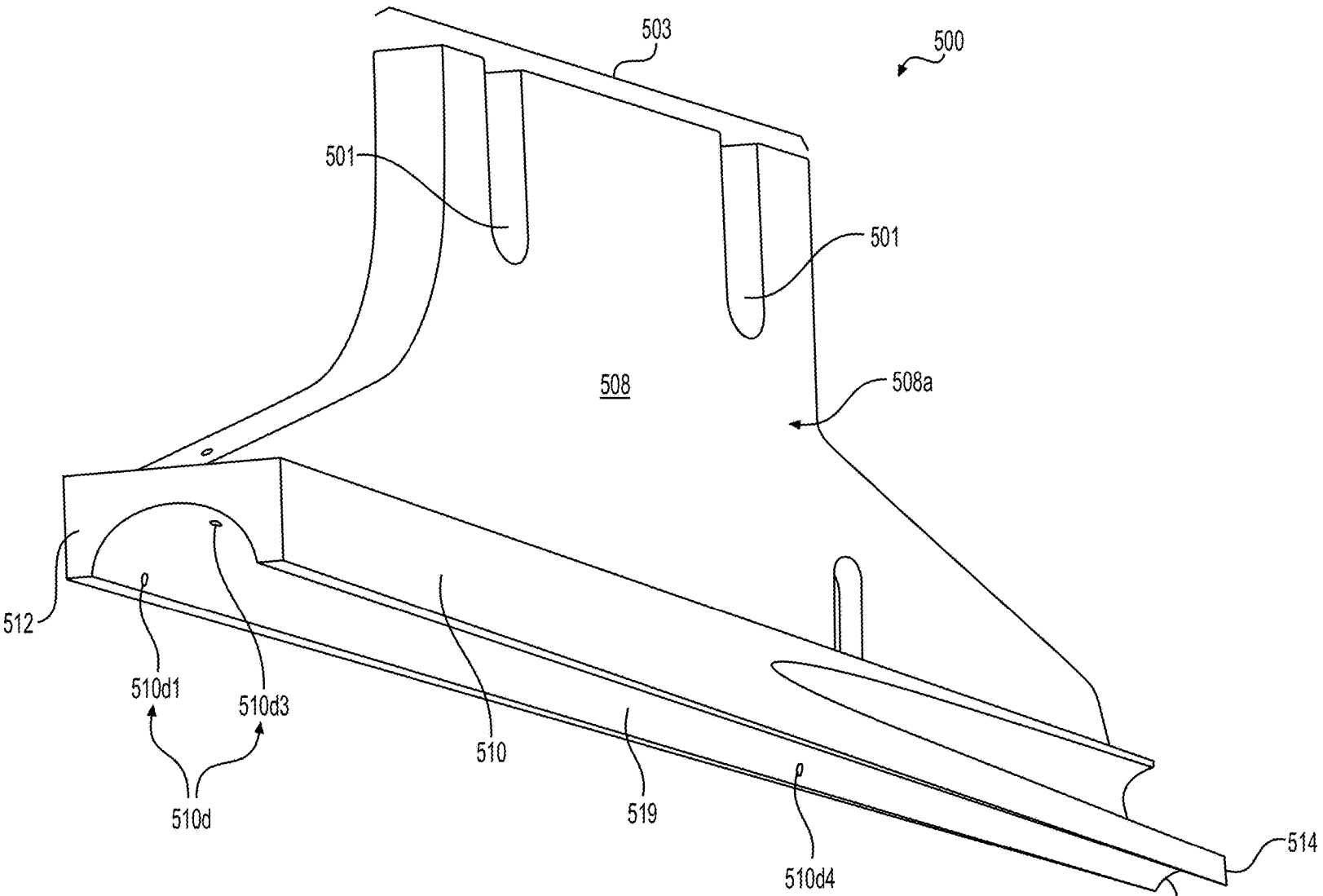
FIG. 15A is an illustration of a perspective view of a third embodiment of a tongue, in accordance with an example embodiment.

FIG. 15A is an illustration of a perspective view of a third embodiment of a tongue 500, in accordance with an example embodiment. In an example embodiment, the tongue 500 includes a major body 508. In an example embodiment, the major body 508 is a plate, or a substantially plate-shaped portion, from the standpoint that the major body 508 includes opposing flat surfaces, where a first surface 508*a* is depicted in FIG. 15A and a second surface 508*b* is shown in at least FIG. 15B. In an example embodiment, the major body 508 includes engaging structure 503 that is used to mount the tongue 500 on at least a portion of the rod forming apparatus 10 to stabilize the tongue 500. In an example embodiment, the engaging structure 503 includes one or more slots 501 that allow the tongue 500 to slid and lock into place on an arm 600 (see at least FIG. 16). In an example embodiment, the major body 508 includes a substantially flat upper surface 508*e* (FIG. 15C).

In an example embodiment, a shaft 510 runs along a bottom end (an edge) of the major body (plate) 508. In an example embodiment, the shaft 510 includes an inlet 512 and an outlet 514. In an example embodiment, the shaft 510 includes an inner surface 519 that is arcuate-shaped. Other shapes for the inner surface 519 are contemplated. In an example embodiment, a radius of curvature 519*a* of the inlet 512 is larger than a radius of curvature 519*b* of the outlet 514, and therefore the inlet 512 has a larger cross-sectional flow area as compared to a cross-sectional flow area of the outlet 514. In an example embodiment, a radius of curvature of the inner surface 519 is reduced, between the inlet 512 and the outlet 514, where this reduction in the radius of curvature may be continually and linearly reduced along a longitudinal length of the shaft 510.

In an example embodiment, discussion of the one or more injection ports 110*d*, described in relation to the example embodiments of FIGS. 9A-10C, apply equally to the example embodiment of FIG. 15A.

In an example embodiment, the shaft 510 and/or the major body 508 defines one or more injection ports 510*d*. In an example embodiment, the one or more injection ports 510*d* include the following (where some of these ports are shown in FIG. 15A, and all of these ports are shown in FIG. 15F): a first injection port 510*d*1, a second injection port 510*d*2, a third injection port 510*d*3, a fourth injection port 510*d*4, a fifth injection port 510*d*5, and a sixth injection port 510*d*6. In an example embodiment, discussion of the one or more injection ports 110*d* described in relation to the example embodiments of FIGS. 9A-10C, including a number, a shape, a location of the one or more injection ports 110*d*, and a use of the one or more injection ports 110*d* to inject the at least one substance on the inner surface 119 of the shaft 110, apply equally to the one or more injection ports 510*d* and the shaft 510 of the example embodiment of FIG. 15A. In an example embodiment, discussion of the injection of the at least one substance into the shaft 110 of the tongue 102 in relation to the example embodiments of FIGS. 9A-10C, apply equally to injection of the at least one substance into the shaft 510 of the tongue 500 of the example embodiments of FIG. 15A.

Figure 15B:
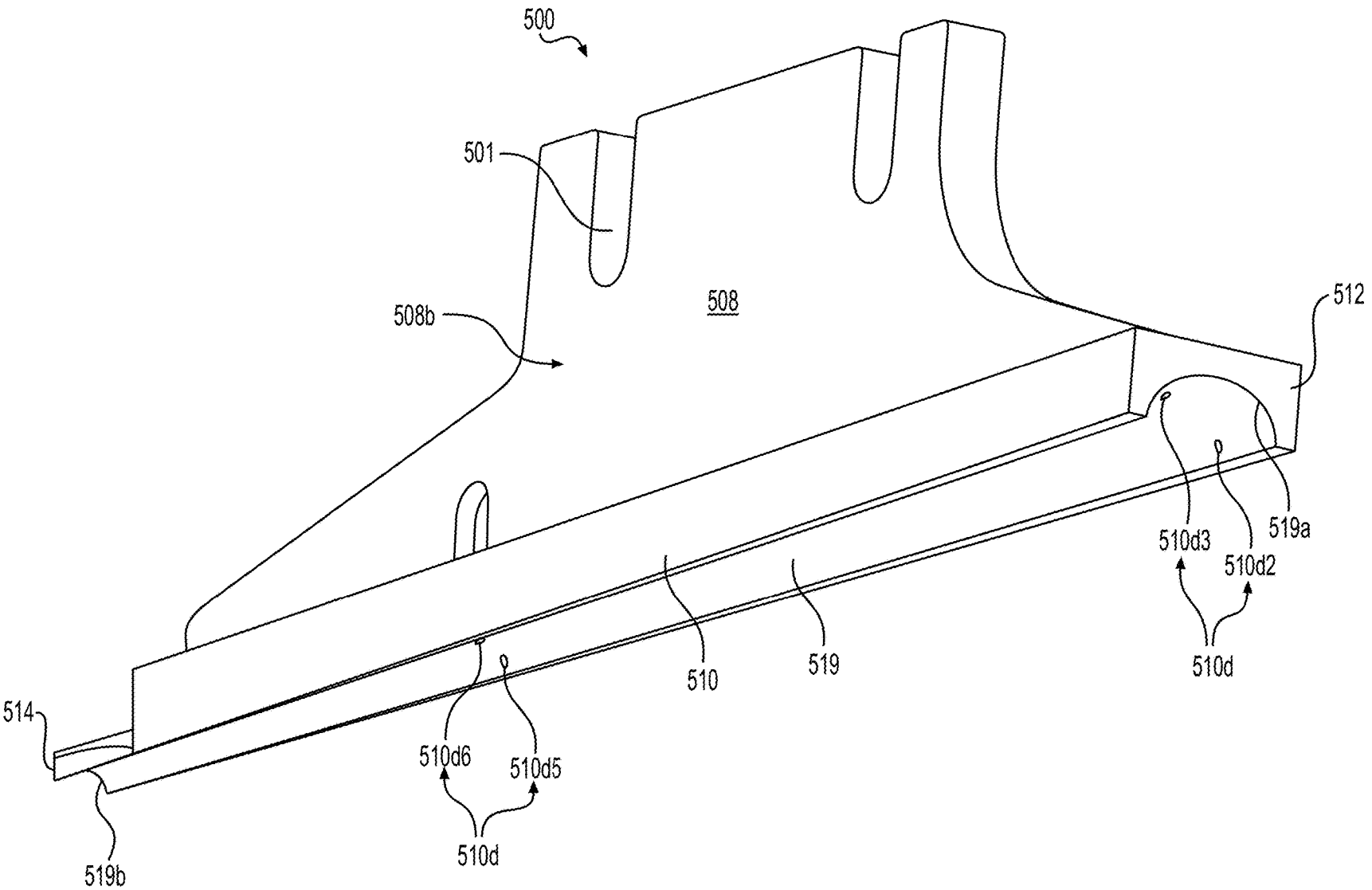
FIG. 15B is an illustration of another perspective view of the third embodiment of the tongue, in accordance with an example embodiment.
Figure 15C:
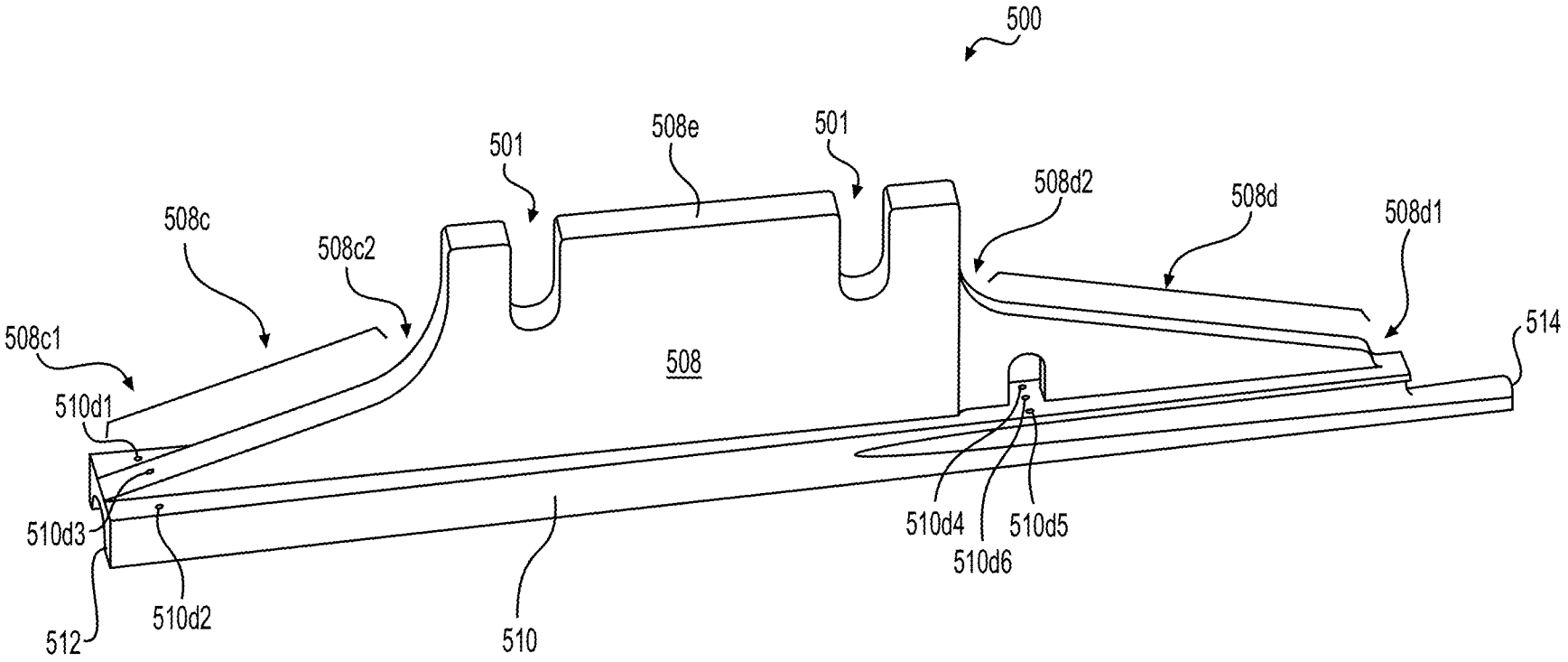
FIG. 15C is an illustration of another perspective view of the third embodiment of the tongue, in accordance with an example embodiment.

FIG. 15B is an illustration of another perspective view of the third embodiment of the tongue, in accordance with an example embodiment. In an example embodiment, and as shown in FIG. 15B, the second injection port 510*d*2 and the fifth injection port 510*d*5 are reverse tear-drop shaped, just as the first injection port 510*d*1 and the fourth injection port 510*d*4 are also reverse tear-drop shaped. In an example embodiment, these ports can be oval-shaped, or something other than circular. In an example embodiment, these ports are circular. In an example embodiment, the ports along a lowest edge of the inner surface 519 of the shaft 510 (e.g., the first injection port 510*d*1, the second injection port 510*d*2, the fourth injection port 510*d*4 and the fifth injection port 510*d*5) are reverse tear-drop shaped, tear-drop shaped, oval, or something other than circular. In another example embodiment, these ports along the lowest edge of the inner surface 519 are circular. In an example embodiment, the ports along a central portion of the longitudinal length of inner surface 519 of the shaft 510 (e.g., the third injection port 510*d*3 and the sixth injection port 510*d*6) are circular. In another example embodiment, the ports along the central portion of the longitudinal length of the inner surface are shaped to be something other than circular, such as oval-shaped, tear-drop-shaped, reverse tear-drop shaped, etc.

FIG. 15C is an illustration of another perspective view of the third embodiment of the tongue 500, in accordance with an example embodiment. In an example embodiment, and as shown in FIG. 15C, the major body 508 includes a first (lobe) extension 508*c* and a second (lobe) extension 508*d*. In an example embodiment, the first extension 508*c* and the second extension 508*d* are substantially triangular in shape. In an example embodiment, other shapes of the first extension 508*c* and the second extension 508*d* are contemplated, such as rectangular or square, etc. In an example embodiment, the major body 508 is one singular plate, that is an overall rectangular or square shape that includes the first extension 508*c* and the second extension 508*d* (e.g., the first extension 508*c* and the second extension 508*d* are not lobes that are separate from the major body 508). Other shapes of the major body 508 and/or the extensions 508*c/d* are contemplated. In an example embodiment, the first extension 508*c* includes a sloped incline 508*c*2 and/or a flattened portion 508*c*1. In an example embodiment, the flattened portion 508*c*1 helps at least partially define at least one of the one or more injection ports 510*d*.

In an example embodiment, the second extension 508*d* includes a sloped incline 508*d*2 and/or a flattened portion 508*d*1. In an example embodiment, the second extension defines an opening (slot) 508*d*3. In an example embodiment, the shaft 510 includes an upper surface 510*a* that extends along an upper portion of much of the shaft 510. In an example embodiment, the upper surface 510*a* helps at least partially define the opening 508*d*3. In an example embodiment, the upper surface 510*a* helps at least partially define some or all of the one or more injection ports (e.g., the first injection port 510*d*1, the second injection port 510*d*2, the fourth injection port 510*d*4, the fifth injection port 510*d*5 and the sixth injection port 510*d*6). In an example embodiment, the upper surface 510*a* forms an outer surface of the shaft 510 into a box (square, or rectangular) shaped shaft, with a square or rectangular shaped vertical cross-sectional profile (see for instance FIG. 15E).

Figure 15D:
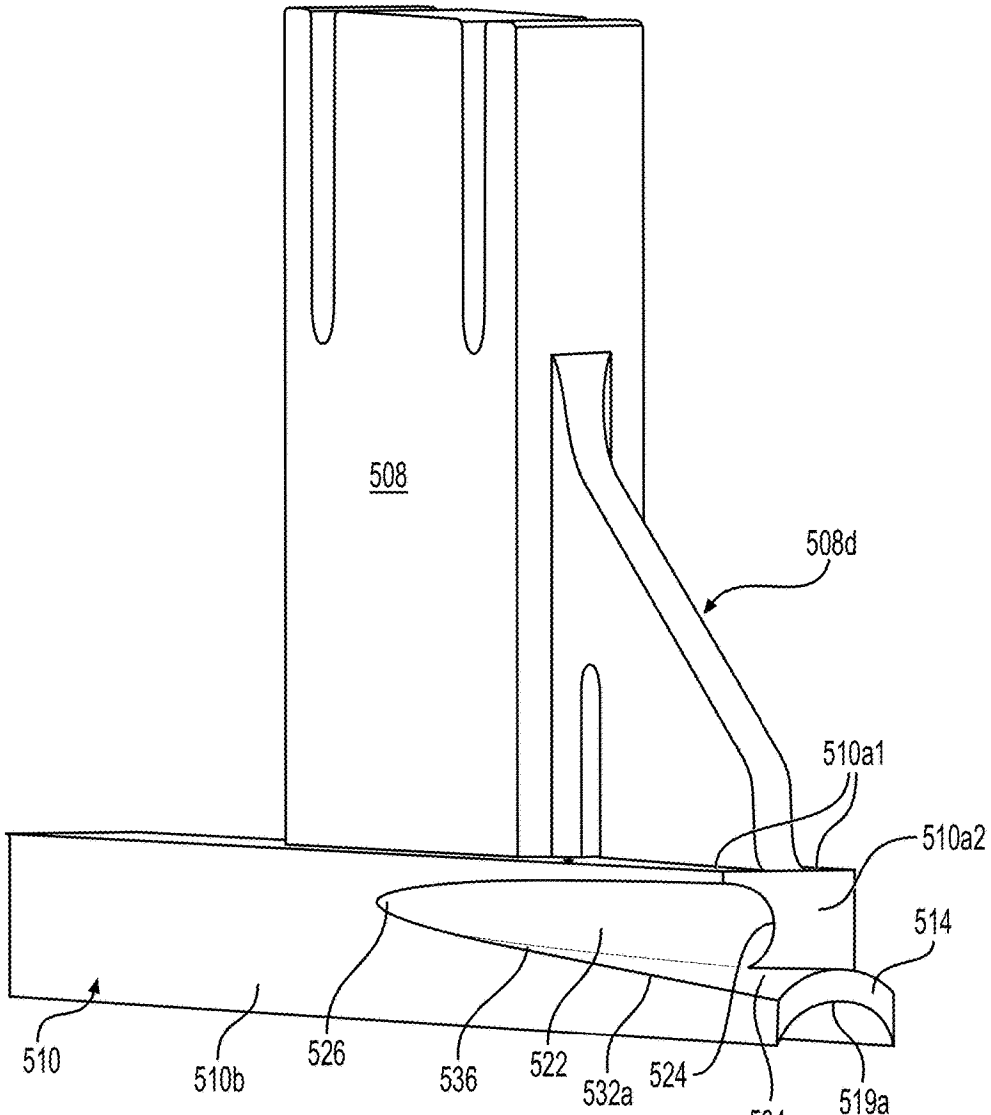
FIG. 15D is an illustration of another perspective view of the third embodiment of the tongue, in accordance with an example embodiment.

FIG. 15D is an illustration of another perspective view of the third embodiment of the tongue 500, in accordance with an example embodiment. In an example embodiment, a first end portion 510*a*1 of the upper surface 510*a* of the shaft 510 extends beyond the second extension 508*d*. In an example embodiment, a first side surface 510*b* of the shaft 510 defines an impression (groove) 522. In an example embodiment, the impression is an irregularly-shaped groove. In an example embodiment, the impression 522 includes an arcuate-shaped surface that is dug into the first side surface 510*b* of the shaft 510. In an example embodiment, the impression 522 includes a first end 526. In an example embodiment, and as shown in FIG. 15D, the first end 526 is tapered. In an example embodiment, the impression 523 includes a second end 524 that is arcuate-shaped. In an example embodiment, the impression 522 increases in width, from the first end 526 to the second end 524. Other shapes for the impression 522 are also contemplated. In an example embodiment, the outlet 514 of the shaft 510 extends beyond an end surface 510*a*2 of the shaft 510. In an example embodiment, the end surface 510*a*2 is a substantially vertically oriented surface, relative to the upper surface 510*a* of the shaft 510. In an example embodiment, an upper surface 534 of the outlet 514 extends along an upper portion of the outlet 514. In an example embodiment, the upper surface 534 is arcuate shaped. In an example embodiment, a first end edge 532*a* of the upper surface 534 extends diagonally upward, from the outlet 514 to the first end 526 of the impression 522, where an end 536 of the upper surface 534 intersects with the first end 526 of the impression 522. In an example embodiment, the shape of the impression 522, the position of the upper surface 534 relative to the impression 522, and the diagonal position of the first end edge 532*a* of the upper surface 534, combine to allow the lap edge 33 of the at least one covering 31 to gently glide across the first side 510*b* of the shaft 510 and transition to a folded position (see FIG. 17B) where an upper surface of the at least one covering 31 slides off the end of the outlet 514, without tearing the at least one covering 31 (also see FIGS. 15G and 16B).

Figure 15E:
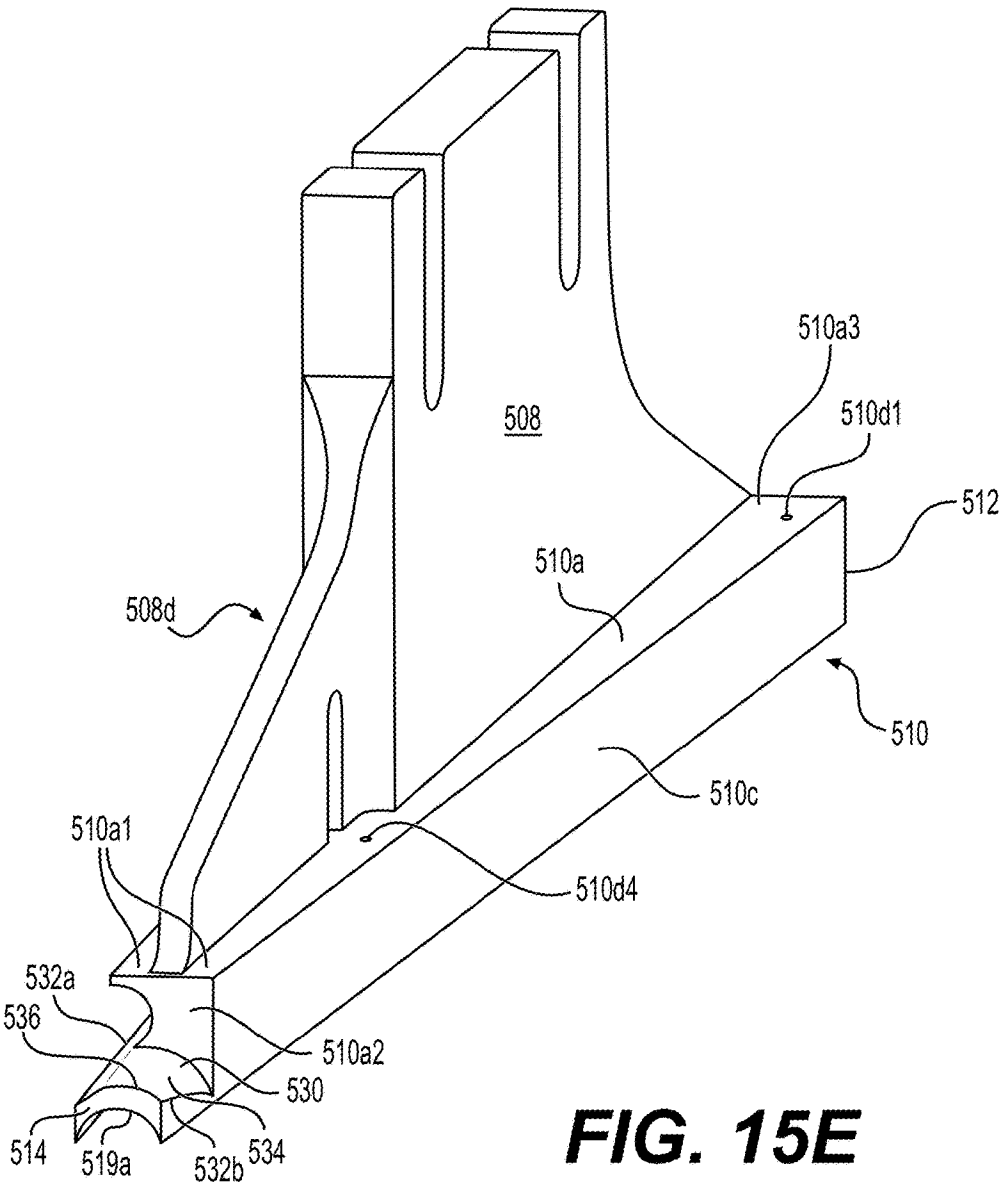
FIG. 15E is an illustration of another perspective view of the third embodiment of the tongue, in accordance with an example embodiment.
Figure 15F:
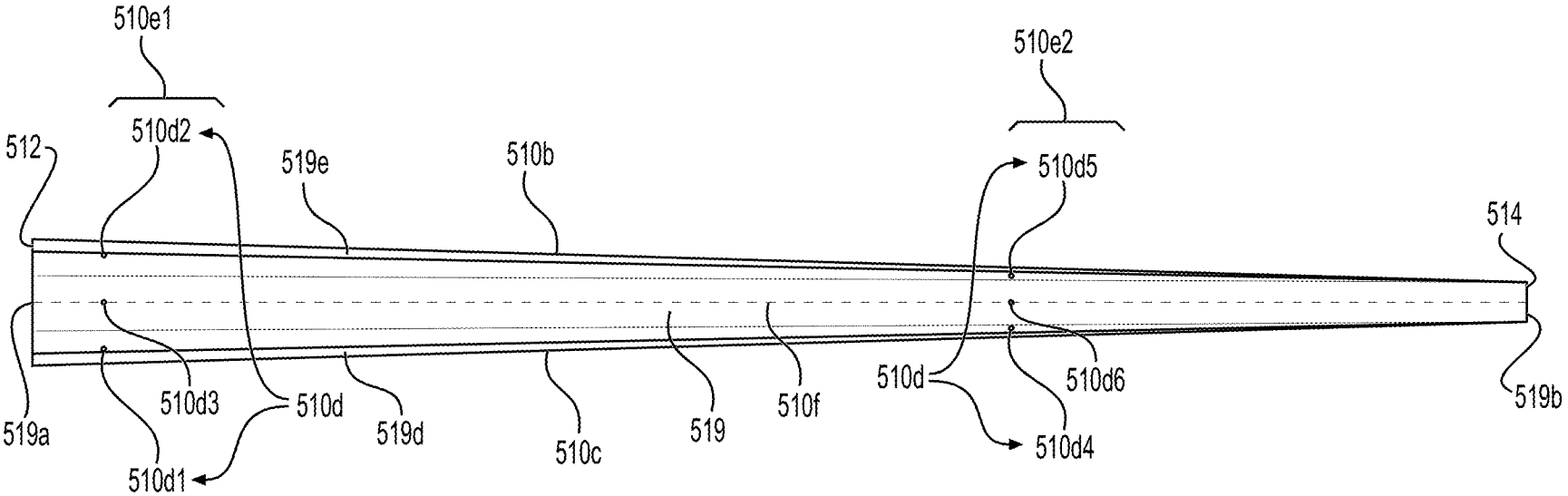
FIG. 15F is an illustration of a lower view of the third embodiment of the tongue, in accordance with an example embodiment.

FIG. 15E is an illustration of another perspective view of the third embodiment of the tongue 500, in accordance with an example embodiment. In an example embodiment, and as shown in FIG. 15E, a second end edge 532*b* of the upper surface 534 is diagonally positioned to slope downward, from the outlet 514 to the end surface 510*a*2. In an example embodiment, a width of the upper surface 534 narrows, from a first end 530 of the upper surface 534 to a second end 536 of the upper surface 534.

In an example embodiment, a second side surface 510*c* of the shaft 510, and the first side surface 510*b* (FIG. 15D) of the shaft 510, begin to converge with each other, from the inlet 512 to the outlet 514 (shown in better detail in FIG. 15F). In this example embodiment, a width of the upper surface 510*a* narrows, from a second end portion 510*a*3 to the first end portion 510*a*1 of the upper surface 510*a*.

FIG. 15F is an illustration of a lower view of the third embodiment of the tongue 500, in accordance with an example embodiment. In an example embodiment, and as discussed in relation to the example embodiment of FIG. 9B, the shaft 510 may define a single injection port, or any number of the one or more injection ports 510*d*. In an example embodiment, and as discussed in relation to the example embodiment of FIG. 9B, the shaft 510 defines the one or more injection ports 510*d* at different locations along the longitudinal length of the shaft 510. For example in an example embodiment, a first set 510*e*1 of the one or more injection ports 510*d* is located near the inlet 512 of the shaft 510, and a second set 510*e*2 of the one or more injection ports 510*d* is positioned near a mid-section of the shaft 510. In an example embodiment, the mid-section of the shaft 510 is a middle of the shaft 510, relative to the longitudinal length of the shaft 510. In an example embodiment, the second set 510*e*2 of the one or more injection ports 510*d* is located between the mid-section of the shaft 510, and the outlet 514 of the shaft 510.

In an example embodiment, the first set 510*e*1 of the one or more injection ports 510*d* includes at least three injection ports (e.g., the first injection port 510*d*1, the second injection port 510*d*2 and a third injection port 510*d*3). In this example embodiment, the first set 510*e*1 of the one or more injection ports 510*d* can be substantially evenly distributed along a circumference of the inner surface 519 of the shaft 510, as shown in FIG. 15F, and also shown in FIGS. 15A and 15B (where the first set 510*e*1 includes the first injection port 510*d*1 and the second injection port 510*d*2 respectively positioned near a first end 519*d* and a second end 519*e* of the arcuate-shaped inner surface 519, and the third injection port 510*d*3 is substantially positioned near a center of the arcuate-shaped inner surface 519). Similarly, in an example embodiment, the second set 510*e*2 of the one or more injection ports 510*d* is substantially evenly distributed along the circumference of the inner surface 519 near the mid-section of the shaft 510 (e.g., the fourth injection port 510*d*4 and a fifth injection port 510*d*5 are respectively located near the first end 519*d* and the second end 519*e* of the arcuate-shaped inner surface 519, and a sixth injection port 510*d*6 is near a center of the arcuate-shaped inner surface 519). Other shapes for the inner surface 519 of the shaft 510 are contemplated, where the one or more injection ports 510*d* are evenly distributed at one or more locations along the longitudinal length of the shaft 510.

In an example embodiment, more than two sets of injection ports (e.g. more than 510*e*1 and 510*e*2) are defined by the shaft 510.

In an example embodiment, at least some of the one or more injection ports 510*d* traverse a centerline 510*f* of the inner surface 519 of the shaft 510. In an example embodiment, at least one of the injection ports from each set of the injection ports (e.g., 510*e*1 and 510*e*2), traverses the centerline 510*f* of the inner surface 519. In an example embodiment, the centerline 510*f* is an imaginary line running along the center of the inner surface 519, along the longitudinal length of the inner surface 519. In an example embodiment, the centerline 510*f* substantially divides the inner surface 199 into equal halves (e.g., equal sides). In this example embodiment, other injection ports, of each set of injection ports (e.g., 510*e*1 and 510*e*2), are located on either side of the centerline 510*f*. In an example embodiment, the centerline 510*f* is at a center location of the circumference of the inner surface 519 of the shaft 510 (e.g., a highest elevation along the inner surface 519 of the shaft 510).

In an example embodiment, the shaft 510 defines only a single injection port. In an example embodiment, the single injection port is the third injection port 510*d*3 or the sixth injection port 510*d*6. In an example embodiment, the single injection port is defined in the shaft 110 to be positioned along the centerline 519*f*.

In an example embodiment, the shaft 510 defines only two injection ports. In an example embodiment, the two injection ports are the third injection port 510*d*3 and the sixth injection port 510*d*6. In an example embodiment, the one or more injection ports 510*d* are located between the inlet 512 and the mid-section of the shaft 510, along the longitudinal length of the shaft 510.

In an example embodiment, the one or more injection ports 510*d* are defined at any location along the longitudinal length of the shaft 510, and may include any number of injection ports.

Figure 15G:
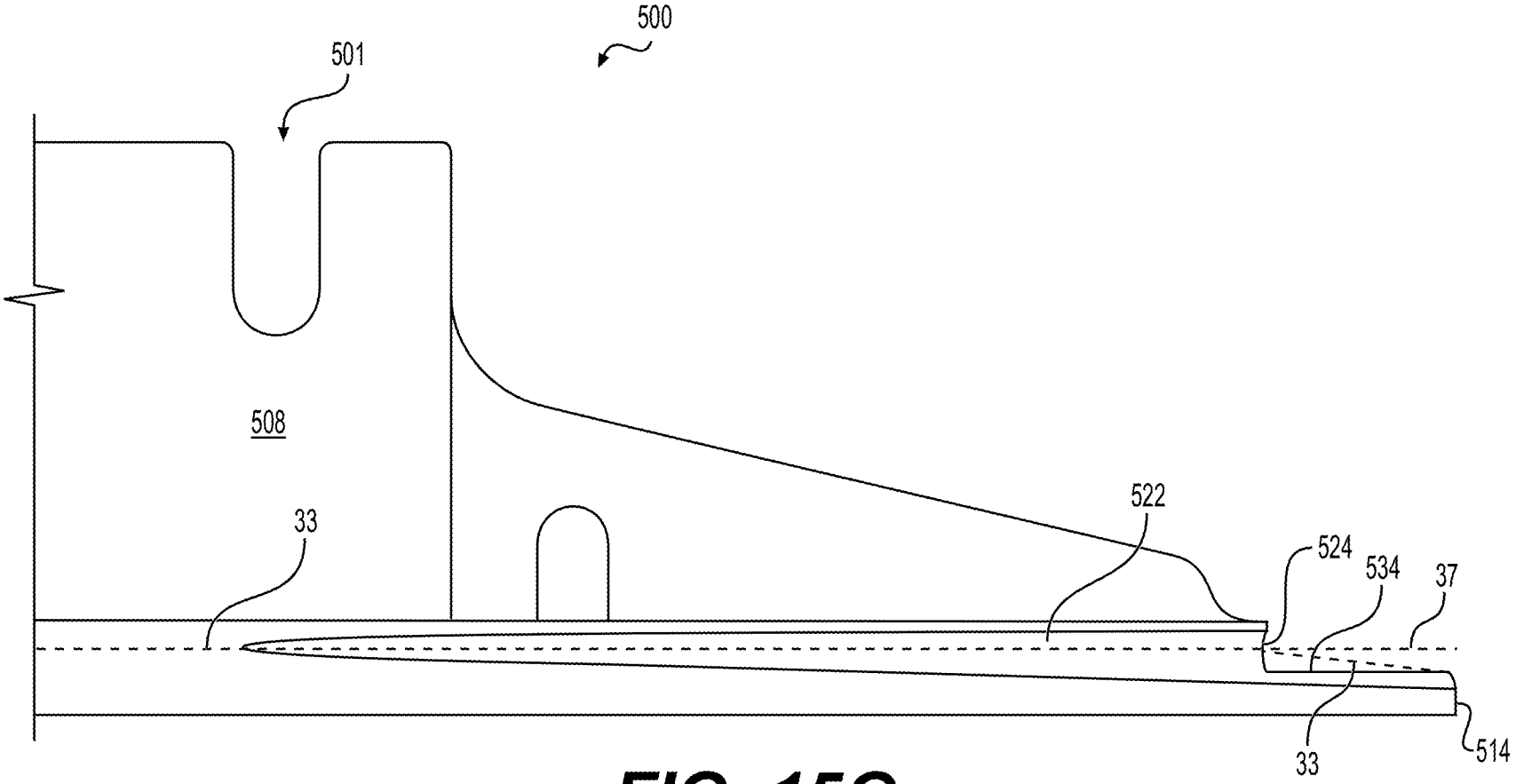
FIG. 15G is an illustration of a magnified close-up view of a portion of the side of the third embodiment of the tongue, in accordance with an example embodiment.

FIG. 15G is an illustration of a magnified close-up view of a portion of the side of the third embodiment of the tongue 500, in accordance with an example embodiment. In an example embodiment, and as shown in FIG. 15G, in operation the tongue 500 allows the lap edge 33 of the at least one covering 31 to travel along the first side 510*b* of the shaft 510, glide along the surface of the impression 522, slide off of the second end 524 of the impression 522, and fold over onto the upper surface 534 of the outlet 514, so that the lap edge 33 can then fold onto the top of the tobacco rod 1*b* (see FIG. 17B). In an example embodiment, the short folder 42 at least partially assists in causing the lap edge 33 to be folded over so that an upper surface of the at least one covering 31 (e.g., the binder web 30 side) is folded onto the upper surface 534, as shown for instance in FIG. 16B.

Figure 16A:
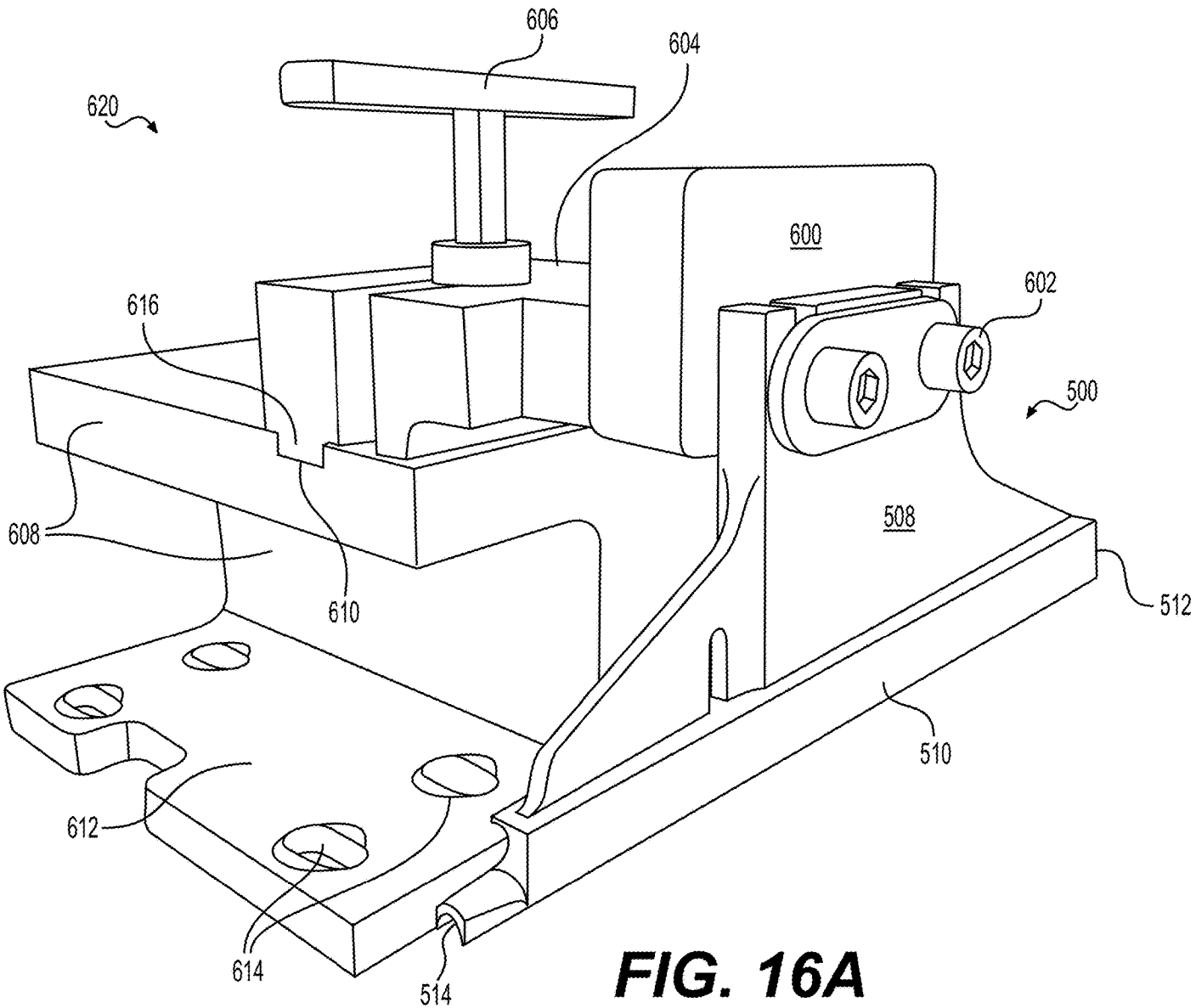
FIG. 16A is an illustration of a perspective view of the third embodiment of the tongue, being supported by an arm support device, in accordance with an example embodiment.
Figure 16B:
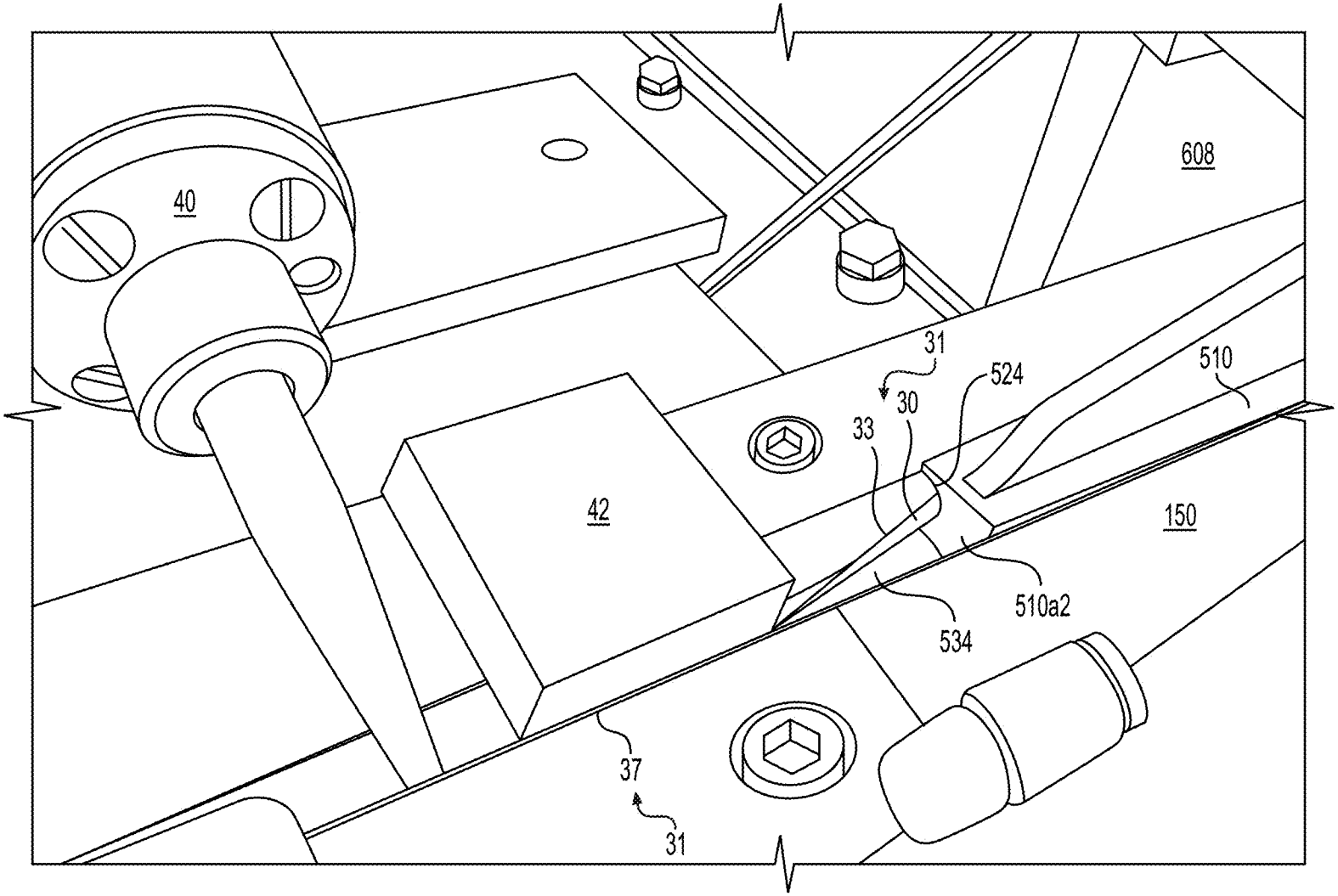
FIG. 16B is an illustration of a perspective view of the arm support device holding and stabilizing the third embodiment of the tongue within the compression box, in accordance with an example embodiment.

FIG. 16A is an illustration of a perspective view of the third embodiment of the tongue 500, being supported by an arm support device 620, in accordance with an example embodiment. In an example embodiment, the arm support device 620 holds and stabilizes the tongue 500 on the lower plate 150 of the compression box 100*a*, as shown in FIG. 16B. In an example embodiment, the arm support device 620 aligns the inner surface 519 of the shaft 510 of the tongue 500 with the groove 152 of the lower plate 150 of the compression box 100*a*, in a manner that is identical to the alignment of the shaft 110 with the groove 152 shown in the example embodiments of FIGS. 13A and 13B.

In an example embodiment, the arm support device 620 includes an arm 600 that holds the tongue 500, via an engaging structure 602. In an example embodiment, the engaging structure 602 includes bolts. In an example embodiment, the engaging structure 602 interfaces, and fits between, the one or more slots 501 of the tongue 500 to grip and hold the tongue 500 in place. In another example embodiment, the engaging structure 602 includes fasteners, clasps, hooks that are capable of gripping and/or holding a portion of the tongue 500, to stabilize the tongue 500 into a locked position over the lower plate 150 of the compression box 100*a*.

In an example embodiment, the arm 600 is connected to a main support 604. In an example embodiment, the main support 604 sits on a base 608. In an example embodiment, in an example embodiment, a groove 616 of the main support 604 slides within a groove 610 of the base to provide fine tuning of a position of the main support 604 and the arm 600 to control a placement of the tongue 500 onto the lower plate 150 of the compression box 100*a*. In an example embodiment, a handle 606 is used to tighten the main support 604 onto the base 608, where the handle is in communication with a threaded shaft that screws into a threaded hole in the base 608 (not shown). In an example embodiment, other similar structure is contemplated for attaching the main support 604 to the base 608, and/or fine tuning the position of the main support 604 on the base 608.

In an example embodiment, the base 608 includes a platform 612 that extends from the base 608. In an example embodiment, the platform 612 includes one or more elongated holes 614 that allow for the platform 612, and in turn the base 608, to be bolted onto the rod forming apparatus 10 at a location that is near the compression box 100*a*. In an example embodiment, the bolting of the platform 612 onto the rod forming apparatus 10 allows for gross positioning of the arm support device 620, where more refined positioning is accomplished by sliding the platform 612 closer or further from the compression box 100*a*, as the bolts (not shown) slide within the elongated holes 614.

In an example embodiment, and as shown in FIG. 16A, further fine positioning of the tongue 500 is accomplished via the engaging structure 602 sliding within the one or more slots 501 of the tongue 500.

FIG. 16B is an illustration of a perspective view of the arm support device 620 holding and stabilizing the third embodiment of the tongue 500 within the compression box 100*a*, in accordance with an example embodiment. In an example embodiment, and as shown in FIG. 16B, the lap edge 33 of the at least one covering 31 travels along the impression 522 of the tongue 500 (see FIG. 15G) on one side of the shaft 510, while the free edge 37 of the at least one covering 31 travels along the other side of the shaft 510. As the lap edge 33 of the at least one covering leaves the second end 524 of the impression 522, the lap edge 33 is pulled down onto the upper surface 534 of the outlet 514, so that the wrapper web 34 side of the at least one covering 31 is faced upward (see FIG. 17B). In an example embodiment, the lap edge 33 is pulled down onto the upper surface 534 by the short folder 42. In an example embodiment, once the at least one covering 31 leaves the tongue 500 to travel through the short folder 42, the at least one covering 31 is in the configuration shown in the example embodiment of FIG. 17B. In an example embodiment, once the at least one covering 31 passes through the short folder 42, the free edge 37 of the at least one covering 31 receives the adhesive 35 via the adhesive application 40. In an example embodiment, and as described above in association with at least FIG. 14, the adhesive applicator 40 can apply the adhesive before and/or after the short folder 42.

FIG. 17A is an illustration of the cross-sectional view (view A-A of FIG. 1) of the tobacco rod 1*b* being bound, in accordance with an example embodiment. In an example embodiment, and as shown in FIG. 17A, the tobacco rod 1*b* is formed by the tobacco column 1*a* flowing between the tips 86 of the horizontal portion 84 of the squeeze bars 60/62, and flowing into the inlet 112 of the tongue assembly 100, where the tobacco column 1*a* is transformed from a column with a square-shaped or a rectangular-shaped cross-section (matching a cross-section of the inlet 112) into a circular-shaped cross-section, as the tobacco column 1*a* is pressed into the circular shaped channel 166 of the compression box 100*a* (see FIG. 13A). To be clear, the tobacco rod 1*b* shown in FIG. 17A, is the cross-sectional view of the tobacco rod 1*b* after the tobacco has passed into the inlet 119*a* of the shaft 110 of the tongue assembly 100.

In an example embodiment, the lap (folded) edge 33 and free edge 37 of the at least one covering 31 remain extended, in the 'flared out' configuration relative to the tobacco rod 1*b* (as shown in FIG. 17A), where a mid-section 31*a* of the at least one covering 31 is contacting, and is partially wrapped around, a surface of the tobacco rod 1*b*, as the tobacco rod 1*b* enters the tongue assembly 100.

FIG. 17B is another illustration of the cross-sectional view (view B-B of FIG. 1) of the tobacco rod 1*b* being bound, in accordance with an example embodiment. In an example embodiment, and as shown in FIG. 17B, the tobacco rod 1*b* and the at least one covering 31 has already passed by the adhesive applicator 40, and the adhesive 35 has been applied to an upper (inner) surface of the free edge 37 of the at least one covering 31 (see FIG. 1). In an example embodiment, and as shown in FIG. 17B, the lap edge 33 is being folded toward the tobacco rod 1*b* as the tobacco rod 1*b* enters the short folder 42, where the short folder 42 is at least partially assisting in pinning the lap edge 33 down so that the lap edge 33 is laying over the tobacco rod 1*b*.

FIG. 17C is another illustration of the cross-sectional view the tobacco rod 1*b* (view C-C of FIG. 1) being bound, in accordance with an example embodiment. In an example embodiment, and in this configuration, the tobacco rod 1*b* has passed through the short folder 42 and is entering the finishing folder 44. In this configuration, the lap edge 33 has already been folded over onto the tobacco rod 1*b*, and the free edge 37 of the at least one covering 31 is extended upward and is beginning to be folded (in direction 39) over the top portion of the tobacco rod 1*b*.

FIG. 17D is another illustration of the cross-sectional view the tobacco rod 1*b* (view D-D of FIG. 1) being bound, in accordance with an example embodiment. In an example embodiment, and in this configuration, the tobacco rod 1*b* has passed through the finishing folder 44, where the free edge 37 of the at least one covering 31 has been folded over onto the lap edge 33, and the lap edge 33 and free edge 37 are pinned together on the tobacco rod 1*b* by the adhesive 35.

In an example embodiment, following the finishing folder 44, the tobacco rod 1*b* enters the heater 46 so that the heater 46 may apply heat to the at least one covering 31, in order to cure the adhesive 35 and fuse the at least one covering 31 around the tobacco rod 1*b* to form a finished rod 41. In an example embodiment, the finished rod 41 leaves the heater 46 and enters the cutter 48, to cut sections of the finished rod 41 in order to form the consumer product 300.

FIG. 18 is an illustration of the consumer product 300 that is made from the rod forming apparatus 10, in accordance with an example embodiment. In an example embodiment, the consumer product 300 is a rolled tobacco product. In an example embodiment, the consumer product 300 is a cigar. In another example embodiment, the consumer product 300 is a cigarette.

In an example embodiment, the tobacco 1 is shredded tobacco that is suitable for machine-made cigars. In an example embodiment, the tobacco 1 has a moisture content of about 10-20%, or about 12-18%. In an example embodiment, the tobacco 1 is blended pipe tobacco, or blended packing tobacco, that is suitable for packing a pipe. In an example embodiment, the tobacco 1 is a blend of various types of shredded, moist, tacky tobacco. In an example embodiment, the tobacco 1 is, for example, flue-cured tobacco, Burley tobacco, Maryland tobacco, Oriental tobacco, rare tobacco, specialty tobacco, reconstituted tobacco, or combinations thereof. In an example embodiment, the tobacco 1 is pasteurized. In another example embodiment, the tobacco 1 is fermented.

In an example embodiment, the tobacco 1 includes the at least one substance, as described above, where the at least one substance includes the at least one flavorant, the at least one additive, water (moisture), or combinations thereof. In an example embodiment, the at least one flavorant includes any natural or synthetic flavorant or aroma, such as menthol, etc. In an example embodiment, the at least one flavorant includes flavor compounds that include acids, alcohols, esters, aldehydes, ketones, pyrazines, or combinations thereof. In an example embodiment, the flavor compounds include, for example, phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, ethylacetate, isoamylacetate, propylisobutyrate, isobutylbutyrate, ethylbutyrate, ethylvalerate, benzylformate, limonene, cymene, pinene, linalool, geraniol, or combinations thereof.

In at least one example embodiment, the tobacco 1 used in the manufacture of machine-made cigars, which is made by the rod forming apparatus 10, is a pipe tobacco blend having a degree of tackiness imparted thereto.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A tongue assembly, comprising:

a tongue, the tongue including a shaft, the shaft being hollow, the shaft including a first end and a second end, the first end defining a first opening with a first radius of curvature, the second end defining a second opening with a second radius of curvature, the first radius of curvature being larger than the second radius of curvature, the shaft defining at least one injection port that traverses through an inner surface of the shaft, and a first plate connected to the shaft, the first plate including an engaging structure configured to mount the tongue onto a lower plate of a rod forming apparatus and align the shaft with a groove defined by the lower plate; and a lower mounting plate connected to a lower portion of the tongue, the lower mounting plate defining a shelf with an inclined surface that faces the shaft, the inclined surface being inclined away from the shaft from a lower elevation to an upper elevation of the lower mounting plate.

2. The tongue assembly of claim 1, wherein the first opening has a first cross-sectional flow area that is larger than a second cross-sectional flow area of the second opening.

3. The tongue assembly of claim 1, wherein the inner surface is arcuate-shaped and has a continually reducing radius of curvature from the first end to the second end of the shaft.

4. The tongue assembly of claim 2, wherein the at least one injection port is configured to inject at least one substance onto the inner surface, the at least one substance being at least one of water, at least one flavorant, at least one additive, or combinations thereof.

5. The tongue assembly of claim 1, wherein the at least one injection port traverses a centerline of the inner surface, the centerline running along a longitudinal length of the inner surface.

6. The tongue assembly of claim 5, wherein the at least one injection port includes a singular injection port.

7. The tongue assembly of claim 5, wherein the at least one injection port includes two injection ports.

8. The tongue assembly of claim 1, wherein the at least one injection port includes a first plurality of injection ports that are located at a first position along a longitudinal length of the shaft.

9. The tongue assembly of claim 8, wherein the first plurality of injection ports includes, at least one first injection port that traverses a centerline of the inner surface, the centerline running along the longitudinal length of the shaft, at least one second injection port traversing a first side of the inner surface, and at least one third injection port traversing a second side of the inner surface, the first side and the second side being on either side of the centerline.

10. The tongue assembly of claim 8, wherein the at least one injection port includes a second plurality of injection ports that are located at a second position along a longitudinal length of the shaft.

11. The tongue assembly of claim 10, wherein the first position is near the first end of the shaft.

12. The tongue assembly of claim 10, wherein the second position is near a mid-section of the shaft.

13. The tongue assembly of claim 10, wherein the second position is between a mid-section of the shaft and the second end of the shaft.

14. The tongue assembly of claim 1, wherein the engaging structure is at least one of a mounting bolt hole or a slot.

15. The tongue assembly of claim 1, wherein the shaft further includes, a tapered entrance connected to the first end of the shaft, the tapered entrance defining an enlarged opening, the first opening having a first cross-sectional flow area that is smaller than a second cross-sectional area of the enlarged opening.

16. The tongue assembly of claim 15, wherein the first cross-sectional flow area is larger than a third cross-sectional flow area of the second opening.

17. The tongue assembly of claim 15, wherein the second cross-sectional area of the enlarged opening is one of rectangular-shaped or squared-shaped.

18. The tongue assembly of claim 1, wherein the shaft runs along an edge of the first plate.

19. The tongue assembly of claim 1, wherein the first plate is connected along at least a portion of an upper surface of the shaft.

20. The tongue assembly of claim 1, wherein the first plate includes, a first protrusion on a first side of the first plate, and a second protrusion on the first side of the first plate, the first protrusion and the second protrusion defining a notch, and the first protrusion runs along at least part of an upper portion of a longitudinal length of the shaft.

21. The tongue assembly of claim 20, wherein a lower end of the lower mounting plate includes a third protrusion, the third protrusion running substantially underneath the second protrusion, the third protrusion being positioned to at least partially align and mount the tongue assembly onto the lower plate.

22. A tongue assembly, comprising:

a tongue, the tongue including a shaft, the shaft being hollow, the shaft including a first end and a second end, the first end defining a first opening with a first radius of curvature, the second end defining a second opening with a second radius of curvature, the first radius of curvature being larger than the second radius of curvature, the shaft defining at least one injection port that traverses through an inner surface of the shaft, and a first plate connected to the shaft, the first plate including an engaging structure configured to mount the tongue onto a lower plate and align the shaft with a groove defined by the lower plate, the first plate including a first protrusion on a first side of the first plate and a second protrusion on the first side of the first plate, the first protrusion and the second protrusion defining a notch, the first protrusion running along at least part of an upper portion of a longitudinal length of the shaft; and a lower mounting plate connected to a lower portion of the tongue, the lower mounting plate including a shelf, the shelf extending from an inner side of the lower mounting plate toward the shaft, the shelf including an inclined surface, the inclined surface being upwardly facing and inclined away from the shaft from a lower elevation to an upper elevation of the lower mounting plate, the inclined surface being configured to at least partially assist in folding a lap edge of at least one covering of a rolled consumer product toward an upper surface of the shaft, as the lap edge of the at least one covering travels through a third opening defined by the tongue assembly.

23. The tongue assembly of claim 22, wherein the third opening is at least partially defined by the inclined surface and a side of the shaft.

24. A tongue assembly, comprising:

a tongue, the tongue including a shaft, the shaft being hollow, the shaft including a first end and a second end, the first end defining a first opening with a first radius of curvature, the second end defining a second opening with a second radius of curvature, the first radius of curvature being larger than the second radius of curvature, the shaft defining at least one injection port that traverses through an inner surface of the shaft, and a first plate connected to the shaft, the first plate including an engaging structure configured to mount the tongue onto a lower plate and align the shaft with a groove defined by the lower plate, the first plate including a first protrusion on a first side of the first plate and a second protrusion on the first side of the first plate, the first protrusion and the second protrusion defining a notch, the first protrusion running along at least part of an upper portion of a longitudinal length of the shaft;

a lower mounting plate connected to a lower portion of the tongue; and an upper mounting plate, a first surface of the upper mounting plate mating with an upper surface of the first plate and a second surface of the lower mounting plate mating with a lower surface of the first plate, the upper surface, the lower surface, the first surface, and the second surface each being substantially flat.

25. The tongue assembly of claim 24, wherein the upper mounting plate includes a fourth protrusion and a fifth protrusion, the fourth protrusion mating with the first protrusion and the fifth protrusion mating with the second protrusion.

26. The tongue assembly of claim 25, wherein the fourth protrusion defines at least two bolt holes, the at least two bolt holes being on either side of the first protrusion, the at least two bolt holes being configured to align the first plate with the upper mounting plate.

27. The tongue assembly of claim 24, wherein the first plate defines a first notch, and the upper mounting plate defines a second notch, the first notch and the second notch being substantially aligned with each other.

28. The tongue assembly of claim 27, where the first notch and the second notch are both substantially V-shaped.

29. A rod forming apparatus, comprising:

an in-feed section configured to convey a column of tobacco in a downward direction;

a finishing section configured to receive the column of tobacco, the finishing section being configured to roll the column of tobacco into a wrapped tobacco rod, the finishing section including a tongue assembly, the tongue assembly including, a tongue, the tongue including a shaft, the shaft being hollow, the shaft including a first end and a second end, the first end defining a first opening with a first radius of curvature, the second end defining a second opening with a second radius of curvature, the first radius of curvature being larger than the second radius of curvature, the shaft defining at least one injection port that traverses through an inner surface of the shaft, and a first plate connected to the shaft, the first plate including an engaging structure configured to mount the tongue onto a lower plate and align the shaft with a groove defined by the lower plate; and a lower mounting plate connected to a lower portion of the tongue, the lower mounting plate defining a shelf with an inclined surface that faces the shaft, the inclined surface being inclined away from the shaft from a lower elevation to an upper elevation of the lower mounting plate.

30. The rod forming apparatus of claim 29, wherein the in-feed section includes, an upper belt and an in-feed belt, the upper belt and the in-feed belt defining a descending channel, the descending channel being configured to convey the column of tobacco in the downward direction, a pair of squeeze bars that are configured to receive the column of tobacco from the descending channel, the pair of squeeze bars being configured to compress the column of tobacco, a lower belt configured to move the column of tobacco through the pair of squeeze bars and into the finishing section, and the lower belt being further configured to move at least one covering, positioned below the column of tobacco, into the finishing section.

31. The rod forming apparatus of claim 29, wherein the finishing section further includes, a compression box, the compression box including a lower plate defining a groove, wherein the shaft of the tongue is configured to longitudinally align with the groove, the compression box being configured to further compression the column of tobacco into a tobacco rod, an adhesive applicator, the adhesive applicator being configured to apply an adhesive to a portion of the at least one covering, one or more folders downstream of the compression box, the one or more folders being configured to fold the at least one covering, with the adhesive, around the tobacco rod, and a cutter, the cutter being configured to cut the tobacco rod into rolled consumer products.

32. The rod forming apparatus of claim 29, wherein the at least one injection port is configured to inject at least one substance onto the inner surface, the at least one substance being at least one of water, at least one flavorant, at least one additive, or combinations thereof.

* * * * *